United States Patent [19]

Rose et al.

[11] Patent Number: 4,998,960

[45] Date of Patent: Mar. 12, 1991

[54] MUSIC SYNTHESIZER

[75] Inventors: Floyd D. Rose, 5303 154th Ave. SE., Bellevue, Wash. 98006; John C. Ragin, III; Ronald H. Randall, Jr., both of Bellevue, Wash.

[73] Assignee: Floyd Rose, Bellevue, Wash.

[21] Appl. No.: 252,568

[22] Filed: Sep. 30, 1988

[51] Int. Cl.[5] ..... G10H 7/00; G10H 1/02

[52] U.S. Cl. ..... 84/622; 84/602; 84/604; 84/624; 84/625; 84/626; 84/627; 84/632; 84/DIG. 1; 84/DIG. 12

[58] Field of Search ..... 84/1.01, DIG. 2, DIG. 1, 84/1.28, DIG. 12, 1.09, 1.03, DIG. 26, DIG. 27, 1.19, 1.27, DIG. 9, 29, 1.20–1.23, 1.13, 1.26, 1.10–1.12, 115, 462, 601, 602, 604, 605, 607, 609, 615, 617, 618, 622–627, 632, 647, 653, 656, 658–659, 662; 381/51, 53, 61, 63

[56] References Cited

U.S. PATENT DOCUMENTS

| | | | |
|---|---|---|---|
| 4,033,219 | 7/1977 | Deutsch | 84/1.01 X |
| 4,050,343 | 9/1977 | Moog | 84/1.19 X |
| 4,138,915 | 2/1979 | Nagai et al. | 84/1.01 X |
| 4,181,059 | 1/1980 | Weber | 84/DIG. 12 |
| 4,184,403 | 1/1980 | Whitefield | 84/1.19 X |
| 4,185,531 | 1/1980 | Oberheim | 84/1.28 X |
| 4,201,105 | 5/1980 | Alles | 84/1.27 X |
| 4,202,234 | 5/1980 | Comerford | 84/1.01 |
| 4,202,239 | 5/1980 | Southard et al. | 84/DIG. 2 |
| 4,305,319 | 12/1981 | Linn | 84/1.01 |
| 4,344,347 | 8/1982 | Faulkner | 84/1.26 |
| 4,387,619 | 6/1983 | Kashio | 84/1.03 |
| 4,463,650 | 8/1984 | Rupert | 84/1.01 X |
| 4,476,765 | 10/1984 | Hentzschel et al. | 84/1.01 X |
| 4,478,124 | 10/1984 | Kikumoto | 84/1.19 |
| 4,481,851 | 11/1984 | Swain et al. | 84/1.01 |
| 4,577,540 | 3/1986 | Yamana | 84/1.27 |
| 4,644,840 | 2/1987 | Franz et al. | 84/1.01 |
| 4,677,890 | 7/1987 | Yannes | 84/DIG. 9 |
| 4,713,996 | 12/1987 | Oguri | 84/1.28 X |
| 4,736,663 | 4/1988 | Wawrzynek et al. | 84/DIG. 9 |
| 4,779,505 | 10/1988 | Suzuki | 84/1.1 X |

FOREIGN PATENT DOCUMENTS 0169659 6/1985 European Pat. Off. .

OTHER PUBLICATIONS

"Imitating Musical Instruments with Synthesized Sound", *Popular Electronics,* Aug. 1975, pp. 37–39 and 44.

*Primary Examiner*—A. T. Grimley
*Assistant Examiner*—Matthew S. Smith
*Attorney, Agent, or Firm*—Lerner, David, Littenberg, Krumholz & Mentlik

[57] ABSTRACT

A music synthesizer is constructed according to a modular scheme with plural, substantially interchangeable voice units. During operation, these voice units are used to simulate different instruments. The voice units operate under control of a master computer, and take waveform data from a common memory through a common digital data bus. The actions of each voice unit in simulating a note are controlled according to a plurality of control parameters. These control parameters are derived by interpolating between plots of each control parameter versus time for a weak actuation (soft note) and a strong actuation (hard note) condition. The synthesizer is arranged to simulate the effects caused by the interactions between closely spaced excitations of the same instrument such as closely spaced strikes upon a drumhead, by varying the qualities of the sound. The synthesizer may also serve as a mixer or as a multichannel signal processing device.

51 Claims, 17 Drawing Sheets

240
INPUT GAIN
DECAY RATE
THRESHOLD
RUMBLE GAIN
RESET
HIT
PEAK VAL.
272
338
348
310
372
374
296
246a
48
240
INPUT GAIN
DECAY RATE
THRESHOLD
RUMBLE GAIN
RESET
HIT
PEAK VAL.
246b
42
240
INPUT GAIN
DECAY RATE
THRESHOLD
RUMBLE GAIN
RESET
HIT
PEAK VAL.
246n
48
48
D/A
244
A/D
245
247
INTERFACE
242
247
49

| FIG. 6A |
|---|
| FIG. 6B |

WHEEL
ENTER
FAST REV
FAST FWD
REC
PLAY
LABEL
LABEL
LABEL
LABEL
LABEL
LABEL
54
501
502
502
506
508
509
510
512
514
516
518
518
518
520
520
520
522
524
546
500

SERIAL INT
LCD CONTROL
ENCODE
A/D
A/D
36
500
506
508
518
520
522
524
526
528
530
530
532
534
536
538
540

| | |
|---|---|
| FIG. 17A | |
| FIG. 17B | |

MUSIC SYNTHESIZER

The present invention relates to musical synthesizers.

Substantial effort has been devoted in recent years to development of electronic musical instruments, commonly referred to as "synthesizers." A synthesizer ordinarily is arranged to accept input signals such as keystroke signals representing the musician's action and produce output signals in the audio frequency range. These output signals may be directed to equipment such as a loudspeaker and reproduced in the form of sound. The synthesizer may be arranged to provide output signals simulating the sounds of a conventional, known musical instrument. Alternatively, the synthesizer may be arranged to simulate sounds which would be emitted by a theoretical instrument having predetermined characteristics different from those of any real instrument. Thus, the synthesizer may produce sounds unattainable by conventional musical instruments.

Music synthesis is a formidable technical task. Real musical instrument produce complex blends of many different frequencies imparting what is commonly referred to as a "tone color" to the sound. Percussive sounds such as those made by a drum, cymbal or the like are aperiodic functions which cannot be fully described by any simple mathematical expression. Whether a synthesizer is intended to simulate a real instrument or a theoretical instrument, it should provide sounds as rich and complex as those of a real instrument. Moreover, the synthesizer should respond to the nuances of the musician's inputs For example, a synthesizer intended to simulate a percussive sound such as a drum sound may be equipped with a pad or other device for detecting strikes of a drumstick. The synthesizer should respond to variations in striking technique so as to provide a realistic musical effect. In a real instrument, the sound produced varies in many subtle ways as the striking force or key depression force changes. Thus, characteristics such as loudness and duration of the sound, the frequency spectrum of the sound and the like all change as the striking force changes.

As taught in European Patent Application 0 169 659, a simulator for a keyboard instrument may be equipped with a memory storing digitally sampled and encoded waveform data representing the real sound of each note played at each of several possible intensities. When the musician actuates a key, the appropriate waveform is selected depending on the key activated and the intensity of the strike. The so-selected waveform is converted into an output signal. In this arrangement, the synthesizer in effect merely plays back recordings of individual notes. Each waveform is stored as a series of individual data words each representing a single sample of the amplitude of the waveform at a particular time. To achieve acceptable fidelity, any such stored waveform must include tens of thousands of samples per second of stored sound. The memory required to store each waveform is substantial and the memory required to store all of the required waveforms is accordingly large.

Other synthesizers have been arranged to store one or a few waveforms representing the sounds of a musical instrument. The synthesizers are arranged to replay the stored waveform upon actuation by the musician, and alter or mix one or several stored waveforms dependent upon actuation force. Thus, Nagai, U.S. Pat. No. 4,138,915 discloses an instrument wherein plural waveforms are read from a digital memory and blended in varying proportions according to a function of time. This function of time may depend upon the keystroke force. Faulkner, U.S. Pat. No. 4,344,347 discloses a further synthesizer utilizing a set of stored digital values as a record of a waveform to be simulated. An amplitude envelope or relationship between amplitude of the output signal and time is generated such that the envelope is defined by exponential functions having time constants scaled in accordance with keystroke velocity. In an alternative arrangement (column 26 of the reference) a filter is controlled in accordance with the touch response signal or in accordance with the envelope parameters so as to vary the frequency spectrum of the output signal, and hence the tone color in accordance with keystroke velocity.

Oguri, U.S. Pat. No. 4,713,996 discloses a simulator having loud tone and soft tone waveforms for each of various percussion instruments stored in a memory. To produce a tone for a strike of intermediate amplitude, both the loud tone and soft tone waveforms are read out from the memory and mixed at a mixing ratio corresponding to the strength of the strike. Comerford, U.S Pat. No. 4,202,234 discloses a further instrument employing interpolation between values taken from plural stored waveforms. Kikumoto, U.S. Pat. No. 4,478,124 discloses a keyboard actuated synthesizer wherein numerous parameters determining operation of the synthesizer and the characteristics of the notes produced thereby can be set by adjustable potentiometers. The instruments may be arranged so that at one extreme setting of the potentiometer, the characteristics simulate those of a piano whereas at the other extreme setting the characteristics simulate those of a harpsichord. Settings intermediate between these values produce interpolated characteristics. In an alternative embodiment, interpolated values of the individual characteristics may be selected for each note depending upon the key strike force.

Deutsch, U.S. Pat. No. 4,033,219 discloses a touch responsive keyboard instrument wherein the relative amplitudes of various harmonics in the output signal are scaled in accordance with key velocity. Lynn, U.S. Pat. No. 4,305,319 discloses a synthesizer for simulating drums or other percussive instruments wherein a plurality of modular units, each including a read only memory and an analog-to-digital converter are provided. Each modular unit further includes a voltage controlled oscillator. The read only memory stores a digital waveform record of an actual drumstrike. The analog-to-digital conversion device is arranged to read out the contents of the memory at a speed controlled by the frequency of the voltage controlled oscillator. Thus, the device can be actuated to simulate a relatively high pitched or relatively low pitched rendition of the same prerecorded sound by varying the speed at which the contents of the memory are read.

Despite all of these developments, however, the synthesizers utilized heretofore to simulate the sounds of percussion instruments such as drums do not deliver the full, rich range of sound associated with a real drum performance. Moreover, percussion synthesizers available heretofore do not respond properly to the subtle inputs which the musician may apply to achieve subtle variations in the percussion sound.

In many cases, it is desirable to use a real percussion instrument such as a real drum as an input or triggering device for the synthesizer. Thus, even though the musician may have a real drum at hand, it may be desirable to use the synthesizer to provide a drum sound simulating a higher quality drum or a drum having different tone quality. In theory, the sound produced by the simulator would be the same regardless of whether the musician actuates the synthesizer by striking a drum or by depressing a key on a keyboard or even by entering commands on a computerlike console. However, none of these alternatives would be appealing to the musician as they do not provide the physical sensation or "feel" of a real instrument.

There are considerable difficulties in transforming a strike on a real drum into electronic signals indicating that the instrument has been struck and the magnitude of the strike so as to provide accurate input signals to the synthesizer. After a real drum has been struck, the drum head continues to vibrate for a considerable period of time. The residual vibrations remaining some time after a hard strike may be of greater magnitude than the initial vibration occurring in response to a relatively soft strike. Therefore, it is difficult to determine when a drum has been struck merely by observing the vibration of the drumhead or by monitoring an electronic signal representing such vibration, such as the signal from a transducer connected to the drumhead.

A further problem arises when the number of output signals to be provided simultaneously exceeds the capacity of the synthesizer. A realistic musical note or percussion sound persists for some time after it begins. Where the musician provides inputs in rapid succession, these closely-spaced inputs call for sounds overlapping one another in time. For perfect realism, plural output signals simulating plural notes must be emitted simultaneously. In a drum simulator as contemplated by the aforementioned Lynn, U.S. Pat. No. 4,305,319, each of the plural modular units is arranged to reproduce the sounds from one and only one instrument in a percussion instrument ensemble. Thus, one unit is arranged to reproduce the sound of a snare drum, another to reproduce the sound of a bass drum and so on. The capacity problem is particularly severe in apparatus of this type. Successive output signals simulating sounds from the same instrument cannot overlap one another at all, although sounds simulating different instruments may overlap.

Other synthesizers arranged to simulate piano or organlike instruments have been provided with plural sound production channels or "voice units", any one of which can be used to reproduce sounds simulating any of plural keys. In these, arrangements, the voice units can be reassigned as needed so that output signals simulating plural sounds, including plural sounds created by the same element or string can be sounded at the same time. Nonetheless, where the total number of output signals to be emitted simultaneously exceeds the number of available voice units, some of the output signals must be omitted.

Various schemes have been proposed for selecting the sound to be omitted. Swain et al., U.S. Pat. No. 4,481,851 teaches a voice unit allocation system in which the system responds to the condition where all of the voice units are occupied by terminating the action of the voice unit simulating the oldest note and then reassigning that voice unit to provide an output signal simulating a note produced by a newly struck key. Southard et al., U.S. Pat. No. 4,202,239 allocates voice units in a keyboard organ by monitoring a function related to the decay of the output signal. When a new key is struck, and all of the voice units are occupied, the voice unit which is furthest into its decay mode of operation is seized and used to produce the new note. Thus, the decaying note previously sounded by that voice unit is terminated. Where a single key is repetitively struck, the same voice unit is repeatedly used for that note.

These voice unit allocation schemes, however, leave much to be desired particularly where the synthesizer must simulate the sounds produced by plural different instruments played at random times, with repetitive sounding of some instruments in the ensemble. For example, where the synthesizer must simulate the sound produced by a conventional percussion instrument ensemble including several different drums and other percussive instruments, the voice unit allocation schemes depending solely upon times or degree of output signal decay do not provide fully satisfactory results.

Moreover, the synthesizers available heretofore have been ill-suited to the varied needs of different musicians. High-quality synthesizers suitable for use by accomplished professional musicians are too expensive and too complex for the beginner. A synthesizer affordable and usable by a beginner does not provide adequate sound quality for the accomplished professional. Also, synthesizers heretofore have been used merely to replace or enhance one or more traditional instruments. The musician using the synthesizer must still contend with all of the other electronic devices used in modern performance sound systems and recording studios, and must also bear the expense of these additional items. Little thought has been given heretofore to integration of the synthesizer with other electronic devices used by the musician. Moreover, the manual controls provided for synthesizers heretofore have been difficult to master. Thus, a typical synthesizer may have many different control knobs and switches and the like all arranged in seemingly random fashion. These random arrangements do not lend themselves to easy mastery by the musician.

Accordingly, there have been unmet needs heretofore for improvements in synthesizers and components thereof.

SUMMARY OF THE INVENTION

One aspect of the present invention provides a synthesizer including reproduction means for accepting input signals and producing output signals responsive to the input signals such that the output signals simulate sounds emitted by a vibratory element of a real or theoretical musical instrument. The synthesizer according to this aspect of the present invention most preferably includes overlap means for determining if the input signals call for the reproduction means to provide overlapping output signals simulating overlapping sounds emitted by the vibratory element in response to closely spaced excitations of such element separated in time by only brief intervals. The overlap means is arranged to vary at least one of the output signals in response to such determination to simulate a change in the sound produced by the vibratory element occasioned by such closely spaced excitations.

Preferably, the reproduction means includes means for providing output signals such that each output signal includes frequency information specifying the frequencies in a sound to be simulated and the overlap means includes means for altering this frequency information. Where the output signal is an analog, audio frequency signal, the frequency information is constituted by the frequency spectrum of the output signal itself, and the overlap means desirably is arranged to alter this frequency spectrum. Where the sound means produces sounds simulating the sounds emitted by a percussive element such as a drumhead, the overlap means may be arranged to alter the frequency information in the output signal so that the frequency information specifies generally higher frequencies. Thus, for an analog output signal, the overlap means may be arranged to shift the frequency spectrum of the output signal towards higher frequencies upon the occurrence of input signals specifying simulation of closely spaced excitations. The opposite effect—a shift toward generally lower frequencies—may also be employed. Desirably, the reproduction means includes waveform data storage means for storing a series of amplitude values and readout means for reading out the stored series in response to an input signal to thereby provide a signal simulating a waveform of the musical instrument. The overlap means preferably includes means for altering the readout rate to thereby alter the frequency spectrum of the waveform-simulating signal. Variation of the readout rate can also be regarded as changing the fundamental "pitch" of the output signal.

Desirably, the reproduction means also includes means for varying the characteristics of each output signal, such as amplitude and frequency or "pitch" to take account of variations in individual notes. For example, in a synthesizer intended to simulate percussive sounds, the reproduction means may vary the output signals simulating individual strikes so as to simulate the varying effects of individual strong and weak strikes specified by the input signals. The additional variations introduced by the overlap means, simulating interactive effects between closely-spaced notes, supplements the other variations.

This aspect of the invention incorporates the realization that the sounds produced by the vibrator elements of real musical instruments, and in particular the sounds produced by drums and other percussive instruments are not simply additive. If a drum is struck with closely spaced first and second strikes, so that the sound of the first strike has not fully decayed by the time of the second strike, the sound of the second strike will have a different frequency spectrum than would be produced by the same, second strike on a quiescent drumhead. That portion of the firststrike sound persisting after the second strike may also differ from the corresponding sound which would be produced in the absence of the second strike. Synthesizers according to preferred embodiments of the present invention can simulate one or both of these effects. This added capability provides a more realistic sound.

Although the present invention is not limited by any theory of operation, it is believed that these effects in a real drum may arise from changes in the tension of the drum head. In its rest or quiescent state a real drumhead has predetermined resonant frequencies. When subjected to a series of closely spaced strikes the drumhead apparently does not resume its rest or quiescent state. Therefore, the later strikes, and the later portions of the earlier strikes, are sounded by a drumhead starting from a condition other than the rest or quiescent state, and hence having different properties.

A synthesizer according to the invention may also include randomization means for applying random variations to one or more parameters determining the characteristics of the output signal. For example, in a synthesizer employing controllable filters to control the frequency composition of an audio frequency analog output signal, random variations may be applied in one or more parameters of the filters. Such randomization provides still further realism. This aspect of the present invention incorporates the realization that the sound produced by a strike on a real percussive element such as drumhead is subject to random variations. Here again, the invention is not limited by theories of operation. However, it is believed that the random nature of percussive instrument sounds is due at least in part to a randomizing effect produced by vibration of the percussive element. When a drumhead vibrating in response to a previous strike is struck again, that portion of the head contacted by the stick or other striking element may be moving codirectionally or counterdirectionally to the direction of motion of the stick. These effects are believed to randomize the sound produced by real drums. Similar effects are believed to prevail in other percussive instruments.

A further aspect of the present invention provides a music synthesizer having actuation means for providing input signals so that each input signal includes an actuation strength value in a range between a weak actuation or soft-hit value and a strong actuation or hard-hit value. The synthesizer desirably includes generation and processing means for generating signals representing sound waveforms responsive to the actuation signals and processing the waveform-representing signals according to a plurality of control parameters so as to derive output signals representing the sound to be produced. A synthesizer according to this aspect of the present invention most desirably includes storage means for storing soft-hit an hard-hit plots of each control parameter versus time. Each such plot includes a series of values of the control parameter. Desirably, interpolation means responsive to the input signals are provided for interpolating between the soft-hit and hard-hit plots of each control parameter to derive an interpolated plot or series of values of each control parameter against time. Thus, the interpolated plot for a given parameter approaches the soft-hit plot for that parameter as the actuation strength value in the input signal approaches the soft-hit value and approaches the hard-hit plot for the same parameter in the actuation strength value as the input signal approaches the strongest actuation value. The interpolation means desirably is arranged to provide the series of values of each control parameter constituting the interpolated plot to the signal processing means.

The control parameters may include one or more frequency-related control parameters, and the generation and processing means may include means for varying the relative predominance of different frequencies within the processed signal in accordance with these one or more frequency-related parameters. The generation and processing means may include storage means for storing a series of amplitude values and means for reading out the stored series to provide a waveform-representing signal. Desirably, the frequency-related control parameters include a readout rate or "pitch" parameter, and the readout means is arranged to read out successive values at a rate which varies in accordance with the interpolated readout rate plot. The generation and processing means may include variable filter means for applying boost or cut of a selected magnitude to signals in a selected frequency range, and the frequency-related control parameters may include the magnitude and sign of the boost or cut and at least one parameter specifying the frequency range, such as a center frequency and a bandwidth or "Q" parameter. Where the signal processing means is arranged to provide a stereo processed signal including spatial distribution information, the control parameters may include a pan parameter related to the spatial distribution information. The control parameters typically also include an amplitude parameter representing the total loudness or volume to be produced.

Independent interpolation of each parameter between soft-hit and hard-hit according to the actuation strength value provides complete control of each parameter throughout the duration of the sound. In contrast to arrangements where a control parameter is interpolated between a single weakest actuation value and a single strongest actuation value, and the so-interpolated value is applied as the control parameter throughout the duration of the sound, synthesizers according to this aspect of the present invention provide for variation of each control parameter with time during the signal and also provide for adjustment of the pattern of variation with time in accordance with the actuation strength value. Because the variation with time of a plurality of control parameters is adjusted in accordance with the actuation strength, the characteristics of the output signal can simulate a real or theoretical instrument sound under varying degrees of actuation force. The variations in sound quality with the actuation strength values in the input signals provided by the control parameters can provide realistic simulation of the variation in sound quality of the instrument with actuation force, and can provide unique special effects.

A further aspect of the present invention provides a synthesizer comprising a plurality of voice units, each such voice unit having means for generating a voice signal simulating any one of a plurality of different instruments or vibratory elements as, for example, any one of several drums or percussive instruments. A plurality of output units are also provided. The synthesizer most desirably includes switchable connector means for selectively interconnecting the output units and the voice units. Command means may be provided for allocating the voice units to instruments, actuating each voice unit to generate a voice signal simulating the instrument allocated thereto and altering this allocation from time to time while controlling the switchable connector means to route the voice signal simulating particular instruments to particular ones of the output units according to a predetermined pattern of correlation between instruments and output units. Thus, each output channel unit carries signals simulating one or more predetermined instruments. Although the allocation of voice units to instruments may change from time to time, the signal simulating each instrument is always present at a predetermined one or ones of the output units.

The switchable connector means may include an output bus having a plurality of bus channels, means for connecting each voice unit to a predetermined one of the bus channels and selectively operable means for connecting each output unit to one or more of the bus channels responsive to commands from the command means. Desirably, the selectively operable connecting means includes means for connecting each output channel to a plurality of bus channels simultaneously, and each output unit includes means for mixing signals received from plural bus channels to provide a composite output signal. Thus, the composite output signal from each output unit may include a predetermined mixture of sounds simulating a preselected mixture of instruments.

Synthesizers according to this aspect of the present invention provide individual output channels with signals representing particular instruments simulated. This permits individual treatment of the sounds simulating different instruments by different external devices like reverberation units or the like, and also facilitates routing the sound simulating each instrument to separate inputs of a multichannel recording device or other signal processing device. The plural output channels can be used to provide different mixtures of sounds representing different instruments as, for example, to the various musicians in a band during a performance.

Infeed means may be provided for accepting signals from external sources and applying these signals to predetermined ones of the bus channels. The selectively operable connecting means may be arranged to connect one or more of the output units to these bus channels. Each output which is so connected will provide an output signal including signals representing signals from a external source. Desirably, the infeed means is arranged to permit connection of plural external sources to plural bus channels. Thus, the same selectively operable switching means which provides the needed correlation between output channels and instruments simulated for sounds created by the synthesizer can also act as a mixer for externally generated signals and/or externally modified signals from the synthesizer itself.

As an alternative, or in addition, one or more voice units may incorporate external signal input means for accepting a signal such as an audio-frequency analog signal from an external source and means for passing the external signal through the signal processing devices incorporated in the voice unit so that the processed external signal is supplied by the voice unit instead of the normal voice signal. Thus, the synthesizer can be used in place of conventional signal-modifying devices such as equalizers. Also, the processed external signals delivered to the output bus can be mixed by the output units so that the synthesizer can replace both an equalizer and a mixer simultaneously.

A synthesizer according to this aspect of the present invention may include common memory means for storing information defining signals to be generated for each instrument to be simulated. Each of the voice units may include means for taking information from the common memory means and generating the voice signal of that voice unit depending upon that information. The common memory means may include digital waveform memory means for storing series of digital values constituting waveforms of instruments to be simulated as series of digital values. The synthesizer may include a digital data bus and the means in each voice unit for taking information from the common memory may include means for accessing the digital waveform memory via the digital data bus. Most preferably, the digital data bus includes a plurality of digital/voice unit connectors at least equal in number to the number of voice units and the output bus includes a plurality of voice-/output connectors at least equal in number to the number of voice units. Each of the voice units may be releasably connected to the digital data bus and to the output bus via the digital/voice unit connectors and the voice-/output connectors respectively. As any of the voice units can take waveform information from the common memory to simulate any of the instruments, the voice units are interchangeable with one another. Additional voice units can be installed merely by releasably connecting the same to the digital data bus and the output bus via unused connectors. The synthesizer thus provides a modular system. The musician may purchase a synthesizer having only a few voice units and hence capable of reproducing only a few sounds simultaneously. Such a system may provide acceptable realism for a musician at the early stages of his career. As he progresses, he can add additional voice units to provide a more capable instrument. Desirably, the output bus also includes a plurality of output/output unit connectors at least equal in number to the number of output units. Each output channel unit desirably is releasably connected to the output bus via one of the output bus-/output channel unit connectors. Here again, the system is modular and arranged for progressive growth, so that the musician can add output units as his needs increase. The synthesizer may also include reverse processing means for converting an analog signal to digital form and passing the resulting digital information to the digital data bus. For example, one or more voice units may include analog-to-digital conversion means for converting an analog signal into a series of digital values. The analog signal may be an external signal, a signal from other voice units or a combination of these. The digital values may be used for direct digital recording, or may be stored in the digital waveform memory.

Another aspect of the present invention provides a synthesizer comprising reproduction means for accepting input signals calling for simulation of sounds emitted by a plurality of different musical instruments or vibratory elements and emitting output signals representing sounds responsive to said input signals. The reproduction means typically is capable of emitting at most a predetermined number of output signals simultaneously. For example, where the reproduction means includes individual voice units each capable of providing only one output signal at a time, the maximum number of simultaneous output signals is equal to the number of voice units. According to this aspect of the present invention, priority means are provided for calculating a score for each output signal depending upon a plurality of factors for each such output signal including the identity of the instrument or vibratory element simulated thereby. The priority means most preferably is operative to determine whether input signals will require the reproduction means to emit more than the predetermined maximum number of output signals simultaneously and, if so, to cause the reproduction means to omit one or more output signals having the lowest scores so that the number of output signals remaining is no greater than the predetermined maximum number. Most desirably, the priority means includes means for determining, with respect to each output signal in a plurality of output signals to be emitted simultaneously, the number of other output signals in the plurality simulating the same instrument, assigning a uniqueness value depending upon this number and considering this uniqueness value as one of the factors in computing the score for each output signal. The synthesizer may include automatic echo means for automatically providing echo signals responsive to some or all of the input signals received, and the reproduction means may be operative to produce output signals responsive to the echo signals as well as responsive to the input signals. In this case, the priority means desirably includes means for determining whether each output signal is to be emitted in response to an input signal or in response to an echo signal, assigning an echo factor value dependent upon this determination and considering the echo factor value in the computation of the scores for each output signal.

Preferably, the priority means is arranged to maintain a running score for each output signal. The priority means may include means for assigning an initial value to the running score for each output signal such that the initial value depends upon the identity of the instrument or element simulated. The priority means may also include means for ordering those simultaneous output signals simulating the same instrument or element according to an initial amplitude value for each such output signal. Separate orders are maintained for signals simulating different instruments or elements. The priority means may further include means for assigning a score decrement to each output signal depending upon its rank in such an order and means for decrementing the running score for each output signal by its score decrement when a new input signal is received. With the score decrementing scheme, each score is reduced progressively as new input signals are received, and hence the running score implicitly reflects the age of the output signal. The significance of the instrument or element in the musical scheme to be simulated is reflected in the initial value for the running score, whereas the uniqueness factor value is implicitly reflected in the score decrement. A unique output signal, being the only output signal simulating a particular instrument, necessarily will be at the first rank in the aforesaid order. Therefore, such a signal will have a lesser score decrement and its running score will decrease by a relatively small amount when a new input signal is received. Desirably, the means for assigning an initial value to the running score for each output signal includes means for assigning a lower initial value for an output signal produced responsive to an echo signal than to an output signal simulating the same instrument but produced responsive to one of the input signals. Thus, the echo factor value is implicitly reflected in the initial value of the running score.

The priority scheme according to this aspect of the present invention provides superior allocation of limited resources in the synthesizer. This aspect of the present invention incorporates the realization that some notes are more important than others. Notes played by some instruments or vibratory elements in the ensemble are more important than notes played by others, and notes played as echoes under an automatic echo scheme typically are less important than notes played in response to manually generated input signal. Also, loud notes typically are more important than soft notes from the same instrument. The priority scheme according to this aspect of the present invention allows the synthesizer to reflect such musical value judgments.

Yet a further aspect of the present invention provides a hit detector for a percussion synthesizer. The hit detector according to this aspect of the present invention includes input connection means for accepting an input signal from a transducer representing motions of a percussive element and providing a sensed input signal directly related to the magnitude of the input signal. Capture means are provided for capturing and holding a floating trigger value directly related to the maximum magnitude of the sensed input signal. Desirably, the capture means are arranged so that the floating trigger value increases more slowly than the sensed input signal while the magnitude of the sensed input signal is increasing. Bleed means are provided for progressively decreasing the floating trigger value at a preselected bleed rate, and trip means are arranged to issue a trip signal whenever the sensed input signal exceeds the floating trigger value by a preselected threshold amount. Hit signal means are provided for issuing a hit signal responsive to the trip signal. Most preferably, inhibit means are provided for inhibiting the operation of the hit signal means for a predetermined inhibit interval after each trip signal. Means may be provided for adjusting one or more of the preselected bleed rate, the threshold amoung and the predetermined inhibit interval. The input connection means may include means for providing a sensed input signal as an analog voltage such as the signal from an analog transducer. The capture means may include means for providing an analog voltage directly related to the magnitude of the sensed input signal, a means for rectifying this analog capacitor and means for charging the capacitor with the rectified analog voltage, so that the voltage on the capacitor represents the peak value of the rectified analog voltage. The bleed means may include means for progressively discharging the capacitor at a preselected discharge rate. The voltage on the capacitor may constitute the floating trigger value. The trip means may include means for comparing the analog voltage with the voltage on the capacitor and issuing the trip signal when the analog voltage exceeds the voltage on the capacitor by the threshold amount. The hit signal means may include a first monostable multivibrator having a normal state and a tripped state and means for issuing the hit signal responsive to transition of the first monostable multivibrator from the normal state to the tripped state. The inhibit means may include means for retaining the first monostable multivibrator in its tripped state for the predetermined inhibit interval after each trip signal. If a new trip signal occurs before lapse of this predetermined interval after a previous trip signal, the first multivibrator will still be in its tripped state when the new trip signal occurs. Therefor, there will be no transition of the first monostable multivibrator from normal to tripped state and accordingly, no hit signal will be issued.

Preferred hit detectors according to this aspect of the present invention will provide accurate hit signals when the percussive instrument is hit with a strike of a large magnitude or a small magnitude and even when these large magnitude and small magnitude strikes are interspersed with one another. However, the preferred hit detectors according to this aspect of the present invention are relatively insensitive to "rumble" or effects of drumhead vibrations persisting after the initial strike. These desirable results arise from a combination of factors including the floating threshold and the time delay provided by the inhibit means, all as further explained hereinbelow.

Yet a further aspect of the present invention provides a control panel for an audio signal processing device such as a synthesizer. The control panel includes a display screen defining substantially perpendicular horizontal and vertical directions. A first control knob is provided on the panel, which control knob is movable substantially in the horizontal direction. A second control knob is movable substantially in the vertical direction defined by the screen. These first and second control knobs are disposed adjacent the display screen. Means are provided for detecting the positions of the first and second knobs and providing first and second signals representing these positions. Graph display means are included for accepting data representing variation of a control parameter of an audio signal processing device against an independent variable such as time and displaying this data as a graph on the display so that the magnitude of the control parameter is represented by distance in the vertical direction and the magnitude of the independent variable is represented by distance in the horizontal direction. Selective interpretation means are provided. These means define first and second conditions. In the first condition, the selective interpretation means is operative to interpret the first and second signals as pan and loudness control signals respectively and deliver these pan and loudness control signals to an audio signal processing device. In the second condition, the selective interpretation means is operative to interpret the first and second signals as values of the independent variable and values of the magnitude of the control parameter and deliver these values to the audio signal processing device. The first knob will move horizontally, in the direction normally associated with independent variables on graphs and also in the direction normally associated with a pan control for a stereo signal. Conversely, the second knob moves generally vertically in the direction normally associated with a dependent variable on a graph and also in the direction normally associated with loudness controls. Thus, the user finds it natural to use the control knobs either to plot a graph of data variation or to adjust loudness and pan control. The graphing capability of the control panel in accordance with this aspect of the present invention can be used to input plots of control parameters versus time in connection with a synthesizer as discussed above.

These and other objects, features and advantages of the present invention will be more readily apparent from the detailed description of the preferred embodiments set forth below taken in conjunction with the accompanying drawings.

BRIEF DESCRIPTION OF THE DRAWINGS

FIGS. 6A and 6B constitute a schematic diagram of a circuit used in a component of FIG. 5.

FIGS. 10 and 11 are flow diagrams illustrating certain logic routines utilized in the synthesizer of

FIGS. 1–9.

DETAILED DESCRIPTION OF THE PREFERRED EMBODIMENTS OVERALL ORGANIZATION

Figure 1:
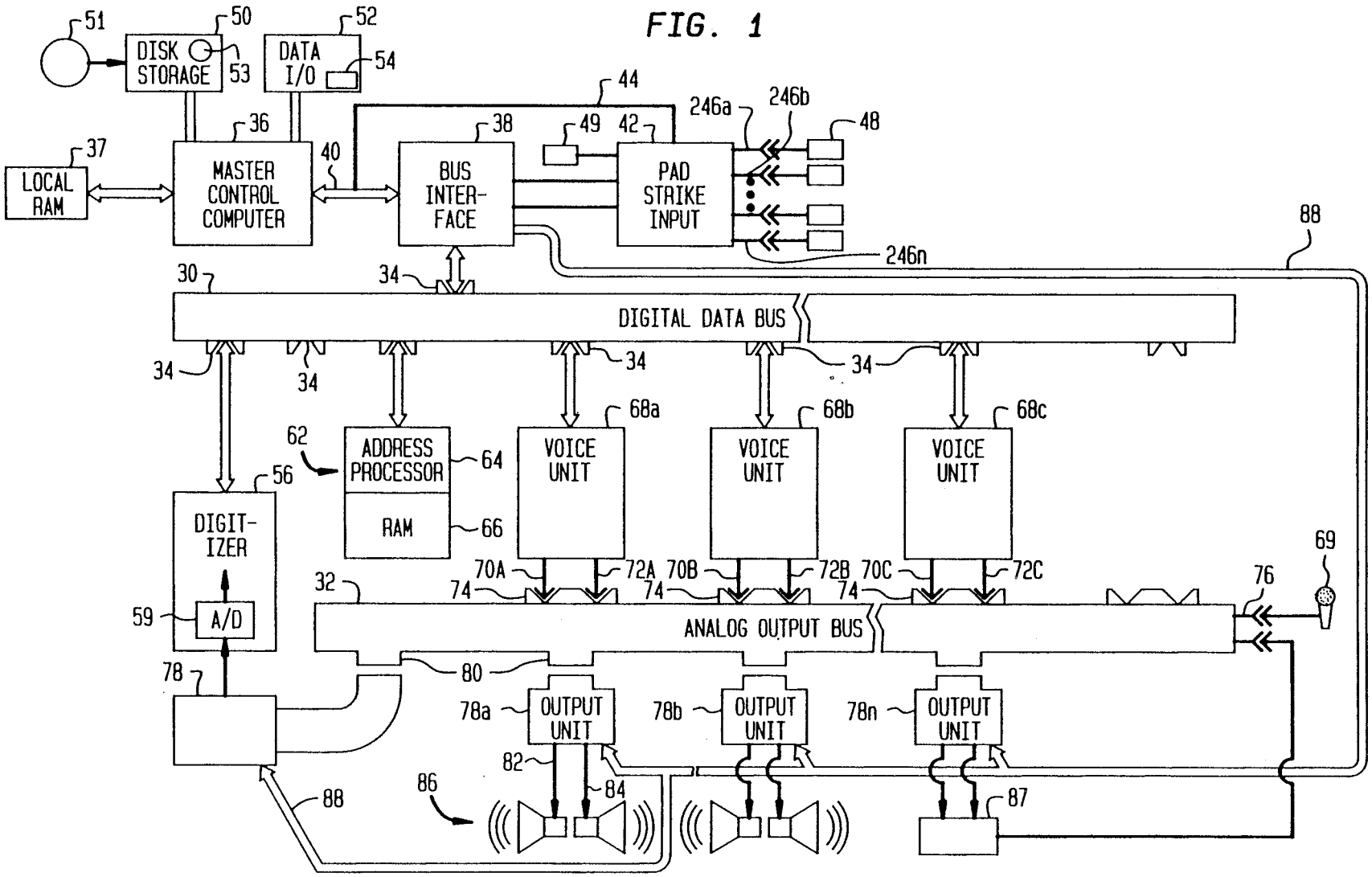
FIG. 1 is a functional block diagram of a synthesizer in accordance with one embodiment of the present invention.

A synthesizer in accordance with one embodiment of the present invention includes a digital data bus 30 and an analog output bus 32. A plurality of digital/voice connectors 34 are provided along bus 30, each such connector 34 being a conventional multielement socket having multiple elements electrically connected to the conductors of the data bus. A master control computer, commonly referred to as a "mother board" 36 is linked to digital data bus 30 via a bus interface device 38. Master control computer 36 may be a standard computer such as an IBM® personal computer or other computer having similar architecture. Master control computer 36 incorporates an internal random access memory or "RAM" and internal bus 40, which is connected to a bus interface 38. A strike input processor 42 and output control line 88 are connected to the internal bus 40 via bus interface 38. Strike input processor 40 is also directly connected to internal bus 40 via a single-bit line 44.. Strike input processor 42 is connectable to a plurality of strike transducers 48 and to one or more external influence transducers 49. Transducers 48 and 49 can be used to actuate the synthesizer during performance. Other components of the system connected to the internal bus 40 of master control computer or mother board 36 include standard mass data storage devices 50 and data input and output units 52. Data input and output units 52 may include a conventional keyboard and screen with conventional interface devices (not shown) and a special control panel 54 described below. Also, the data input and output units may also include a Music Industry-Data Interface or "MIDI" standard device permitting communication between computer 36 and other musical devices according to a standard communications protocol.

A common memory unit 62 is connected to digital data bus 30 incorporating an address processor portion 64 and a massive random access memory 66. A plurality of voice units 68 are also connected to the digital data bus 30 via digital/voice connectors 34. Each voice unit has a pair of analog output paths 70 and 72 adapted to carry the left and right portions respectively of an analog stereo signal. The analog output paths 70 and 72 of each voice unit 68 are releasably connected to analog output bus 32 by voice/output connectors 74. As further described hereinbelow, analog output bus 32 has a plurality of output bus channels each including left and right conductors for carrying a multiplicity of stereo analog audio frequency signals. Further, a plurality of infeed ports 76 are also connected to analog output bus 32. Each infeed port 76 may include a preamplifier (not shown), and an external sound input device such as a microphone 69 may be connected to each infeed port 76. A plurality of output units 78 are releasably connected to analog output bus 32 via output bus/output unit connectors 80. Each analog output unit 78 has .a pair of output terminals 82 and 84. Conventional sound reproduction devices such as loudspeakers 86 thus may be connected to these terminals. Ordinarily, external linear amplifiers (not shown) are connected between the output units and loudspeakers. Alternatively, or additionally, an external sound signal modifying device 87 may be connected to output units 78, and the modified signals produced by device 87 may be passed back into one or more infeed ports 76. Each analog output unit 78 is linked via an output control data path 88 to the output control unit 44. Although only three voice units 68 and four output units 78 are depicted in FIG. 1, the synthesizer typically includes more of these components, commonly up to sixteen voice units 62 and up to twelve output units 78.

In a performance mode the synthesizer utilizes waveform data stored and control parameter plots stored in common memory 62. The musician actuates transducers 48 each of which represents a particular instrument. Strike input processor 42 communicates the identity of the transducer together with strike intensity data to master control computer 36. The master control computer executes a priority scheme to assign one of voice units 68 to the task of reproducing the sound associated with the newly received strike. The master control computer provides to the selected voice unit addresses for the most appropriate stored waveform held in common memory 62 and further with addresses for the most appropriate control parameter plots held in common memory 62. The selected voice unit takes the selected waveform and control parameter data indicated by the addresses supplied to it, converts the stored waveform designated by such data into an analog signal and processes the analog signal according to the control parameters specified by the control parameter plots.

The processed analog signal is supplied as a stereo audio frequency signal at output paths 70 and 72 of the selected voice unit. The analog output signals from the voice units are fed via analog output bus 32 to the output units 78. Each output unit 78 accepts and amplifies the signals from one or more of the voice units 68 to provide final output stereo sound signals on terminals 82 and 84. Plural voice units 68 ordinarily operate simultaneously. Moreover, the voice units 68 are interchangeable with one another. As new sounds are required by inputs signals provided through strike input processor 42, voice units 68 are continually reassigned to produce sounds simulating different instruments.

The master control computer actuates switching devices within each output unit 78 via output control line 88, thereby selectively interconnecting the output units and the voice units so as to maintain a predetermined pattern of correlation between instruments and output units 78. Thus, each output unit will provide a final output signal representing the sounds of one or more predetermined instruments. This allocation will remain regardless of which ones of voice units 68 are being used for which instruments. Sound signals supplied via infeed ports 76 may be mixed by the output units with signals from the voice units as further described hereinbelow.

A digitizer 56 incorporating an analog-to-digital converter 59 is connected to the digital data bus 30. Analog-to-digital converter 59 is connected to an output terminal of an output unit 78. The analog signals on output bus 32 can be converted to digital form and passed to digital data bus 30. This digital data may be stored in common memory 62 and/or disk storage unit 50 under the control of master control computer 36.

THE VOICE UNIT

Each voice unit 68 includes a digital processing section 90 (FIG. 2) and an analog processing section 92. The digital processing section 90 includes a microprocessor 94, which may be a microprocessor of the type supplied by Texas Instruments, Inc. of Dallas, Texas, under the designation TMS 320. The microprocessor 94 is linked to a limit and increment latch 96, a flag and command latch 98 and two incoming data latches 100 and 102, referred to as the "I latch" and "P latch". Each one of these latches is arranged according to standard digital architecture techniques for handling interactions between microprocessor 94 and digital data bus 30. Flag and command latch is a bidirectional device, arranged to accept incoming signals from the databus 30 and hold the same until microprocessor 94 can react to them and also to accept outgoing signals from microprocessor 94 and hold the same for transmission to other portions of the system. Limit and increment latch 96 is arranged for transmission of information from microprocessor 94 to bus 30, whereas, I latch 100 and P latch 102 are arranged to accept information from bus 30 for transmission to microprocessor 94. Further, an identification unit 104 is linked to microprocessor 94. Identification unit 104 is arranged to provide a predetermined signal specifying the identity of the voice unit upon actuation by microprocessor 94. All of the latches 96, 98, 100 and 102, and identification unit 104, are linked to a connector 106 mateable with one of the data/voice unit connectors 34 of bus 30. Connectors 106 and 34 are arranged so that each of the latches and identification unit are connected to appropriate portions of data bus 30.

Figure 2:
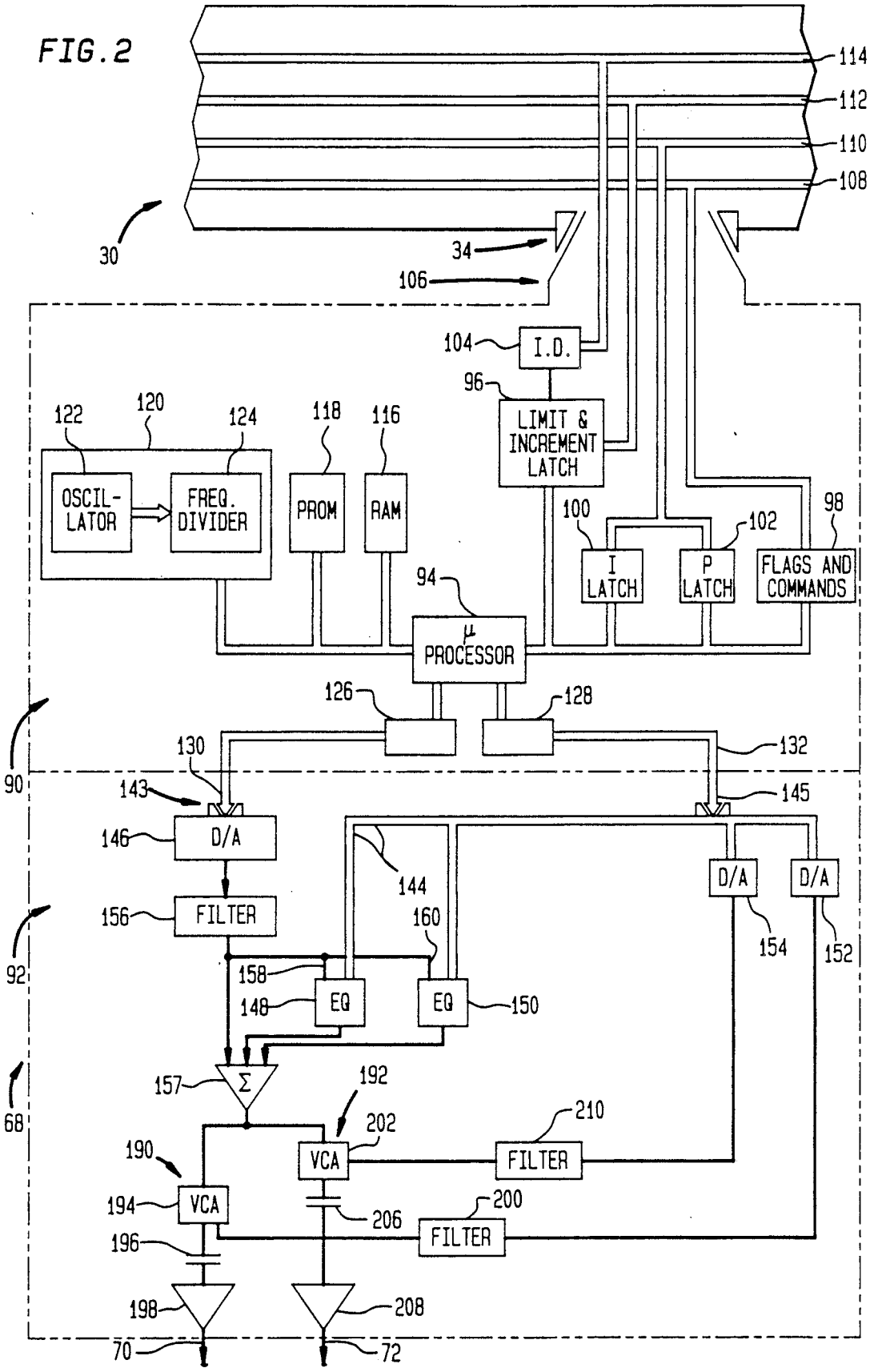
FIG. 2 is a functional block diagram of a component of the synthesizer shown in FIG. 1.

Bus 30, as shown schematically in FIG. 2, includes flag and command channels 108, data channels 110, limit increment and address channels 112 and identification channels 114. Although each of these is shown schematically as a single path in the drawings, it will be readily appreciated by those skilled in the digital data processing art that each of these includes a plurality of individual conductors, with specified meanings being assigned to signals on individual ones of these conductors.

Microprocessor 94 is also linked to a local random access memory or "RAM" 116 and programmable read-only memory 118. In the conventional manner, microprocessor 94 utilizes local RAM 116 as a temporary storage unit for data required for the calculations and operations performed by the microprocessor. Also in the conventional manner, programmable read-only memory 118 operates as a store for permanent data and instruction sets incorporated in the digital processing unit. Additionally, the microprocessor 94 is linked to a local frequency generator 120. Generator 120 includes a crystal oscillator 122 operating at a fixed frequency of 40 MHz and frequency divider 124 operative to divide the frequency of the signal from oscillator 122. Here again, the interconnections between the microprocessor 94, the latches, prom 118, ram 116 and variable frequency oscillator 120 are all conventional multiconductor interconnections wherein signals appearing on particular conductors have preassigned meanings.

Microprocessor 94 is further connected to a 16-bit data output latch 126 and a 12-bit data output latch 128. Latch 126 feeds a single 16-bit output channel 130, whereas multichannel latch 128 feeds a 12-bit parameter bus 132 Each of output channel 130 and bus 132 is provided with an appropriate connector 143 and 145, respectively.

Analog processing section 92 includes a parameter bus 144 releasably connected to the parameter bus 132 of the digital processing section 90 via connector 145. Desirably, the digital and analog processing sections are constructed on separate printed circuit cards and the two circuit boards are detachable from one another. Analog processing section 92 also includes a 16-bit digital-to-analog converter 146 releasably connected to channel 130 by connector 143. A pair of equalizers 148 and 150 and a pair of 12-bit digital-to-analog converters 152 and 154 are connected to parameter bus 144 so that when the digital processing and analog processing sections 90 and 92 are mated with one another as shown, these components are all connected to data latch 128 of the digital section 90.

The analog output of 16-bit converter 146 is connected to an anti-aliasing filter 156. This anti-aliasing filter is a conventional low-pass filter utilized in many digitally-based sound systems. As is well-known in the art of digital music reproduction, an anti-aliasing filter must have a relatively sharp cutoff, so that it causes little loss of desired higher harmonics in the musical signal, but effectively blocks spurious tones at one-half the sampling frequency. Thus, the anti-aliasing filter typically has a top cutoff at about 20 kHz. The output of anti-aliasing filter 156 is connected to one input of a summing amplifier 157. Further, the output of anti-aliasing filter 156 is connected to the analog signal inputs 150 and 168, respectively of equalizers 148 and 150. The signal outputs of equalizers 148 and 150 are also connected to summing amplifier 157.

Figure 3:
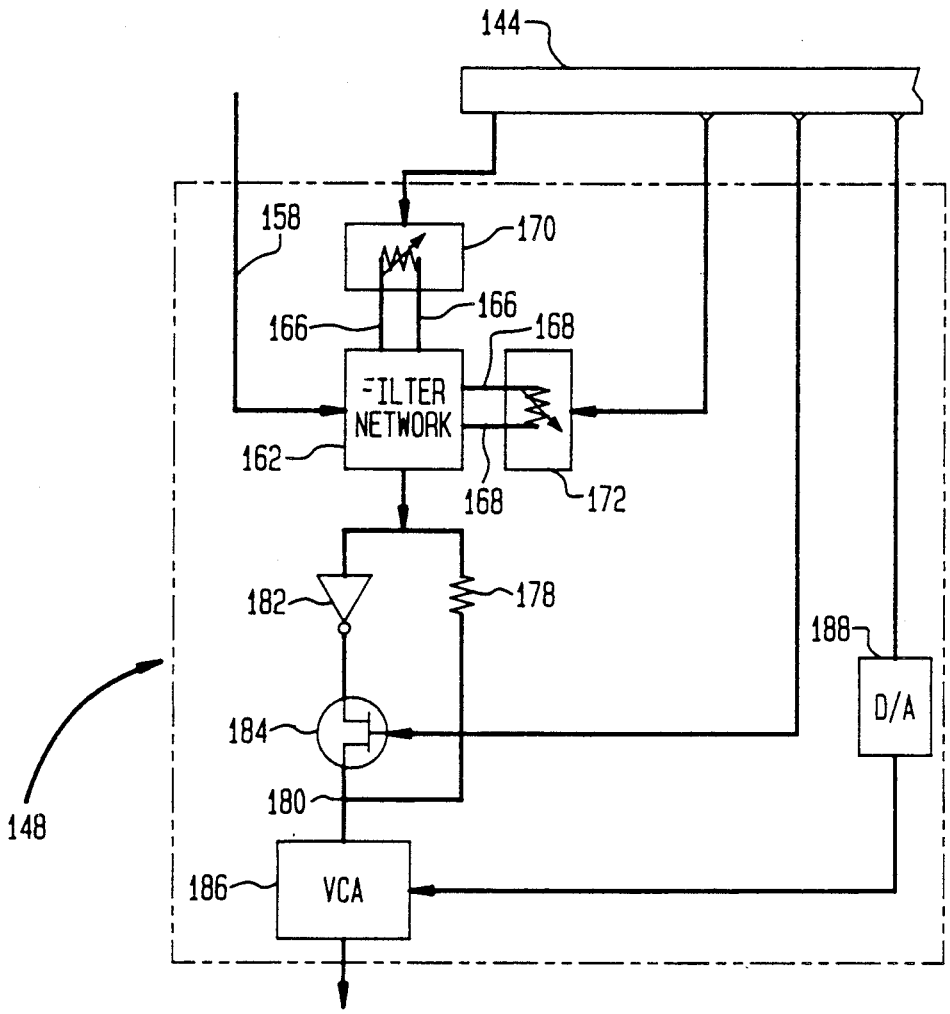
FIG. 3 is a block diagram of a subassembly in the component of FIG. 2.

Equalizer 148 includes a standard parametric bandpass filter network 162 (FIG. 3). The input of the filter network 162 forms the signal input 158 of the equalizer, and hence is connected to the output of antialiasing filter 156 (FIGS. 2). Filter network 162 is arranged so that the resistance between two terminals 168 controls the center frequency of the filter's passband. The resistance between a further pair of terminals 166 controls the Q or ratio of band width to the center frequency. A digitally-controllable dual variable resistor 170, also known as "V-ref-able digital-to-analog converter" is connected across terminals 166. The digital control input of potentiometer 170 is connected to parameter bus 144 and hence to latch 128. A further digitally-controllable variable resistor 172 is connected across terminals 168, the digital control input of resistor 172 also being connected to buss 144 and hence to latch 128.

The signal output of filter network 162 is connected through a resistor 178 to a circuit node 180. The output from filter network 162 is also connected to the input of an inverting amplifier 182 having a gain of about −4, i.e., a signal magnitude gain of about 4 with a 180 degree phase shift. The output of inverting amplifier 182 is connected to one input of a field effect transistor switching device 184. The output of switching device 184 is connected to circuit node 180. The control input of switching device 184 is connected to data latch 128 via bus 144 so that the data latch can supply a single-bit signal to the control input.. Switching device 184 is arranged to be essentially off or nonconducting or else to be essentially on or conducting. As will be appreciated from inspection of FIG. 3, the signal appearing at node 180 when the switching device is off will consist entirely of a noninverted signal from the output of filter network 162. Conversely, when the switching device 184 is on and conducting, signals will pass from the filter network to node 180 both via the noninverting path through resistor 178 and via the inverting path through amplifier 182. However, the inverted signals will be of substantially larger magnitude than the noninverted signals and, accordingly, the composite signal appearing at node 180 will consist essentially of the inverted signal supplied by amplifier 182.

Node 180 is connected to the signal input of a voltage-controlled amplifier 186. The control input of amplifier 186 is connected to a digital-to-analog converter 188, which, in turn, is connected to latch 128 via bus 144. Thus, equalizer 148 will select a predetermined portion of the signal from anti-aliasing filter 156 appearing on input 158 within a passband having a center frequency specified by digital values supplied through bus 144 and a bandwidth or Q specified by other digital values also supplied on the bus. The selected portion of the input signal will be either inverted or not depending upon the single bit signal supplied to switching device 184 The magnitude of this selected and possibly inverted portion will be controlled by the digital value supplied to D/A converter 188. The other equalizer 150 (FIG. 2) is exactly the same. The outputs from equalizers 148 and 150 are connected to inputs of summing amplifier 157. Accordingly, the summing amplifier receives signals directly from anti-aliasing filter 156 and also receives selected portions of the signals, either inverted or not, from equalizers 148 and 150. Upon summation in the amplifier 157, these will provide a signal corresponding to the signal from filter 156 with that portion of the frequency range selected by each equalizer 148 or 150 either cut or boosted according to whether the signal from the particular equalizer is inverted or not.

The output of summing amplifier 157 is connected to a left analog path 190 and a right analog path 192. (FIG. 2) Left path 190 includes a voltage-controlled amplifier 194, a DC blocking capacitor 196 and a precision, low-offset output amplifier 198 in series with one another. The control input of voltage controlled amplifier 194 is connected via a low pass filter 200 to the output of 12-bit digital to analog converter 152, so that the gain of amplifier 194 is controllable by the digital values supplied to converter 152. Filter 200 smooths stepwise changes in the analog signal from converter 152 as may be occasioned by sudden changes in the digital value and thus provides for gradual transitions between gain values. The output of final amplifier 198 constitutes the left path audio signal output 70 of voice unit 68. Right path 192 is substantially identical to left path 190, and includes a similar voltage-controlled amplifier 202, blocking capacitor 206 and final amplifier 208, the control input of voltage-controlled amplifier 192 being connected via filter 210 to the output of digital-to-analog converter 154. The output of right final amplifier 208 constitutes the right path audio signal output 72 of voice unit 68.

THE ANALOG OUTPUT BUS AND OUTPUT UNIT

Figure 4:
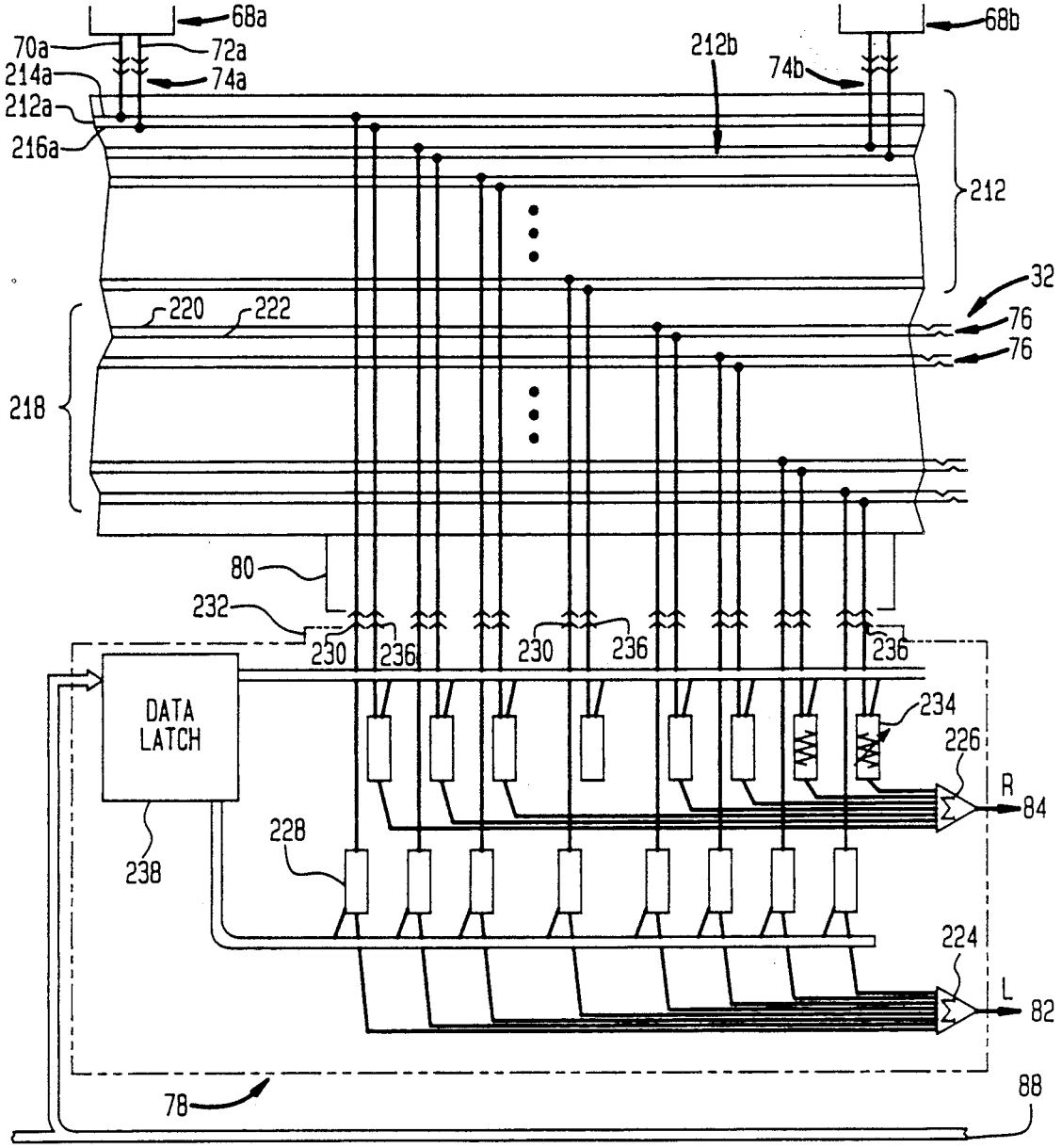
FIG. 4 is a functional block diagram of further components in the synthesizer of FIG. 1.

Analog output bus 32 incorporates twenty-eight output bus channels Sixteen of these channels 212 (FIG. 4), of which only some are shown for clarity of illustration, are utilized only for carrying signals from voice units 68, and hence are referred to herein as voice unit channels. Each voice unit channel 212 includes a left-hand conductor 214 and a righthand conductor 216. Each voice unit channel 214 is permanently associated with one of the voice/output connectors 74. Thus, channel **212*a* is associated permanently with voice/output 74*a*, channel 212*b* is associated with voice output connector 74*b* and so on. The left conductor 214*a* of channel 212*a* is connected to the left input of connector 74*a* and, hence, to the left path output 70*a* of the voice unit 68*a* engaged with connector 74*a*. Likewise, the right conductor 216*a* of channel 212*a* is connected to the right input of the same connector 74*a* and, hence, to the right path output 72*a* of the same voice unit 68*a*. Channel 212*b* is connected to connector 74*b* and, hence, to the output paths of voice unit 68*b* connected therewith. In the same way, each of the other voice unit channels 212 is connected to one and only one voice output connector 74**.

Output bus 32 also includes twelve excess channels 218. Each excess channel 218 includes a left conductor 220 and right conductor 222. Each of the excess output channels 218 is connected to a conventional stereophonic input jack 76 constituting an infeed port. In the conventional manner, the right and left connections of the jack are connected to the right and left conductors of the associated channel 218.

Twelve output bus/output unit connectors 80 are provided. Each such connector includes individual connections for all of the individual conductors in the individual channels 212 and 218 of the output bus. There are sixteen voice unit channels 212 and twelve excess output bus channels 218, for a total of twenty-eight channels. Each channel has two conductors, and thus fifty-six individual connections are provided in each of the output bus/output unit connectors 80. An output unit 78 may be releasably connected to each output bus/output unit connector 80. Each output unit 78 includes a left summing amplifier 224 and a right summing amplifier 226, which may be provided as a unified stereophonic summing amplifier. The left summing amplifier 224 of the output unit has twenty-eight inputs. Each input of left summing amplifier 224 is connected through a digitally-controllable resistor 228 to a connecting element 230 in a connector 232 mateable with output bus/output unit connector 80. This arrangement is repeated twenty-eight times so that there are twenty-eight elements 230 connected through the twenty-eight resistors 228 to left summing amplifier 224. The same arrangement is provided for right summing amplifier 226. Thus, right summing amplifier 226 has twenty-eight individual inputs, each connected through a digitally-controllable resistors 234 to an associated connecting element 236 of connector 232. Connecting elements 230, associated with the left amplifier, and 236, associated with the right amplifier, are mechanically arranged within connector 232 so that when connector 232 is mated with output bus/output unit connector 80, each connecting element 230 associated with the left amplifier is connected to the left conductor 214 or 220 of one of the channels 212 or 218. Likewise, each connecting element 236 associated with right amplifier 226 is connected to the right conductor 216 or 222 of one of the channels 212 or 218.

Each of the potentiometers 234 and 228 has a control input connected to a multi-channel data latch 238. This data latch, in turn, is connected to output control data line 88 for receipt of control values from master control computer 36 via bus interface 38 (FIG. 1). Thus, the digital values supplied to data latch 238 will determine whether each resistor 228 and 234 is in a conducting or nonconducting state, and if in a conducting state, the impedance of the resistor . Accordingly, digital values supplied over line 88 to the data latch 238 will cause right and left amplifiers 224 and 226 to selectively connect with and disconnect from the channels 212 and 218 of the analog output bus 32. Inasmuch as each of channels 212 is connected to a single one of voice units 68, this action will cause the right and left amplifiers 224 and 226 of output unit 78 to selectively disconnect from and connect with particular ones of the voice unit 68. Likewise, because each channel 218 is associated with one of the infeed ports 76, the same switching action will selectively connect and disconnect the amplifier 224 and 226 with the infeed ports 76. Because the impedance of each such connection between one of the output amplifiers and one of the voice units or one of the port is controllable, the proportion of the input signals reaching amplifier 224 and 226 of signal from each voice unit 68 and from each infeed port 76 can be varied. The remaining output units 78 are substantially the same.

THE STRIKE INPUT PROCESSOR

Figure 5:
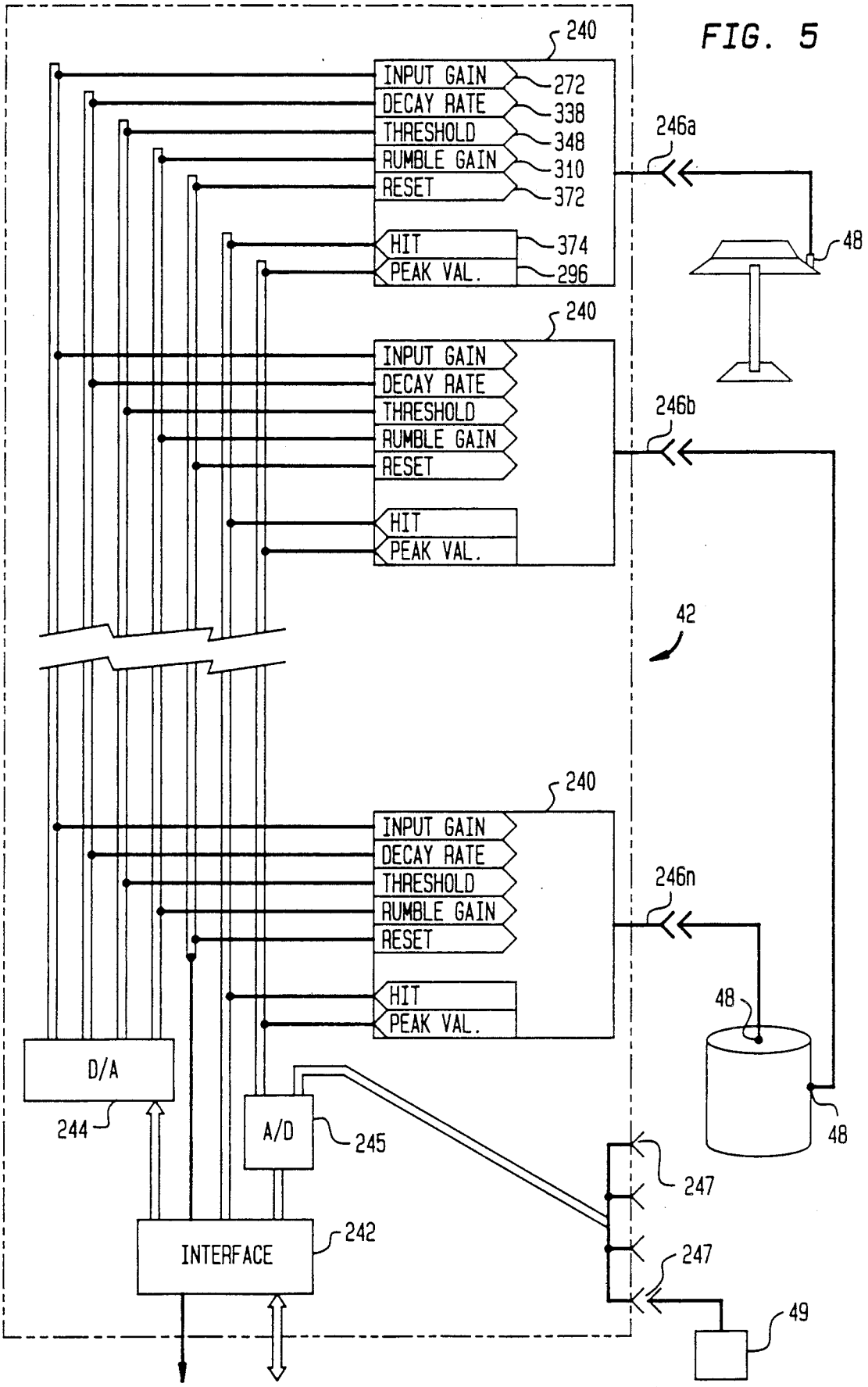
FIG. 5 is yet another functional block diagram showing further components of the synthesizer in FIG. 1.

Strike input processor 42 includes a plurality of individual strike detection circuits 240 (FIG. 5). Preferably, sixteen such strike detection circuits are provided, although only three are shown in FIG. 5 for clarity of illustration. The number of strike detection circuits 240 may be greater or less than the number of voice units 68 and/or output units 78. The strike input processor also includes an adjustment, polling and reporting unit 242, a multiplexing digital-to-analog converter and analog signal distributor 244 and a multiplexing analog-to-digital converter 245.

Figures 6, 6A:
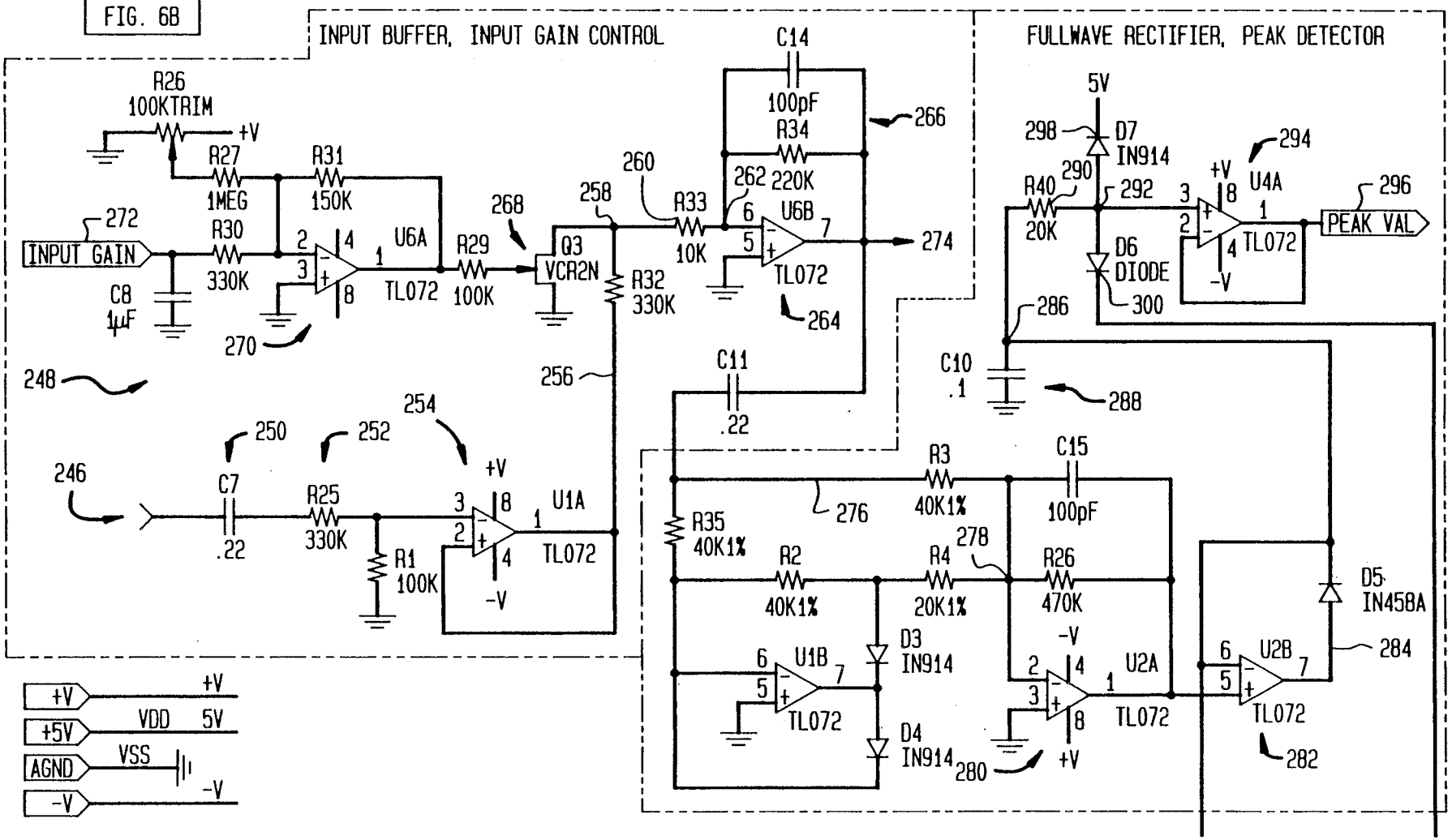
Figure 6B:
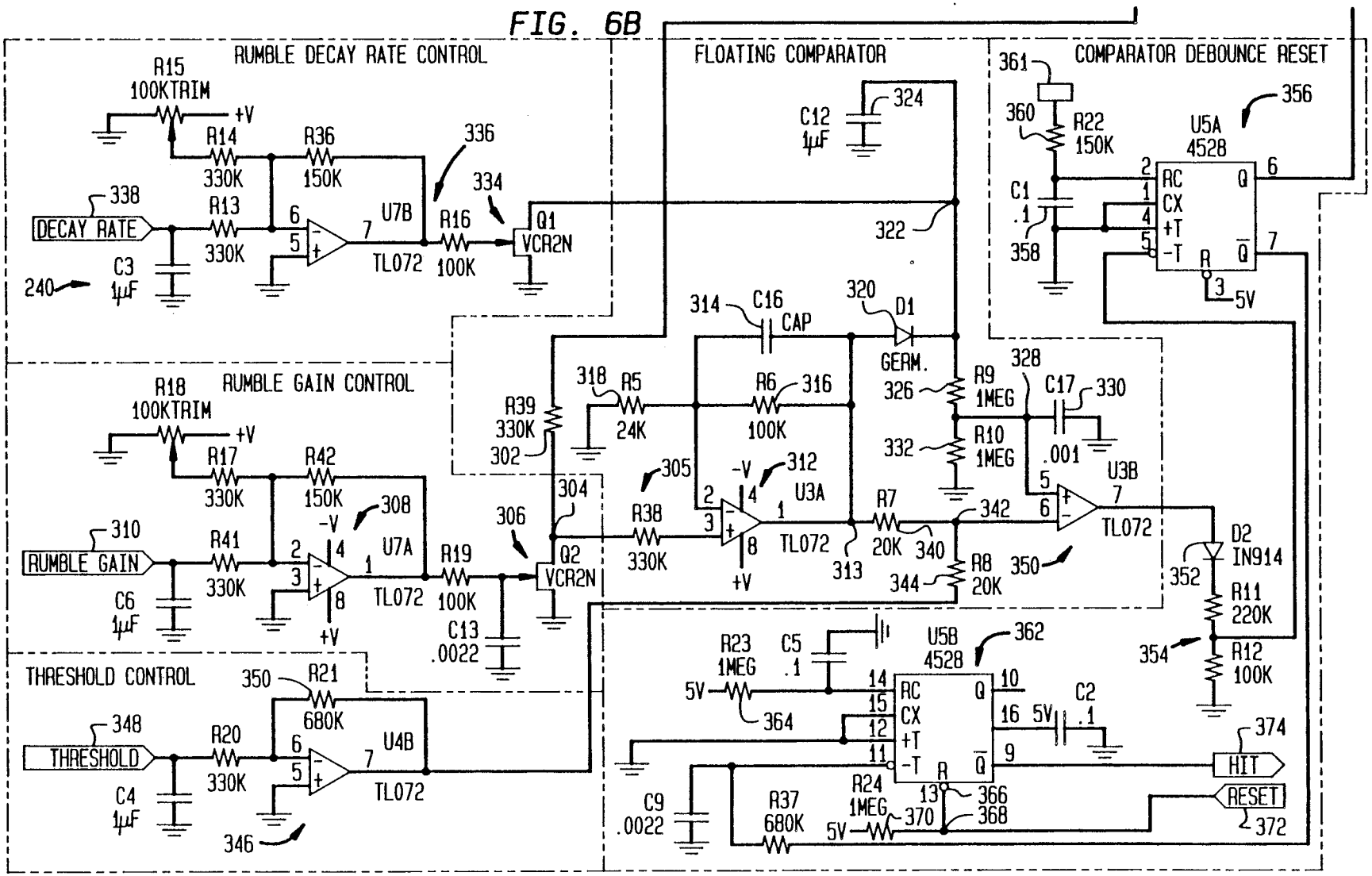

Each strike detection circuit 240 includes a transducer input jack 246 connected to an input buffer and input gain control section 248 (FIG. 6). The buffer and gain control section includes a DC blocking capacitor 250, resistor network 252 and unity gain buffering amplifier 254. The output of buffering amplifier 254 is connected through a resistor 256 to a circuit node 258. Node 258, in turn, is connected through a further resistor 260 to an input node 262 of an operational amplifier 264 having a parallel resistor-capacitor network 266 as a feedback path. Node 258 is connected to the source of a field effect transistor or FET 268. The drain of this FET is connected to ground, whereas the gate of FET 268 is connected to the output of a gain control amplifier 270. Input gain control amplifier 270 has an input connected to the input gain control connection 272 of the circuit. The voltage at input gain control connection 272 will control the output voltage of amplifier 270 and hence the gate voltage and source-to-drain resistance of FET 268. The voltage appearing at node 262 and thus the voltage appearing at the output node 274 of amplifier 264 in response to any signal applied at transducer input 24 will vary with the voltage applied at input gain 272.

The output node 274 of amplifier 264 is connected to the input of a full-wave rectifying circuit 276. The output node 278 of the full-wave rectifying circuit is connected to the input of further amplifying circuit 280. The output of the amplifying circuit 280 thus is a rectified and amplified version of the original transducer signal applied at transducer input 246.

The output of amplifying circuit 280, in turn, is connected to the noninverting input of an operational amplifier 282. The output of operational amplifier 282 is connected through a diode 284 to a circuit node 286. A capacitor 288 is connected between node 286 and ground. Node 286 is connected to the inverting input of operational amplifier 282, and further connected through a resistor 290 to the noninverting input node 292 of a unity gain buffering amplifier 294. The output of amplifier 294 constitutes the peak value output 296 of the circuit. Input node 292 is connected via a diode 298 to a source of a fixed positive system voltage (not shown). Diode 298 acts as an over-voltage protector to discharge capacitor 288 in the event that the voltage applied thereto ever exceeds the fixed voltage provided by the source. A further diode 300 is connected to node 292 and is employed as further described hereinbelow for selective discharging of capacitor 288.

Circuit node 286 and hence capacitor 288 are connected via a resistor 302 to a further circuit node 304, which, in turn, is connected through the source and drain of a gain control FET 306 to ground. The gate of FET 306 is connected to the output of a so-called "rumble gain control" amplifier 308. An input of amplifier 308 is connected to the rumble gain input 310 of the circuit. The voltage applied at rumble gain input 310 controls the voltage applied to the gate of FET 306 and, hence, controls the source to drain resistance of the FET. Accordingly, the ratio between the voltage appearing at node 304 and the voltage on capacitor 288 will be controlled by the voltage applied at the rumble gain input 310.

Node 304 is connected through a resistor 305 to the noninverting input of a trigger value operational amplifier 312. Trigger value amplifier 312 has a resistor 316 and capacitor 314 connected between its output and its inverting input as conventional feedback components and has a further resistor 318 connected between its inverting input and ground. The output of trigger value amplifier 312 is connected via a diode 320 to a trigger value circuit node 322, which, in turn, is connected to one side of a trigger value capacitor 324. The opposite side of capacitor 324 is connected to ground. Node 322 is also connected via a high value resistor 326 to a comparator input node 328, which node is, in turn, connected via a lag capacitor 330 to ground. Node 328 is further connected via another high value resistor 332 to ground. Trigger value node 322 is connected through the source and drain of a decay rate control FET 334 to ground. The gate of FET 334 is connected to the output of a decay rate amplifier circuit 336, and the input of this amplification circuit 336 is, in turn, connected to the decay rate input 338 of the circuit. The voltage applied at input 338 controls the source-to-drain resistance of the FET and, hence, the resistance from trigger value node 322 to ground.

The output of amplifier 312 is also connected via a resistor 340 to another comparator input node 342. Node 342 is connected via another resistor 344 to the output of threshold control amplifier 346. The threshold control amplifier circuit 346 incorporates an operational amplifier having a noninverting input connected to ground, an inverting input connected to the threshold input 348 of the circuit, and a feedback resistor 350 connected between its output and its inverting input. As will be appreciated, threshold control amplifier 346 will apply a negative voltage through resistor 344 to node 342 in response to a positive voltage applied at threshold input 348. Comparator input nodes 342 and 328 are connected to the positive and negative inputs respectively of a comparator 350. Comparator 350 is arranged to provide a spike or momentary positive output whenever a positive voltage appearing at node 342 exceeds a positive voltage appearing at node 328.

The output of comparator 350 is connected via a diode 352 and resistor network 354 to one input of a first monostable multivibrator 356. Multivibrator 356 has a resetting circuit including a capacitor 358 and resistor 360 connected to a voltage source 361. The characteristics of these components determine, in the conventional manner, the reset delay of multivibrator 356. Multivibrator 356 has a normal or quiescent state and a tripped state. The multivibrator is connected so that it will go from its normal state to its tripped state whenever a pulse is received from comparator 350 and will remain in its tripped state for a predetermined interval set by the characteristics of capacitor 358 and resistor 360. If a further spike is received from comparator 350 before lapse of this predetermined interval, multivibrator 356 will remain in its tripped state until the full predetermined interval has elapsed after the last such spike. The not-Q output of first monostable multivibrator 356 is connected to an input of a second monostable multivibrator 362. Second multivibrator 362 likewise has a normal and a tripped state, and likewise has associated with it a resistor-capacitor network 364 setting a predetermined timing interval. Additionally, second monostable multivibrator 362 has a reset input 366 connected to a further circuit node 368. Node 368 is connected through a high value resistor 370 to a voltage source (not shown). Node 368 is also connected to the reset input of the circuit. The not-Q output of second multivibrator 362 constitutes the hit output 374 of the circuit. The second monostable vibrator 362 has normal and hit states. The second monostable multivibrator is arranged to go from its normal state to its hit state in response to a change in the output from first monostable multivibrator 356 indicating a transition of that multivibrator from its normal state to its tripped state. Ordinarily, the reset input 372 is connected to ground, so that the potential at node 368 is effectively at ground potential. However, if the connection between reset node 372 and ground is disconnected, the voltage at node 368 becomes equal to the voltage applied by the voltage source through resistor 370, thus applying a voltage at reset input 366. Second multivibrator 362 will return from its hit state to its normal state immediately upon application of such a resetting voltage.

Each of inputs 272, 338, 348, and 310 is connected to digital-to-analog converter and distributor 244 (FIG. 5) so as to receive an input voltage selected by interface 242 under the control of master control computer 36. Reset input 372 is connected directly to interface 242 for receipt of digital-level signals. Transducer input 246 is connected to a transducer 48 such as a piezoelectric transducer. The transducer 48 is mounted to an object such as a real musical instrument which may be struck by the musician during play.

In operation, the transducer signal 380 (FIG. 7) received at transducer input 246 from transducer 48 typically includes a series of bursts or closely-spaced successive oscillations, each such burst representing a percussive strike. Within each burst, the pattern of amplitudes may be irregular, such that relatively large amplitude signals persist for some time after beginning of the strike. The amplitudes within each burst will vary with the amplitudes of the strikes. Amplifiers 254, 264, 280 and 282 together with rectifying circuit 276 provide an amplified, rectified version 381 of the transducer input signal. This signal, applied through diode 284, tends to charge capacitor 288. As diode 300 is forward-connected to the Q output of multivibrator 356, and as that output is normally at low or ground potential, capacitor 300 would be expected to discharge. However, diode 300 has an appreciable forward threshold voltage, and hence does not conduct during the initial charging of capacitor 288. Accordingly, the voltage of node 286 rises in response to rectified signal 381.

Figure 7:
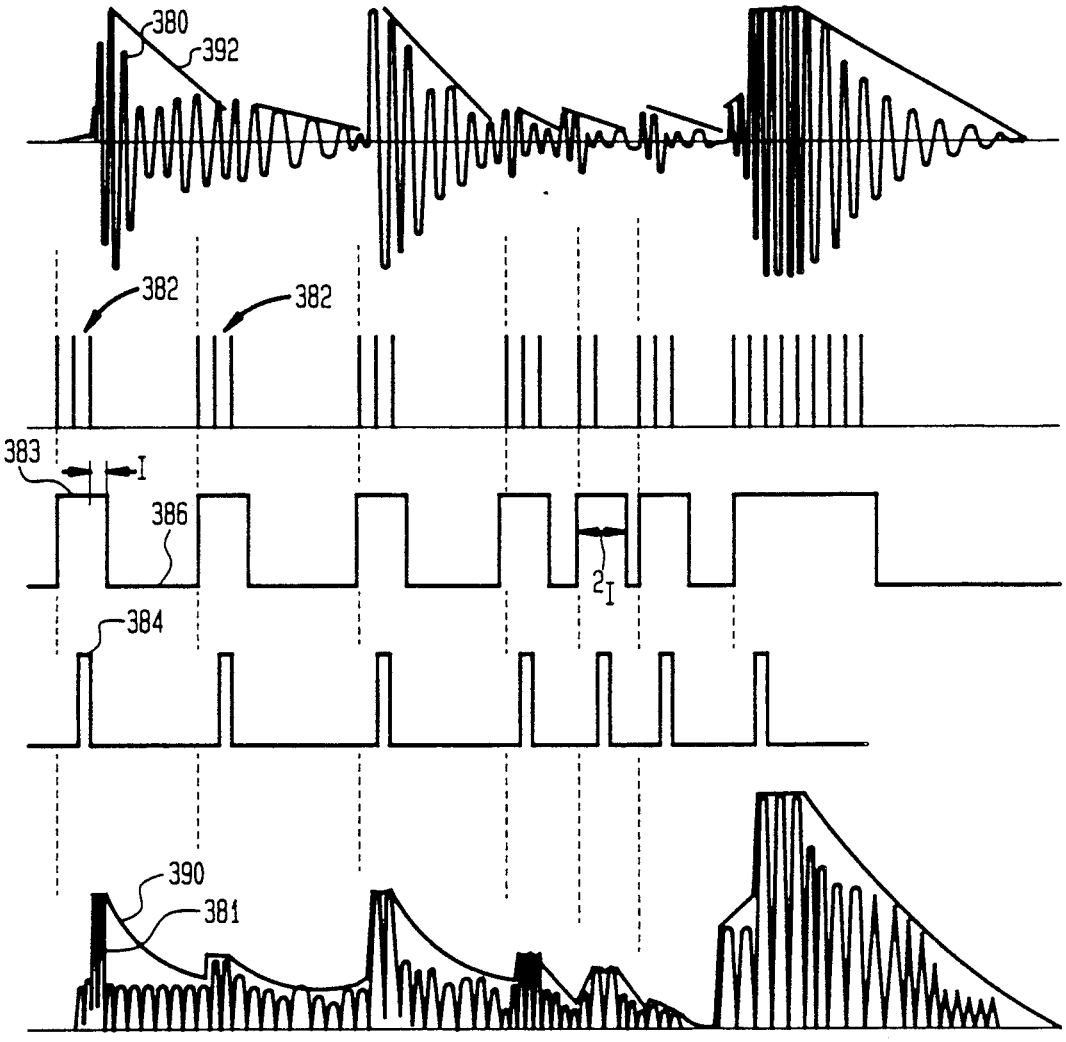
FIG. 7 is an idealized representation of certain signals associated with the circuit of FIG. 6.

During this stage of operation the voltage appearing at node 286 and, hence, the voltage applied through node 304 and resistor 305 to the noninverting input of amplifier 312 reflects the highest magnitude of the transducer input voltage applied at transducer input 246 since capacitor 288 was last discharged. At the beginning of a percussive strike, where the transducer input voltage is progressively and rapidly increasing in magnitude, the output voltage from amplifier 312 will also continually increase. The voltage at node 322 will likewise increase as capacitor 324 charges. The voltage at node 328 will also increase but at a slower rate because of the delay in charging capacitor 340 caused by resistor 326. Therefore, the positive voltage appearing at the output node 313 of threshold voltage amplifier 312 will exceed the positive voltage at node 328. Provided that this excess is greater than the negative voltage applied by threshold amplifier 346 via resistor 344, the voltage appearing at comparator input node 342 will also be greater than the positive voltage appearing at node 328. Therefore, comparator 350 will provide a spike 382 (FIG. 7).

Typically, the signal 380 from a transducer during a percussive strike includes a series of oscillations of progressively increasing magnitude at the beginning of the signal. Each such new and larger oscillation will cause an increase in the voltage at node 286 and, hence, an increase in the output voltage from amplifier 312. With each such increase, the charge on capacitor 324 and, hence, the voltage at node 322 is further increased. During each such period of increase, the voltage at node 313 exceeds the voltage at node 328 because of the lag effect caused by resistor 326 and capacitor 330. During each such increase, provided that the excess in voltage of node 313 above the voltage at node 328 is greater than the negative voltage applied by threshold circuit 346, the voltage at node 342 will exceed the voltage at node 328 and, hence, comparator 350 will issue a further spike.

In the early portion of each percussive signal, several spikes 382 may be issued in close succession. Each spike 382 constitutes a trip signal In response to the first such trip signal received, first multivibrator 356 goes to its tripped state. The Q output goes high, connecting diode 300 to full positive voltage and thus reverse-biasing this diode and preventing conduction through the diode. Accordingly, the charge on capacitor 288 and hence the voltage at node 286 can increase to reach the maximum value of the rectified signal 381 (FIG. 7), which in turn reflects the maximum amplitude of the transducer input signal 380 and hence the strength with which the musician hit transducer 48 or the instrument to which it is attached. This actuation strength signal is applied at peak value output 296.

When first multivibrator 356 goes to its tripped state 383, second multivibrator 362 goes to its hit state 384 after a brief delay and remains in that state for a predetermined time period set by network 364. During that period a "hit" signal is provided at output 374. Adjustment polling and reporting interface 242 (FIG. 5) executes a continuous "spinning" cycle, periodically monitoring all of the hit outputs 374 of all strike detection circuits 240. When a hit output is detected from a particular strike detection circuit, unit 242 actuates analog-to-digital converter 245 to capture the voltage at the peak value output 296 of that circuit 240, thus capturing the strength of the strike.

A series of spikes 382 or successive trip signals may be issued at the beginning of a strike. Provided that these successive trip signals or spikes are issued in such close succession that the time between spikes is less than the reset interval of first monostable multivibrator 356, the first monostable multivibrator 356 will go to its tripped state 383 and will remain there until the last one of these closely-spaced spikes has occurred and until the predetermined reset interval of the first monostable multivibrator has elapsed after such last closely-spaced spike. Because second monostable multivibrator 362 responds only to transition of the first monostable multivibrator 356 from its normal state to its tripped state, the second monostable multivibrator will go from its normal state to its hit state 384 only when the first monostable multivibrator goes from its normal state to its tripped state. Thereafter, the second monostable multivibrator will return from the hit state to the normal state either when the time period established by network 364 elapses or when a reset signal is applied at reset input 366 by interface 242, whichever first occurs. Even if first monostable multivibrator 356 is maintained in its tripped state 387 by a long series of closely-spaced spikes, second multivibrator 362 will only go from normal to hit once and then return. The second monostable multivibrator will not go from normal to hit unless the first multivibrator 356 has returned from its tripped state to its normal state, i.e., after the closely-spaced series of spikes has occurred. Accordingly, only one hit signal will be issued at the beginning of each series of spikes.

When first multivibrato 356 returns from its tripped state 383 to its normal state 386, the Q output and hence diode 300 are connected to ground, thus immediately discharging capacitor 288 down to the forward conduction threshold voltage of diode 300. The remaining charge on capacitor 288 dissipates through resistor 302 and FET 306. During this period, capacitors 324 and 330 discharge through diode 334 at a rate controlled by the decay rate voltage applied on input 338. Thus, the trigger value voltage at node 328 decays at a preselected rate, following a decay curve 390 (FIG. 7). If a further signal is received via transducer input 246 during this decay period, the voltage at node 286 will increase, as will the voltage applied at node 313. However, unless the voltage at node 313, less the threshold voltage applied through amplifier 346, exceeds the floating trigger value voltage at node 328, comparator 350 will not issue any further spike. Thus, the magnitude of a signal at input 246 required to produce a spike from comparator 350 varies. Immediately after a large signal is received through input 246, this minimum magnitude is high as indicated by curve 392 (FIG. 7). It decays with time to a relatively low quiescent state value determined by the voltage applied at threshold offset input 348 and the component values in the system.

Stated another way, circuit 240 provides a varying sensitivity. Shortly after an initial signal burst of great magnitude, the circuit is relatively insensitive and, hence, ignores spurious second increases or "rumble" in the signal. However, in the absence of these conditions, the circuit will provide a hit signal in response to even a relatively low amplitude signal representing a valid but weak percussive signal. The circuit becomes progressively more sensitive as the floating trigger value decays.

The transducer signal 380 may include significant spurious increases in amplitude. That is, the transducer signal 380 coming from a typical transducer mounted on a percussion instrument may increase in amplitude as discussed above at the beginning of a strike, then decrease in amplitude and then increase once again. The rectified signal 382 will follow a similar pattern. These spurious second increases, commonly referred to as "rumble" will be ignored because the circuit is relatively insensitive at time of the spurious second increases. By the time such rumble occurs, the original increase in magnitude of the signal has already set the floating trigger value voltage 390 at node 328 high and the trigger value has not yet decayed..

When interface unit 242 finds a hit output of a circuit 240 in the hit state, it actuates the multiplexing analog digital converter 246 to furnish a digital representation of the peak value voltage appearing at the peak value output 296 of that particular circuit 240. Unit 242 sends an interrupt signal to master control computer 36 via single bit line 44 indicating that a strike has occurred. Unit 242 also sends a pad identity signal indicating the identity of the involved circuit 240 and, hence, indicating the identity of the transducer furnishing the signal and a digital word indicating that peak value of signal captured by A/D converter 245 to the master control computer via bus interface 38. Having performed these tasks, interface unit 242 sends a reset signal to the reset input 372 of the strike detection circuit 240.

The strike input processor also includes a plurality of external analog input ports 247. The eternal analog input ports 247 connected to analog-to-digital converter 245. Typically, about sixteen such analog input ports are provided. Unit 242 is arranged to receive signals from master control computer 36 via bus interface 38 calling for reading of a value from a specified one of the analog input ports 247. Upon receipt of such a signal, unit 242 actuates analog to digital converter 245 to read the voltage applied at the specified port. The interface unit 242 then sends a signal back to the master control computer 36 together with a digital word indicating the magnitude of the voltage detected. Thus, analog devices arranged to provide adjustable voltages such as potentiometer devices may be placed in communication with the master control computer. Such analog devices may be used to detect movement of adjustable controls on musical instruments or musical instrument simulation devices as further discussed below. Interface unit 242 is arranged to give strike detection a higher priority monitoring of analog input ports 247. The monitoring task is put aside whenever a new strike is detected.

THE TRANSDUCERS

The transducers 48 utilized with the strike detection circuits may be employed either with or without a real percussive element. As the only function of the transducer is to provide an electronic signal which can be processed into a hit signal and an amplitude of strike signal by a strike detection circuit 240, the transducers need not be employed in conjunction with real percussive elements. Instead, each transducer may be a conventional piezoelectric, magnetostrictive, strain gauge or other relatively fast-response transducer associated with a "pad" or strikable element having no appreciable acoustic properties. Assemblies of pads and transducers are well known and need not be described herein.

Preferably, however, each transducer 48 is associated with a real percussive element such as a drum, cymbal or the like and each transducer is arranged to provide a signal responsive to a strike on the associated percussive element. Thus, each transducer may incorporate a piezoelectric, strain gauge, magnetostrictive or other signal producing element and appropriate devices for connecting the signal producing element to the percussive element so that the signal produced by the signal producing element of the transducer is directly related to vibration of the percussive element. This arrangement permits the musician to actuate the synthesizer as further described hereinbelow by actually playing on real percussive instruments and hence provides realistic tactile sensation or "feel" during play.

Figure 12:
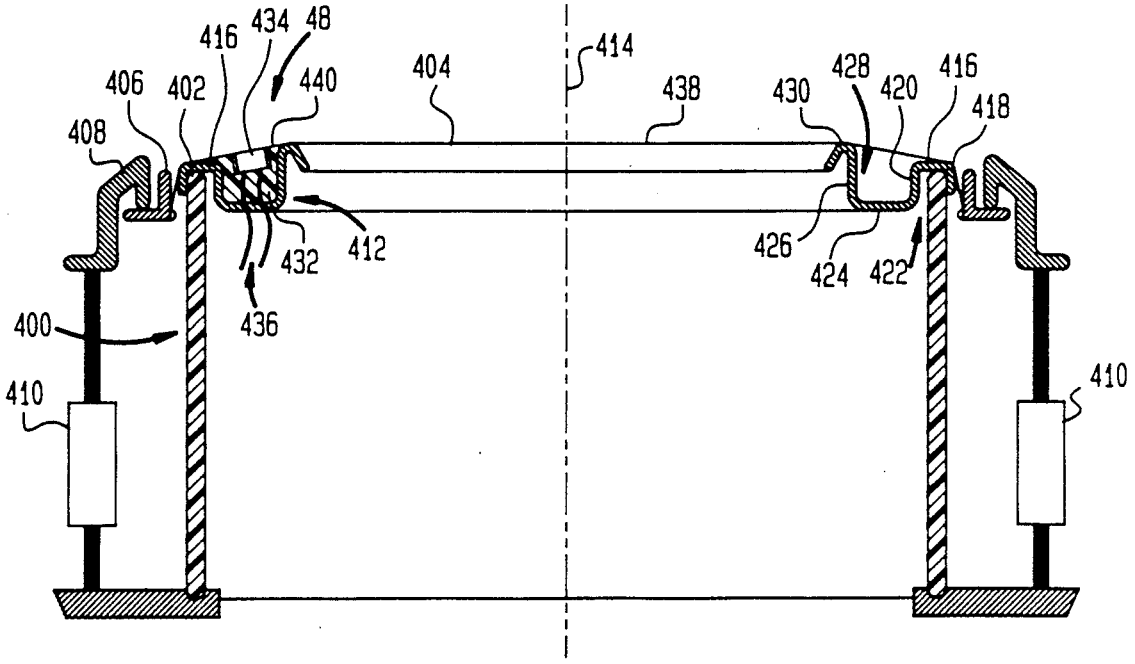
FIG. 12 is a schematic sectional view of a transducer assembly useful with the synthesizer of FIGS. 1–11.

A particularly preferred transducer 48 for use with a real drum is depicted in FIG. 12. A real drum ordinarily includes a hollow, tubular shell 400 having a top rim 402. A flexible membrane or "skin" 404 is permanently fastened to a ring 406 having an interior diameter slightly larger than the exterior diameter of shell 400. In conventional use of the drum, without the transducer, membrane 404 is positioned over the top rim 402 of the shell 400 so that ring 406 encircles the exterior of rim 402. The drum further includes a tensioning ring 408 which overlies membrane ring 406, and a plurality of releasable tensioning devices 410 such as turnbuckles placed around the periphery of shell 400. Tensioning devices 410 are arranged to pull tensioning ring 408 downwardly, towards the end of the shell 400 opposite from rim 402. The force applied by tensioning ring 408 to ring 406 tends to pull the periphery of the membrane downwardly and hence stretches membrane 404 over rim 402. Typically, tensioning devices 410 are secured to another tension ring similar to ring 408 at the opposite end of the drum. This additional tensioning ring may engage the membrane ring of a further membrane similar to membrane 404 but overlying the opposite end of shell 400.

The preferred transducer assembly 48 according to this aspect of the present invention includes a rigid, annular element 412, preferably formed from a metal, a rigid plastic resin or the like. Annular element 412 defines an axis 414 and includes an outer ring 416 extending in radial directions towards and aWay from axis 414. Outer ridge 418 protrudes in an axial downward direction, generally parallel with axis 414 at the outer periphery of ring 416. An inner ridge 420 protrudes from the innermost extremity of lip 416 in the same axial downward direction. Ridges 418 and 420, together with outer ring 416 cooperatively define an outer channel 422 of generally U-shaped cross-section, channel 422 being open in the axial downward direction, towards the bottom of the drawing as seen in FIG. 12. An inner ring 424 extends generally radially inwardly, towards axis 414 from inner ridge 420 and terminates in an upturned support ridge 426 protruding in the axial, upward direction from inner ring 424. Accordingly, the inner ridge 420, inner ring 424 and support ridge 426 define a generally U-shaped inner channel 428 opening in the axial, upward direction, opposite from the opening direction of outer channel 422. The support ridge 426 terminates in a downwardly curved support edge 430 at the uppermost end of the ridge.

A pad 432 of a vibration damping material, desirably an elastic or viscoelastic foam such as a rubber or polyurethane foam is disposed in inner channel 428. A vibration sensitive transducer such as a piezoelectric element 434 is disposed on the upper surface of pad 432. If desired, pad 432 may extend around the entire periphery of ringlike element 412, throughout the entirety of outer channel 428. However, those portions of the pad 432 remote from transducer 434 optionally may be omitted. Transducer 434 is provided with conventional leads 436 extending out of the transducer and desirably extending through annular element 412.

In use, the transducer assembly in accordance with this aspect of the present invention is disposed in conjunction with the conventional drum as shown so that the rim 402 of the drum shell 400 is engaged in the outer channel 422 of ringlike element 412. The outer ring 416 of the ringlike element 412 closely overlies the rim 402 of the drum shell. Thus, inner channel 428 faces upwardly, away from the drum. The membrane 404 is placed over ringlike element 412, and the membrane ring 406 surrounds the outermost ridge 418 of the ringlike element. Tensioning devices 410 are actuated to pull tensioning ring 408 downwardly and urge membrane ring 406 downwardly in the conventional manner. With ringlike element 412 in place however, the membrane bears on the outer ring 416 and on the support edge 430 of support ridge 426. Thus, membrane 404 is placed in tension across the top of ringlike element 412 rather than across the rim 402 of the drum itself. The support edge 430 of ridge 426 bears on membrane 404 along a generally circular line of contact, thus subdividing membrane 404 into central and peripheral portions lying on opposite sides of this line of contact. The central portion 438 of membrane 404 lying radially inwardly of support ridge 426 is free to vibrate in substantially the same way as a membrane stretched on the rim 402 of the drum. However, this central or free vibratory portion of membrane 404 has a slightly smaller diameter than a membrane stretched on the same shell 400 without ringlike element 412. The smaller diameter tends to produce a slightly stiffer feel. This can be compensated for by adjusting the tension applied by tensioning devices 410 to less than the tension used when the transducer assembly is not present.

The peripheral portion 440 of membrane 404 overlying the outer channel 420 is engaged with the support edge 430 of support ridge 426 and is also engaged with the outer ring 416. Further, this peripheral portion 440 of membrane 404 is engaged with the transducer 434 and also with the vibration damping pad 432. Peripheral portion 440 of the membrane thus is constrained against normal vibration. The resilience of pad 432 maintains transducer 434 in contact with the peripheral portion 440 of membrane 404. When the membrane is struck as by a drumstick on the central or free portion 438, some of the vibration is transmitted to the peripheral or constrained portion 440. Thus, transducer 434 is excited and provides a signal. The vibrations of outer portion 440, at least in the vicinity of sensitive element 434, are damped by the interaction between the membrane and pad 432.

Transducer assemblies incorporating these features provide surprisingly good immunity to extraneous noise and to "rumble". That is, the transducer provides a substantial signal when the membrane is hit by a drumstick or similar element, the magnitude of this signal being directly related to the force of the hit. The magnitude of this signal declines rapidly even though membrane 404 continues to vibrate at a considerable amplitude after being struck. Further, excitation of membrane 404 by ambient acoustical noise does not produce a large signal from transducer 434. Thus, the signals from sensitive element 434 are particularly well suited to use as triggering signals for a synthesizer, i.e., as signals which can be processed to provide an indication that the drum membrane has been hit. Moreover, because the signals from transducer 434 vary in proportion to the strength of the excitation applied to membrane 404, these signals can be processed to derive an amplitude of strike signal. Preferably, the transducer assembly as discussed above in connection with FIG. 12 is employed with a strike detection circuit as discussed above with reference to FIGS. 5–7 or as discussed below with reference to FIG. 17.

OTHER DIGITAL COMPONENTS

Common memory unit 62 includes an address processor section 64 and random access memory array 66. The random access memory is a conventional large memory array, typically including several megabytes of random access memory storage. In the normal fashion, random access memory array 66 will furnish data in response to a data request specifying a particular location in memory, referred to as the "absolute address". Address processor 64 is a conventional device including a small control memory (not shown) for retaining a set of running addresses and an address increment associated with each such set. Address processor 64 further includes an increment unit (not shown) for incrementing each such running address in cyclic fashion by the associated increment to create a new running address and delivering the new running address as an absolute address. Common memory unit 62 is linked to the digital data bus 30 so that data supplied by the common memory will be sent on the data lines 110 (FIG. 2) of the bus. Also, the address processor 64 is arranged to receive data concerning addresses via lines 112 of the digital bus.

The common memory unit is arranged to exchange information with the digital data bus 30 and with other devices attached to the data bus according to a "spinning memory" scheme. The "spinning memory" technique is well-known in the data processing and computer architecture arts. Fundamentally, in this technique, the common memory 62 periodically polls all of the units attached to the digital databus to determine whether or not any of these units have information to be sent to memory or require information from memory. Accordingly, common memory 62 can either supply a single item of data in response to a specified absolute address, or a series of data in response to an initial or starting value for a running address together with an increment. Common memory 62 sets up a series of data transmission intervals or "windows. Before each window, the common memory unit sends a "next" signal with an indication of the particular unit (such as a particular voice unit 68) to be addressed. Shortly after sending that "next" signal, the common memory unit looks for a return card identification indicating that the particular unit called for in the "next" signal to the bus is ready to receive or send information to the memory. Upon receipt of such a matching card identification signal, the common memory unit sends the appropriate data during the next available data interval or "window". If no such return card identification signal is received, common memory 62 sends a different "next" signal specifying a different unit. This procedure is repeated until an appropriate card identification signal is found, indicating that a unit is ready to take data during the upcoming window. Having received the "next" signal, the particular unit addressed is on notice that the data on the data lines of bus 30 is addressed to it and, hence, will accept that data.

The actual implementation of such a scheme is complex, but it is also routine and well-known to those skilled in the programming arts. Accordingly, it will not be described in detail herein. However, it should be noted that separate data windows or intervals are set aside for use by the limit and increment latch 96, I latch 100 and P latch 102 of the various voice units 68. Also, the exchange of next" and "card" signals prior to each window occurs simultaneously with exchange of data in an earlier "window" using separate data path in multipath bus 30. Data interchange between the master control computer and the common memory unit 62 is accomplished in essentially the same way, via bus interface 38. Thus, the bus interface 38 and, hence, master control 36 can be addressed by the common memory unit 62 in much the same way as one of the voice units. Flag and command lines 108 of the digital databus 30 are connected directly to master control computer 36 via bus interface 38 for direct interchange of flag and command information between the master control computer and each of voice units 68.

Digitizer 56 includes a digital processing section (not shown) is substantially similar in structure to the digital section 90 of each voice unit 68 and includes a microprocessor and latches similar to those used in the voice units. The digitizer further includes an analog section provided with an analog-to-digital converter 59 (FIG. 1) rather than a digital-to-analog converter. This analog-to-digital converter is connected to the microprocessor of the digitizer 56, so that the digitizer may forward digital data from this analog to digital converter to the common memory unit through the latches and through data bus 30.

The master control computer 36 is essentially a standard computer of the type sold by International Business Machine Corporation of Armonk, New York under the registered trademark IBM-PC. The master control computer bus 40 is arranged in the standard fashion used for such IBM-PC computers. The mass storage device 50 consists of one or more mass storage devices Preferably, a permanently mounted disk storage unit of the type commonly referred to as a "hard disk" is provided, along with one or more "floppy disk" or "optical disk" units capable of accepting replaceable data storage elements and reading the data from such data storage elements and/or writing data onto such a replaceable element 51.

OPERATION - DATA SET-UP

Preparatory to play, RAM 66 of common memory 62 is loaded with waveform data. The waveform data typically includes one fully sampled waveform for each percussive element to be simulated. Thus, where the synthesizer is intended to simulate the output of a set of drums, one real drum sound may be digitized as a series of amplitude values against time and this series of amplitude values may be used as the stored waveform for that particular drum. The sampling operations employed to create this series of digital amplitude values may be essentially the same as those used to create any other digital sound record, viz., conversion of the sound to be recorded into an analog electronic signal, as by a microphone, repetitively sampling that signal at a predetermined sampling frequency having a sampling frequency at least twice the highest audio frequency to be captured and recording the resultant successive digital values. Digitizer 56 may be employed for this purpose. Preferably however, the user simply purchases a prerecorded set of digitized sounds on a removable storage medium such as the disk 51 (FIG. 1) and actuates the master control computer 36 and storage mechanism 50 to read the sets of values and pass those values into common memory unit 52 where the same are stored in RAM 66. Each waveform stored in RAM 66 is associated with a set of addresses within RAM 66. During storage of the waveforms in common memory unit 62, master control computer 36 stores in its local RAM 37 a look-up table containing a correlation between the identity of the instrument associated with each waveform and the starting address in RAM 66 where such waveform can be found.

Before play, also, RAM 66 is loaded with a plurality of plots of control parameters versus time. The information constituting the plots may be provided on the same prerecorded disk 51 as the waveform data. The stored plots of control parameters include a plot of an overall playback amplitude setting versus time, a plot of spatial distribution of the sound versus time which may be in the form a plot of a pan variable versus time and plots of frequency related control parameters. The frequency related control parameters may include an overall "pitch" parameter specifying the readout speed for a stored sound and may also include parameters controlling characteristics of the equalizers 148 and 150 (FIG. 2) employed in a voice unit 68.

As used in this disclosure, the term "plot" means information specifying a series of values of the particular parameter against time. Typically, each plot is stored as a series of successive digital numbers representing successive values of the parameter in question at preselected intervals. For each instrument or percussion element to be simulated, a set of plots including two entire plots of each control parameter is stored. One such plot for each parameter is a strong-actuation or "hard-hit" plot, representing the series of values for the particular parameter which should be employed when the synthesizer is simulating a strong actuation of the instrument. The other plot for each parameter is a weak actuation or "soft-hit" plot representing the series of values for the control parameter which should be used when the synthesizer is simulating a weak actuation of the same instrument.

Figure 8A:
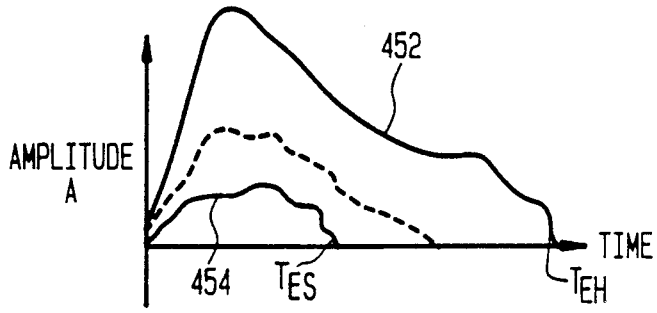
FIGS. 8*a* through 8*e* inclusive are idealized representations of parameter plots employed in the synthesizer of FIGS. 1–7.
Figure 8B:
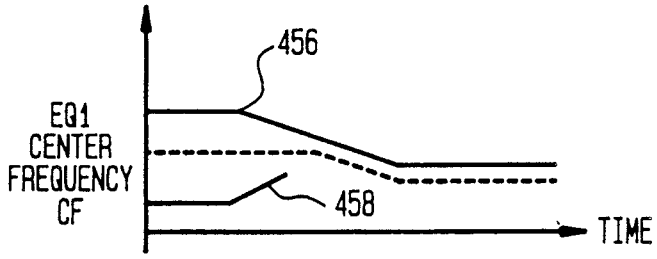
Figure 8C:
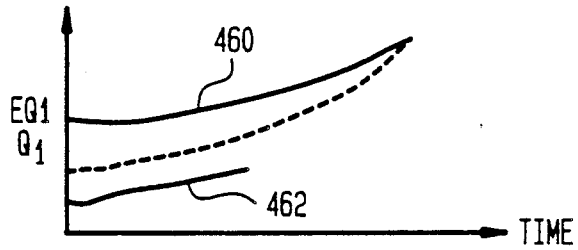
Figure 8D:
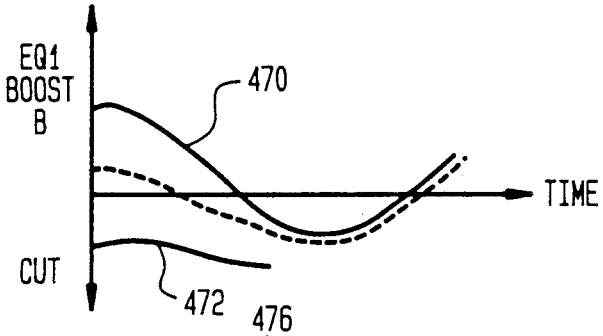
Figure 8E:
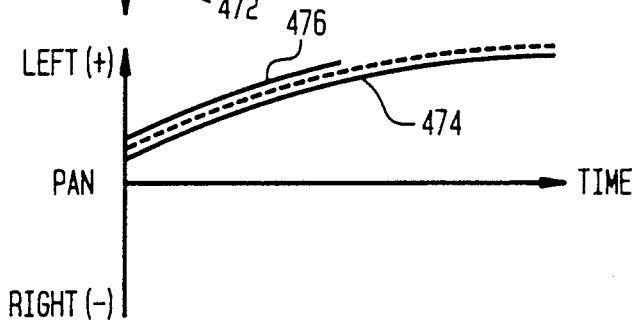
Figure 8F:
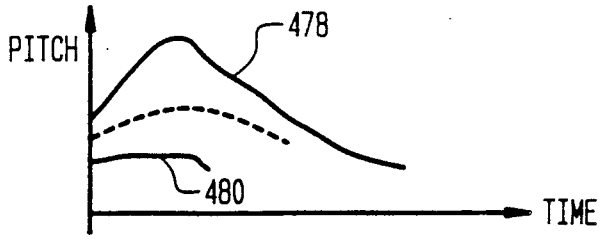

Several typical plots are illustrated schematically in FIG. 8*a* through 8*f*. Thus, FIG. 8*a* shows a strong actuation or hard-hit plot 452 for overall amplitude and a weak actuation or soft-hit plot 454 for the same parameter. FIGS. 8*b* through 8*d* show strong actuation or hard-hit plots 456, 460 and 470 for center frequency, Q (bandwidth) and boost of one equalizer 148 of a voice unit, together with a weak actuation or soft plots 458, 462 and 472 of the same parameters. Similar plots (not shown) are provided for the parameters controlling the other equalizer 150. FIG. 8*e* shows a strongest actuation or hard hit plot 474 of a pan parameter against time together with a weak actuation or soft-hit plot 476 for the same parameter. FIG. 8*f* shows strongest actuation and weakest actuation plots 478 and 480, respectively for a pitch or playback rate parameter. It should be clearly appreciated that these control parameters represent adjustments of sound reproducing apparatus such as a voice unit 68 rather than characteristics of the sound itself. Thus, a plot of an amplitude parameter versus time such as plot 452 simply specifies that the sound reproduction apparatus, when playing back a stored waveform, apply an amplitude multiplier which is relatively low at the beginning of the sound, increases rapidly to a rather high peak and then decreases progressively to zero at a specified hard hit ending time $T_{eh}$. Plot 454 specifies that the apparatus, when reproducing a stored waveform to provide a sound representing a soft or weak hit apply an amplitude multiplier which increases more slowly than that for a hard hit, reaches a smaller maximum value and returns to zero at a soft hit ending time $T_{es}$ shorter than hard hit ending time $T_{eh}$.

Applying an amplitude plot such as 452, the sound volume from the sound reproduction device would increase from zero and decline gradually until reaching zero at time $T_{eh}$, whereupon the sound would be at an end. Likewise, the weaker amplitude plot of amplitude 454 indicates that the amplitude would increase gradually and then decline to zero by time $T_{es}$. Stated another way, the sound from a weaker hit would die out sooner than the sound from a stronger hit. The other parameter plots likewise specify settings of the sound reproduction device versus time rather than characteristics of the sound itself.

Figure 9:
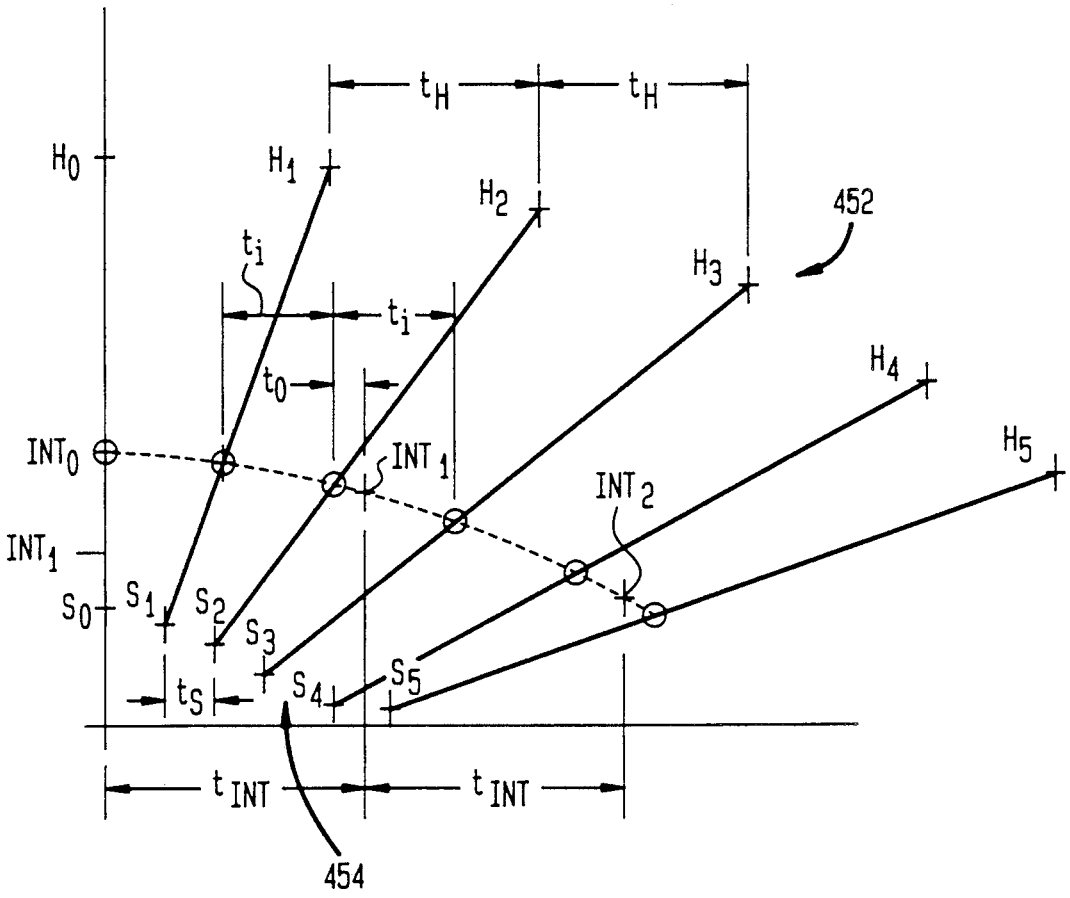
FIG. 9 is a representation on an enlarged scale of a portion of certain plots shown in FIG. 8*c*.

On the scale of FIG. 8, each of these plots appears to be a continuous curve. In fact, each plot is made up of a plurality of discrete values representing successive values for the control parameter at successive times separated by predetermined intervals. Portions of amplitude plots 452 and 454 are schematically depicted on an enlarged scale in FIG. 9. The interval $t_h$ (FIG. 9) between times for the hard hit or strong actuation plot of each parameter is uniform throughout that plot, and typically is one millisecond. Thus, for the strongest actuation plot successive digital values in the series constituting the plot represent successive values of the particular parameter to be applied for successive one millisecond intervals. The time $t_s$ between successive values constituting the weakest actuation or soft-hit plot for each parameter is a uniform fraction of $t_h$. This uniform fraction is selected so that each weak actuation or soft hit plot contains the same number of values as are present in each strong actuation or hard hit plot. That is, $t_s\ (T_{es}/T_{eh}) \times t_h$. Stated another way, the individual values in the hard hit and soft hit plots 452 and 454 are provided in ordered pairs so that there are an equal number of values in each of these two plots. For example, where the amplitude plot is selected so that the amplitude reaches zero in two seconds ($T_{eh}=2000$ milliseconds) and the interval between successive values in the strongest actuation or hardest strike plot is one millisecond ($t_h=1$ ms) then there will be 2000 individual values constituting the strongest amplitude or hardest hit amplitude plot. There are likewise 2000 values in the softest hit or weakest actuation amplitude plot. Assuming that the weakest amplitude plot is constructed so that the amplitude decays to zero in one second ($T_{es}=1000$ milliseconds) then the time interval between successive values in the weakest actuation plot is one-half millisecond ($t_s=0.5$ ms).

The total time periods $T_{eh}$ encompassed by the hard hit plots for all parameters are the same as $T_{eh}$ for the hard-hit amplitude plot of the same instrument. Likewise $T_{es}$ for all parameters of a given instrument is the same. For each instrument, the pitch plots contain the same number of individual values as the amplitude plots. The other parameter plots generally have fewer values. Typically, all of the other parameter plots contain 1/16th as many values as the amplitude and pitch plots for the same instrument. Desirably, the time intervals for all of the plots other than amplitude and pitch are scaled by the same integral factor relative to the time intervals for the amplitude and pitch plots. Typically, this factor is 16 so that where $t_h$ for the amplitude and pitch plots is 1 ms, $t_h$ for the strongest actuation plot for each of the other parameters is 16 ms.

The parameter plots, like the waveform samples are stored in RAM 66 of common memory 62. A memory address is associated with each value in each plot. Preferably, the addresses for the individual values constituting each plot are sequential, so that the address location for the n-th value in each plot is simply the address location for the first value in the same plot plus n. Plots may be entered by the musician himself preparatory to use of the synthesizer as discussed further hereinbelow. Preferably however, the plots for each instrument are provided by the synthesizer manufacturer on the same media disk 51 (FIG. 1) as the waveform samples. Thus, the master control computer reads the values constituting the parameter plots into the RAM 66 of common memory unit 62 from disk 51. At this time, the master control computer stores in its local RAM 37 a directory of the addresses associated with the parameter plots for various instruments.

When the musician is setting up the instrument for play, he enters into the master control computer 36 via input and output devices 52 a set of data establishing correlation between particular transducer inputs 246 an particular instruments. This data is stored within local RAM 37 of the master computer of 36 in the form of a table indicating that an input on the first such transducer input 246*a* indicates a hit on a first instrument, an input at the second transducer input 246*b* indicates a hit on another, different instrument and so on. For example, the first transducer input 246*a* may be associated with a cymbal, the second transducer input 246*b* associated with a bass drum and the nth transducer input 246*n* associated with a snare drum. Also, the musician enters data indicating a particular predetermined pattern of correlation between instruments and output units. This data is also stored in the local RAM 37 of master control computer 36. This data will specify that a particular output unit is to carry sound simulating a particular instrument. For example, the data may take the form of a table associating each output unit with particular mix of sounds simulating various instruments. The first output unit 78*a* may be specified as carrying 100% sound simulating a cymbal, whereas the second output unit may be designated as carrying 80% snare drum sound and 20% bass drum sound so that where the snare and bass drum sounds are of equal amplitude the output signals from output unit 78*b* will include both sounds but the component for the snare drum sound will have four times the amplitude for the bass drum sound. Ordinarily, a musician who utilizes the synthesizer repeatedly will enter this data once to provide correlation suitable for his use and either leave the data in local RAM 37 or temporarily store the same on a permanent storage medium such as a hard disk 53 within mass storage unit 50 so that the same may be later recalled for subsequent use of the synthesizer.

BASIC STRIKE PROCESSING

With the aforementioned data resident in the memories of the synthesizer, the master control computer is actuated to enter a "play" mode. In this mode of operation, the musician actuates the various transducers 48 as by playing real instruments to which the transducers are attached. When an instrument is struck, the transducer 48 attached to that instrument emits an analog signal which is received by the associated transducer input 246. As discussed above, the strike detection circuit 240 associated with the particular transducer input will provide a hit signal and will capture the peak value or maximum magnitude of the transducer signal. The polling or interface unit 242 of the pad strike input processor 42 repeatedly examines the hit signal outputs of all strike detection circuits 240. Upon finding a hit signal at any of these outputs, the interface actuates analog to digital converter 246 to sample the peak value or maximum transducer signal magnitude output 296 of the particular strike detection circuit 240 which provided the hit signal. Interface 242 sends an interrupt signal to the master control computer indicating that a strike has occurred and send data words indicating the identity of the particular strike detection circuit and the peak value or maximum magnitude of the transducer signal. The master control computer then enters a hit routine. It looks up in local RAM 37 the identity of the instrument associated with the particular transducer input and the ascertains, also from local RAM 37, the starting addresses for the waveform data associated with that input and also the starting addresses for each of the parameter plots associated with the same instrument. Further, the master control computer calculates a relative actuation intensity value I from the peak value delivered by the pad strike input processor 40. At this point, the master control computer sends the addresses for the waveform data and parameter plots and the relative intensity value to predetermined temporary or "mailbox" storage addresses in RAM 66 of common memory unit 62.

For purposes of the present discussion, it is assumed that one or more of the voice units 68 is unoccupied. The master control computer selects one of the unoccupied voice units essentially at random from all of the unoccupied voice units and sends a "new command" signal to the selected voice unit via command lines 108 of digital data bus 30. In response to the new command signal, the microprocessor 94 of the selected voice unit enters a new command processing routine. In this routine, the microprocessor 94 of the selected voice unit sends, via limit and increment latch 96, signals calling for the predetermined mailbox addresses. These addresses are delivered by the latches when the next available data window occurs during the spinning ram cycle. When this data is received at the microprocessor 94, the microprocessor sends further signals to common memory unit 62 specifying the particular addresses for the first values in each of the parameter plots. Microprocessor 94 of the voice unit performs an initial interpolation cycle upon receipt of these initial parameter values. In this initial interpolation cycle, the microprocessor merely performs a linear interpolation between the first values of the hard-hit and soft-hit plots for each parameter according to the relative intensity value I. Thus, for each parameter:

$$INT_0 = I(H_0 - S_0) + S_0$$

where:

$INT_0$ is the first interpolated value for the parameter;

$H_0$ is the first value for the hardest hit or strongest actuation plot for the parameter; and $S_0$ is the first value for the softest or weakest actuation plot for the same parameter.

Manifestly, the initial value of $INT_0$ for each parameter will approach $S_0$ if the relative intensity value I supplied by the master control computer is close to zero and will approach $H_0$ if this relative intensity value is close to 1.

The pitch values constituting the pitch plots represent sample or readout rates. These pitch values are normalized to the standard sampling rate used in recording all of the waveform data, so that a pitch value of 1.000 represents a readout rate equal to the standard sampling rate $p_s$, typically 50,000 samples per second. A pitch value of 2 would represent a sample reading rate double the standard sampling rate or 100,000 samples per second and so on. Once the microprocessor has captured the initial interpolated value $INT_1$ for pitch, it calculates a readout rate by multiplying the initial interpolated pitch value by the standard sampling rate. Provided that the resulting readout rate is less than the maximum interrupt processing rate of the microprocessor 94 (typically about 75,000 Hz) the microprocessor actuates the frequency divider 124 of local frequency generator 120 to divide the preselected oscillator frequency 122 by an appropriate factor so as to provide a frequency signal at a frequency equal to the calculated readout rate and sets an increment equal to 1. If the sample readout rate resulting from the initial calculation is in excess of the maximum interrupt rate of the microprocessor, however, the microprocessor divides the calculated sample reading rate by an integer, typically 2, and sets an increment equal to the same integer.

The microprocessor then sends the increment and the starting address for the waveform data for the particular instrument, via limit and increment latch 96 and lines 112 of bus 30 back to the address processor 64 of common memory unit 62. In response to this increment and starting address, address processor 64 sets itself to start a running address at the initial address for the first word of waveform data defining a first amplitude value, and to advance through the words at successive addresses in the waveform data in address increments equal to the increment sent by the voice unit. Thus, where the increment is 1, the address processor will send successive words of waveform data at immediately succeeding addresses. Where the increment is 2, the address processor unit will send every other word of waveform data. The words or amplitude values at the addresses so selected by the address processor unit are sent in succession along data lines 110 to the I latch 100 of the selected voice unit. Whenever microprocessor 94 sets a flag indicating that the I latch is ready to receive a word of data, the common memory unit 62 sends the next word of waveform data (the next amplitude value) selected according to the appropriate increment. The frequency generator 120 of the voice unit generates interrupt signals at a rate equal to the readout rate calculated by the microprocessor 9 in the initial calculation. In response to each such signal, microprocessor 94 takes in words of waveform data from I latch 100 and sets a flag indicating that I latch 100 is ready to receive another word.

This cycle of operations continues so that the microprocessor 94 of the selected voice unit 68 is continually supplied with waveform data and so that the values delivered advance through the series of waveform data at a rate proportional to the interpolated pitch value. For example, assuming that the standard sampling rate is 50,000 Hz and the initial interpolated pitch value is 0.5, the increment will be 1 and the frequency generator will generate interrupt signals at the rate of 25,000 Hz. Accordingly, the microprocessor 94 will receive every word of waveform data at a rate of 25,000 Hz or one-half the standard sampling rate. If the interpolated pitch value is 2, the calculated sample read out rate will be 100,000 Hz. The increment will be set to 2 and the frequency generator 120 will be set to a frequency of 50,000 Hz. Accordingly, the microprocessor 94 will take in new waveform data words or amplitude values at the rate of 50,000 samples per second, but the microprocessor will only receive from common memory unit 62 every other word in the waveform data table. Thus, the system will advance 100,000 places in the waveform data table each second, i.e., at twice the standard sampling rate.

As the microprocessor takes in new words of waveform data representing new amplitude values, it sends them in sequence to latch 126 so that the waveform data words appear in sequence at latch 126. While each waveform data word is latch 126, it is supplied to digital to analog converter 146, which emits a voltage directly proportional to the value represented by the digital waveform data word. These successive analog voltages cooperatively define an analog signal replicating the stored waveform but having pitch modified in accordance with the interpolated pitch value. In a sense, the microprocessor and the digital to analog converter effectively play back the stored waveform at a speed proportional to the interpolated pitch value prevailing at the time. Anti-aliasing filter 156 smooths transitions between successive analog values from digital to analog converter 146 to eliminate unwanted components at the sampling frequency.

Microprocessor 94 also performs a routine to read out the parameter values constituting the plots for the various parameters and derive an interpolated plot including successive values representing values of the parameter in question at successive, constant interpolation intervals $t_{INT}$. Typically, $t_{INT}$ is selected so that $t_{INT} = t_h$. The desired values to constituting this plot are shown as $INT_0$, $INT_1$, $INT_2$, $INT_3$ . . . in FIG. 9. As set forth above, a hardest hit and softest hit plot for each parameter are stored in memory. The hardest hit plot consists of a series of values representing values for the parameter at time intervals $t_h$, whereas the softest hit plot for each parameter represents values at typically smaller intervals $t_s$ there being an equal number of values in the hardest hit and softest hit plot for each parameter. If individual pairs of values from the hard-hit and soft-hit were read out in succession as: $H_0$, $S_0$; $H_1$, $S_1$; . . . $H_n$, $S_n$ and individual interpolations were performed between the values constituting each pair, the interpolated values would represent values (circles in FIG. 9) for the parameter at intervals $t_i$, where: $t_i = (t_h - t_s)I + t_s$, I being the relative intensity value mentioned above. However, the program utilized in the microprocessor does not calculate all of these successive values represented by circles in FIG. 9. As will be seen from FIG. 9, many of these values can be skipped. Thus, the interval $t_{INT}$ is far greater than $t_i$ where the interpolated plot is close to the softest hit plot, i.e., where I is small. To calculate the desired interpolated values other than the first interpolated value $INT_0$, the system utilizes a value number index k. On each cycle, the system increments this value number index by 1 and then calculates $K(t_{INT})/t_i$. The result, rounded to the next lower integer yields a lower set number Z. For example, to calculate the value $INT_1$ in FIG. 9, the system utilizes K=0. The calculation $(t_{INT} \times 1)/t_i$ yields 2 plus a fraction. Rounding to the next lower integer gives the set number Z=2. Further, the system takes the fractional remainder $(t_{INT})(k)-(t_I)(z)$ as an offset time $t_o$.

Using the set number index z, the microprocessor 94 calculates the absolute addresses for the values $H_z$, $S_z$ and $H_{z+1}$ and $S_{z+1}$ from the starting addresses for each plot and the number of steps z and z+1 required to reach the particular values required. Microprocessor 94 sends these absolute addresses back to common memory unit 62. The common memory unit forwards data words representing the values $H_z$, $S_z$, $H_{z+1}$ and $S_{z+1}$ via data lines 112 and the P latch 102 of the voice unit. From the values $H_z$, $S_z$; $H_{z+1}$, $S_{z+1}$, the system calculates the interpolated value $INT_k$ according to the formula:

$$INT_k = [(H_{z+1} - S_{z+1})I + S_{z+1} - (H_z - S_z)I - S_z]\frac{t_o}{t_i} + (H_z - S_z)I + S_z$$

Thus, for each control parameter, microprocessor 94 continually calculates absolute addresses for the values needed for the next interpolation, sends these absolute addresses to the common memory unit and utilizes the returned parameter values from the hard hit and soft hit plots to calculate the interpolated values. Typically, the time intervals $t_{INT}$ between interpolated values are equal to the time interval $t_h$ between the successive values constituting the hard hit plot for the parameter in question. Thus, for amplitude and pitch, $t_{INT}$ typically is one millisecond, whereas for all other control parameters $t_{INT}$ typically is sixteen milliseconds. Thus, the interpolation calculations and supply of new parameter values for use in interpolations are performed considerably less frequently than readings of new waveform data words.

As new interpolated pitch values are calculated, the microprocessor calculates new sample readout rates and adjusts the frequency of local frequency generator 120 accordingly as discussed above in connection with the first interpolated pitch value. As the frequency changes, so does the rate at which microprocessor 94 calls for new waveform data, and hence the readout rate. Further, the microprocessor continually recalculates the increment used in connection with waveform readout as discussed in connection with the first calculated increment. If the increment changes, the microprocessor will send the new increment to the address processor 64 of common memory unit 62 so as to alter the increment used by the common memory unit in advancing through the waveform data.

The parameters other than pitch are applied by microprocessor 94 to control the analog processing section 92. As discussed above, the control parameters include a center frequency, Q or frequency to bandwidth ratio and boost or cut value for first equalizer 148 and similar values for second equalizer 150. The microprocessor separates the boost or cut parameter for each equalizer into a magnitude number and a one bit positive or negative sign. The values for the parameters associated with first equalizer 148 are output through data latch 128 to the first equalizer. The digital value for Q is output directly to digitally controllable resistor 170 (FIG. 3) and hence controls the Q of filter network 162. The value for the center frequency of the first equalizer 148 is output to digitally controllable resistor 172, and hence controls the center frequency of the filter network. As the input of filter network 162 is connected to anti-aliasing filter 156, the filter network receives a sample of the reproduced analog waveform from digital to analog converter 146. Accordingly, the output of filter network 162 will be a sample of that reproduced waveform within the band specified by the center frequency and Q values. The sign bit is applied directly to the gate of FET 184. As explained above in connection with FIG. 3, this determines whether the signal reaching circuit node 180 will consist of a non-invented or inverted output from filter network 162. The magnitude of the boost o cut parameter is applied through digital to analog converter 188 to voltage controlled amplifier 186. Accordingly, the output of voltage controlled amplifier 186, and hence the output of first equalizer 148 will be either an inverted or noninverted sample of the signals from filter 156 amplified to a degree specified by the magnitude of the boost or cut. The action of second equalizer 150 is exactly the same. The signal from equalizers 148 and 150 are combined in summing amplifier 157 with the unmodified output from anti-aliasing filter 156. The resulting summed amplifying signal will be attenuated in those frequency bands where inverted signals were applied by the equalizers and boosted in those frequency bands where noninverted signals were applied by the equalizers. The degree of such boost or cut, of course, will depend upon the magnitude of the inverted or noninverted samples from the equalizers. Accordingly, the signal from summing amplifier 157 will be a modified version of the reproduced analog signal provided by digital to analog converter 146 and antialiasing filter 156.

Microprocessor 94 calculates a channel pan value for the left channel 190 and a similar channel pan value for the right channel 192 from the interpolated values of the pan parameter. The pan values are selected so that the sum of the pan values is constant. Thus, as the interpolated value of the pan parameter increases, the calculated channel pan value for the left channel decreases whereas the calculated channel pan value for the right channel increases by an equal amount. These calculated channel pan values are multiplied by the interpolated value of the overall amplitude parameter and multiplied again by a volume constant established by master control computer 36 and sent to the microprocessor along with the new command signal at the start of the process. This provides a composite loudness parameter for the left channel 190 and a similar composite loudness parameter for the right channel 192. These composite values are applied through digital to analog converters 154 and 152, respectively to yield analog composite loudness signals. These are passed through low pass filters 210 and 200, respectively to the control inputs of voltage controlled amplifiers 194 and 202. Thus, the outputs of voltage controlled amplifiers 194 and 202 will be copies of the signal from summing amplifier 157 multiplied by the appropriate composite loudness parameters. Filters 200 and 210 serve to smooth out sudden changes in the analog composite loudness values and hence avoid abrupt changes in the amplification applied by voltage controlled amplifiers. The outputs from voltage controlled amplifiers 194 and 192 after passing through DC blocking capacitors 196 and 206 are amplified by high precision, low offset amplifiers 198 and 208 to provide output signals on left and right output connections 70 and 72, respectively.

As will be appreciated, these output signals constitute a reproduced version of the waveform data for the particular instrument read out from common memory unit 62 at a readout rate or playback rate which may vary with time according to the pitch parameter plots, modified as to overall amplitude pan and boost or cut of selected frequencies by amounts which also vary with time according to the various parameter plots.

At the same time as the master control computer 36 selects a voice unit 68 to reproduce a sound simulating a particular instrument, the master control computer also sends the appropriate signals via output control line 88 to the output units 78 so that the output signal from the selected voice unit appears in the composite final output signal of the correct output unit 78. Thus, once the master control computer has identified a voice unit to reproduce a sound simulating a particular instrument, the master control computer has implicitly established that such output signal simulating a particular instrument will appear on particular voice unit channels 212 of the analog output bus 32. The master control computer utilizes that information to calculate appropriate connections between output bus channel and the summing amplifiers of particular output units. For example, where the second voice unit **68*b* is selected to produce a sound simulating a cymbal, and where the first output unit 78*a* is designated as carrying cymbal sounds, the master control computer via output data line 88 sends signals to the data latch 238 (FIG. 4) of the second output unit 78*b* so as to interconnect the summing amplifiers 226 and 224 of that output unit with the second output channel bus 212*b*. The impedance of each such interconnection is established by the mixing parameters for each instrument associated with the particular output unit in the tabular data in local RAM 37. Thus, where the mixing parameter is 100% for the particular output unit and the particular instrument, the interconnection is established at the minimum impedance. Where the mixing parameter is less than 100%, master control computer actuates the output control interface to signal the latch 238 and appropriate digitally controllable resistors 228 and 234 to establish that particular interconnection with a higher impedance. As will be appreciated, where plural voice units are assigned to simulate plural sounds emanating from the same instruments, a single output unit may be actuated to connect to plural output bus voice unit channels 212. Also, where the pattern of correlation between output units and instruments call for plural output units 78 to carry sounds simulating the same instruments, the output amplifiers 224 and 226 of plural output units will be interconnected with the same output bus voice unit channel 212**.

Thus, the output signals from the voice unit selected to reproduce a particular sound is delivered along the left and right outputs 82 and 84 of the appropriate output unit 78. This sound may be reproduced by conventional loudspeaker devices 86.

As will be appreciated, the selected voice unit 68, the output control unit 44 and the selected output units 78 require small but finite times to implement the commands necessary to start an output signal and direct that output signal through the appropriate output units. These times are minimized by arranging the software so that the tasks associated with starting a new output signals responsive to a new strike input have relatively high priority. Thus, the master control computer 36 is arranged to drop other tasks upon receipt of the interrupt signal sent by strike input processor 42 responsive to actuation of one of the transducers 48. Further, because the strike input processor 42 is directly linked to the data bus 40 of master control computer 36, via single-bit line 44 the interrupt signal can be sent without delay caused by any intermediate processing. Additionally, the flag and command lines 108 of digital data bus 30 (FIG. 2) carrying the new command signal are linked directly to the master control computer through the bus interface 38. Therefore, the new command signal is sent under the direct control of master control computer 36 without waiting for a clear data window in the spinning RAM cycle. All of these arrangements aid in minimizing the delay from the time the musician actuates transducer 48 to the time sound appears at the loudspeakers 86. Typically, this time is less than about nine milliseconds, and desirably less than about six millisecond. Such brief delay is essentially imperceptible to the musician. The synthesizer thus gives the sensation of providing sounds instantaneously upon percussive strikes, much like a real percussive instrument.

The order in which tasks are accomplished by the voice unit 68 and the output control interface 44 and output unit 78 is controlled by timing or "strobe" signals sent by master control computer 36. Along with the data indicating the appropriate output units and interconnections, the master control computer sends via output line control 88 a signal telling the output control unit to place the new interconnections into effect at a predetermined time set by the strobe signals. Likewise, the new command signal sent to the voice unit 68 by the master control computer 36 includes a timing section instructing the voice unit to start the output signals upon occurrence of a predetermined strobe signal. Desirably, these timing signals are arranged so that the appropriate interconnections of the output unit to the voice unit channels of the output bus 32 are made before the output signal appears at the output paths 70 and 72 of the voice unit. Accordingly, the signal sent to the output unit will start from zero and rise gradually in amplitude as commanded by the control parameter plots sent to the voice unit **68*a***.

The operations associated with production of an output signal by the voice unit continues unless interrupted as described below, until the end of the sound occurs. The end of the sound may occur when the system reaches the end of the waveform data file being read. The waveform data file or series of digital values defining the recorded waveform has an end of file flag within the last few words of data. Microprocessor 94 is arranged to recognize this flag and initiate a termination routine upon such recognition. The termination routine desirably includes rapid but gradual reduction in the amplitude of the output signals, as by a preprogrammed rapid reduction of the digital values supplied to converters 154 and 152, so that the output signal amplitude and hence the sound amplitude are reduced rapidly but gradually to zero during that portion of the waveform represented by the last few words of waveform data.

Alternatively, the amplitude settings specified by the interpolated amplitude plot may reach zero before the system reaches the end of the waveform data. Thus, the waveform data typically is provided so that at a playback or readout rate equal to the standard sampling rate, the waveform data will last for a time at least equal to the duration $T_{eh}$ (FIG. 8*a*) of a hard hit. However, where the amplitude of the strike is low, the amplitude will decay to zero in a relatively short time, closer to $T_{es}$ associated with the softer hit. When the interpolated amplitude reaches zero, the microprocessor recognizes that condition as denoting the end of the sound simulated. Inasmuch as the amplitude of the output signal has been reduced to zero in accordance with the interpolated amplitude curve, there is no need for any further gradual reduction routine in this case. Use of the interpolated amplitude zero as an end of signal indicator requires that neither of the hardest hit or softest hit amplitude parameter plots 452 and 454 go to zero at any point prior to the last value in the plot. This is ordinarily the case with amplitude parameter plots intended to simulate real instruments. However, where it is desired to simulate an hypothetical instrument having a sound which decays to nothing and then rebounds to a larger value, those portions of the amplitude parameter plots 452 and 454 simulating this behavior should be arranged with very low non-zero values.

After terminating the output signals, the microprocessor sends a flag via latch 98 and flag and command lines 108 to the master control computer 36 indicating that the voice unit is clear or ready for another task. During the intervals between tasks, the microprocessor continually maintains a zero waveform value at latch 126 and low or zero values at the converters 154 and 152, so that there is no signal at outputs 70 and 72.

ECHO EFFECTS AND VOICE UNIT ALLOCATION

The master control computer 36 may be arranged to perform an automatic echo generation scheme. Thus, the master control computer may be arranged to respond to a strike input on particular transducer input 246 by initiating a series of output signals representing plural sounds. Thus, the master control computer may be programmed to issue a series of new command signals (together with the necessary waveform data and control parameter plot addresses) over a period of time in response to a single strike input signal Together with each such new command signal the master control computer is arranged to calculate an new intensity value for each echo in the series and based upon an echo schedule stored in local RAM 37 specifying the intensity values for echoes as a function of original strike intensity. Master control computer 36 in effect generates additional echo input signals similar to the strike input signals received from strike input processor 42.

As the master control computer actuates voice units to provide signals responsive to the input signal from the pad strike input processor 42 and responsive to the echo input signals self-generated by the master control computer, the master control computer establishes a record in a current outputs data table in RAM 37. The record for each input signal includes the identity of the instrument associated with the input signal, the relative intensity value originally associated with the input signal when received or when self-generated, the identity of the voice unit (if any) assigned to produce an output signal responsive to that input signal and a running score for that signal. The running score is used as described below to establish priority as between possibly conflicting input signals.

Figure 10:
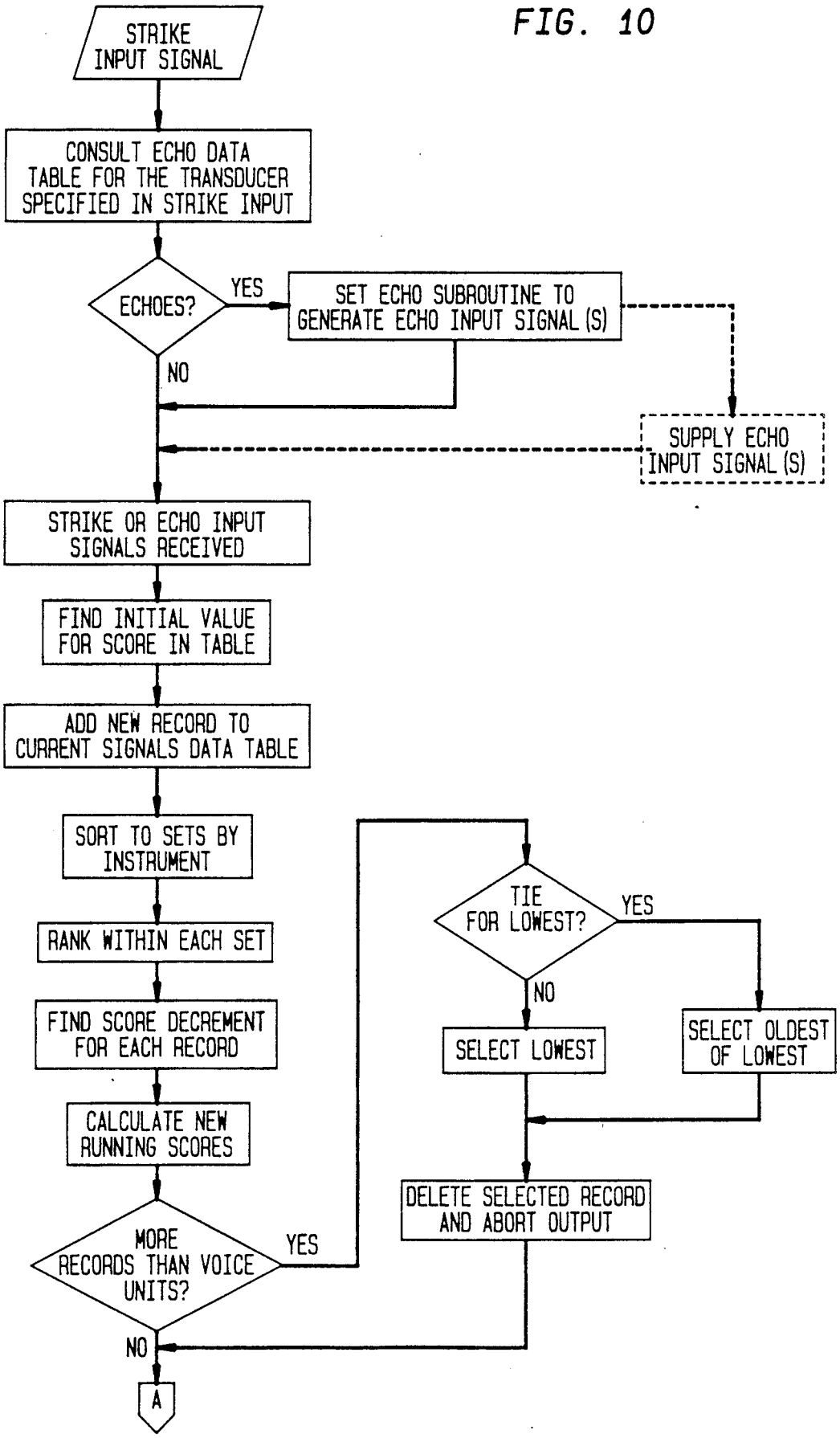

The master control computer has in local RAM 37 a table of initial values associated with various instruments. The initial value table contains different entries for use with echo signals than for use with original strike input signals. Typically, the initial values incorporated in the table for echo signals are lower than the initial values for strike signals. As each new input signal is received, the master control computer retrieves the appropriate initial value depending upon the instrument specified by the input signal and upon whether the input signal is an original or echo input. The master control computer makes a new record in the current signals data table for the newly received input signal. The running score for this new record is set equal to the initial value retrieved from the table. Computer 36 then executes a score resetting routine. (FIG. 10) The computer sorts the records in the current signals data table into sets according to the instruments specified in the particular record. Those records in each set, all of which specify the same instrument, are then ranked in order according to the original intensity or amplitude value I set forth in the record, i.e., according to the original intensity of the strike or echo. The computer then finds a score decrement for each record according to a score decrement table also stored in local RAM 37. The score decrement table contains separate entries for each instrument. Each such entry includes a series of progressively increasing values to be applied to records for that instrument depending upon the order. Thus, the decrement entries in the decrement table for one instrument may be 1, 2, 3 . . . indicating that a decrement of 1 would be applied to the first record in the set for that instrument having the highest original intensity value I, a decrement of 2 would be applied to the second record in the set and so on. The computer then applies the decrement to the running score within each record to provide a new running score. This decrementing process is applied to the record representing the newly received input signal. As each new echo or strike input signal is received, the cycle of operation is repeated so that each running score is repeatedly decremented. Accordingly, the running scores associated with records for older input signals, which have been decremented many times, normally will be lower than the running scores for new input signals decremented only once.

Having calculated the new running scores, the computer determines whether or not the number of records in the current signal data table exceeds the number of voice units. If so, then the input signals received specify production of more output signals than can be accommodated by the voice units. In this case, the computer searches for the record having the lowest running score, deletes that record and sends an abort command to the voice unit associated with that record. In response to the abort command, the voice unit microprocessor 94 (FIG. 2) executes the aforementioned termination routine, thus gradually but rapidly reducing the value supplied to the D/A converters 152 and 154, so as to bring the output signals on output paths 70 and 72 of the voice unit to zero quickly but without any discontinuous step. In the event that two or more records have the same score and that common score is lowest, the computer picks the oldest one of these equal-score records for deletion.

After deleting the selected record, the microprocessor issues a new command signal for the newly received strike or echo input signal. This new command signal is sent to the voice unit previous carrying the deleted output signal. If the number of records in the current signal data table is less than the number of voice units in the system, there is no need to delete any record or to abort any of the output signals. Instead, the system merely send a new command signal to one of the unoccupied voice units. Whenever a voice unit finishes the task of emitting an output signal, it so signals the master control computer by providing an appropriate flag as discussed above. Upon receipt of such a flag, the master control computer deletes the record associated with the particular input signal which originally actuated that voice unit from the current output table. Thus, where the synthesizer is played in a relatively slow rhythm, there will be available unoccupied voice units and the running scores will never be applied to pick a record for deletion. However, where the synthesizer is played rapidly, and/or with many echo signals, all of the voice units will be occupied and the running scores will be applied to free some of the voice units for production of output signals responsive to newly received input signals. It should be appreciated that in some cases the record associated with a newly received input signal may have a lower running score than records associated with older input signals. For example, where the data provided in the initial value table for the different instruments differs greatly from instrument to instrument, records associated with a new input signal having a low initial value may have the lowest running score. In this case, the record associated with the newly received input signal will be deleted without ever resulting in issuance of a new command to a voice unit and hence without production of any corresponding output signal.

OVERLAP VARIATION OF OUTPUT SIGNALS

Figure 11:
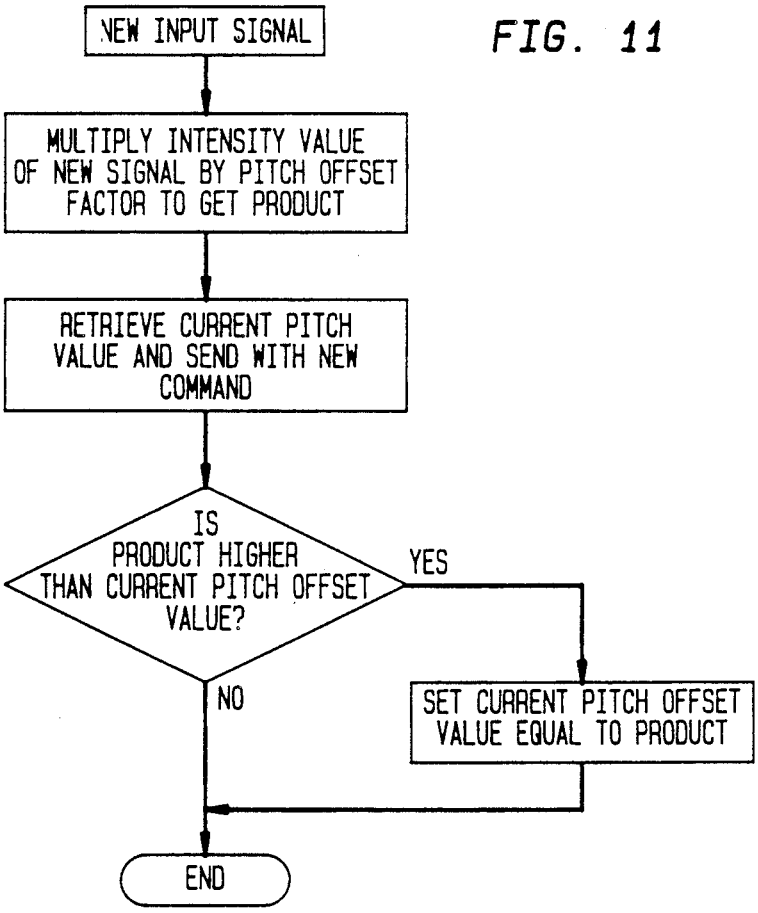

A table of pitch offset factors and pitch offset decay rates is stored in local RAM 37 of master control computer 36. This table includes a separate pitch offset factor and pitch offset decay rate for each instrument or vibratory element to be simulated. The master control computer maintains a current pitch offset value with respect to each instrument or element. In the absence of any input signals calling for production of an output signal simulating a particular instrument, the current pitch offset value is zero. When a new input signal calling for simulation of a particular instrument is received, the master control computer executes the pitch adjustment routine shown in FIG. 11. The computer multiplies the intensity value I for the new input signal by the pitch offset factor for the instrument in question to get a product. The master control computer also sends the current pitch offset value as part of the new command produced in response to the new input signal.

After this step, the master control computer compares the product calculated for the new input signal with the current pitch offset value. If the product is greater than the current pitch offset value, the computer replaces the current pitch offset value for that instrument with the product.

The computer continually decrements the current pitch offset value for each instrument at a rate proportional to the pitch offset decay rate for that instrument. Thus, after an input signal has been received from a given instrument the current pitch offset value will be non-zero, and its magnitude will depend on the intensity value of that input signal. If another input signal for the same instrument is received before the current pitch offset value has been decremented to zero, then this non-zero value will be sent as the pitch offset value in the new command. Thus, when multiple, closely-spaced input signals are received calling for overlapping sounds from the same instrument, non-zero pitch offset values will be provided to the voice units in the new commands.

The voice unit microprocessor adds the pitch offset value to the pitch or readout rate parameter calculated by interpolation between plots. Accordingly, a positive pitch offset factor will effectively increase the pitch or readout rate used in producing the output signal. Thus, the frequency spectrum of the output signal will be shifted towards higher frequencies. The magnitude of this shift will depend on the time since the last previous input signal for the same instrument, on the intensity specified in that input signal, and on the stored factors and hence on identity of the instrument.

With widely spaced input signals corresponding to slow rhythm, the current pitch offset values will be zero, and hence there will be no frequency shifts.

The pitch offset factors and decay rates are selected by the musician or preprogrammed in the instrument to provide effects as desired. If the pitch offset factor for an instrument is negative, the output signal can be shifted towards lower frequencies.

In a variant of this approach, previously issued commands can be replaced in response to new input signals for the same instrument. The replacement commands may include a pitch offset value dependent upon the intensity specified in the new input signal. Thus, previously started sounds can be modified to simulate interaction with new strokes.

In a further variant, the same scheme can be applied to provide offsets for parameters other than pitch.

The new commands (including replacement commands) issued by the master control computer may include randomization factors for one or more control parameters. A table of variability factors may be stored in local RAM 37. There may be a separate variability factor for each control parameter for each instrument. Prior to issuing a new command, the master control computer looks up the variability factor for each control parameter for the instrument associated with the new command and multiplies the variability factor by a random number generated by any suitable pseudorandom number generation subroutine so as to yield a randomization factor for each control parameter. These randomizing factors may be transmitted as part of the new command when issued. The microprocessor of the selected voice unit 94 will multiply the interpolated value for each control parameter by the randomization factor for that control parameter before applying the same in production of an output signal. As will be appreciated, this arrangement provides for variability in the sounds produced by the synthesizer in response to input signals applied by the musician. Typically, the variability factors are selected so that the random variation in a control parameter may amount to only a few percent of the value of such control parameter. Thus, the randomization factors typically do not affect the sound dramatically. Instead, they introduce very subtle variations which avoid an unrealistically perfect or "mechanistic" quality in the output.

DATA INPUT AND OUTPUT

As set forth above, the synthesizer must be loaded with a considerable amount of data before use. This data includes the items mentioned above such as the waveform data, the parameter plots, the randomization factors for the various instruments, pitch offset factors for each instrument, the initial values for the running scores used in the priority scheme and others, all of which define the sound qualities of the instrument. Preferably, much or all of this data is provided in a prerecorded data medium such as the disk 51 (FIG. 2). Prerecorded media incorporating such data thus constitute a further aspect of the present invention. The musician can obtain an entire new sound quality from the synthesizer merely by inserting a new prerecorded data medium and actuating the system to take up the new data. If the musician is content with the sound quality provided by this prerecorded data, he need not input any data manually other than the data defining the relationships between transducer input connections 246 and particular instruments and the data defining the relationships between output units 78 and particular instruments. Thus, the synthesizer can be used readily without extensive training.

Figure 13:
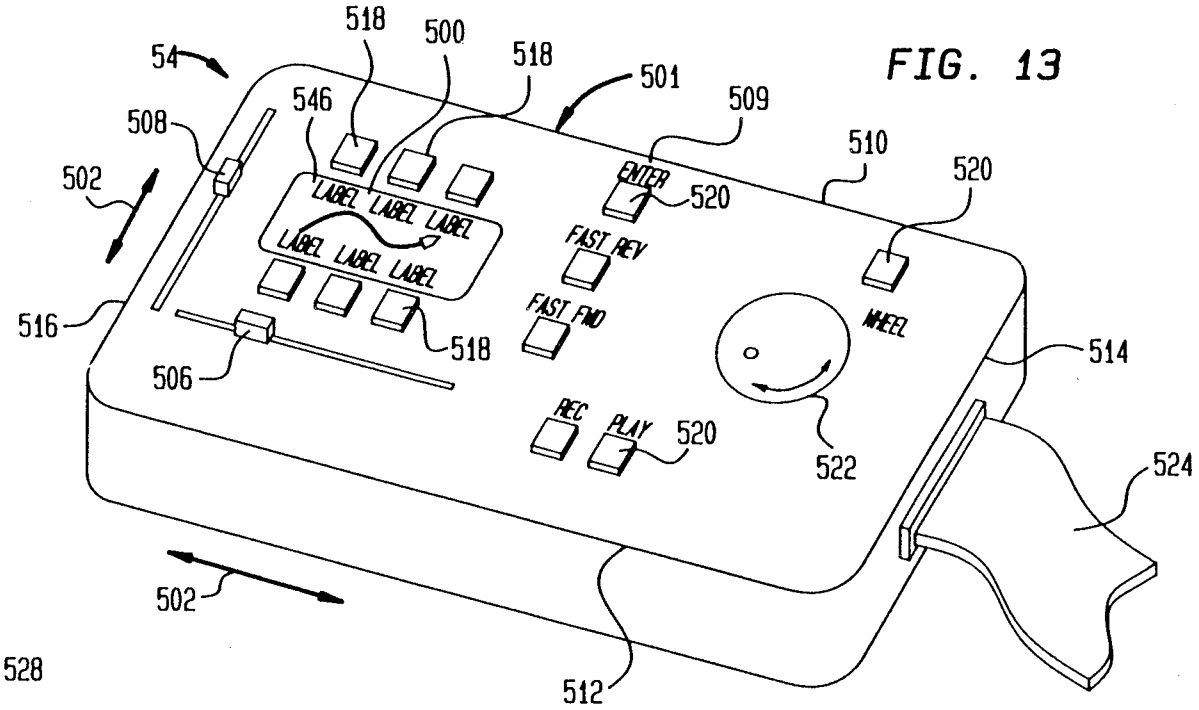
FIG. 13 is a schematic perspective view of a component of the synthesizer of FIGS. 1-11.
Figure 14:
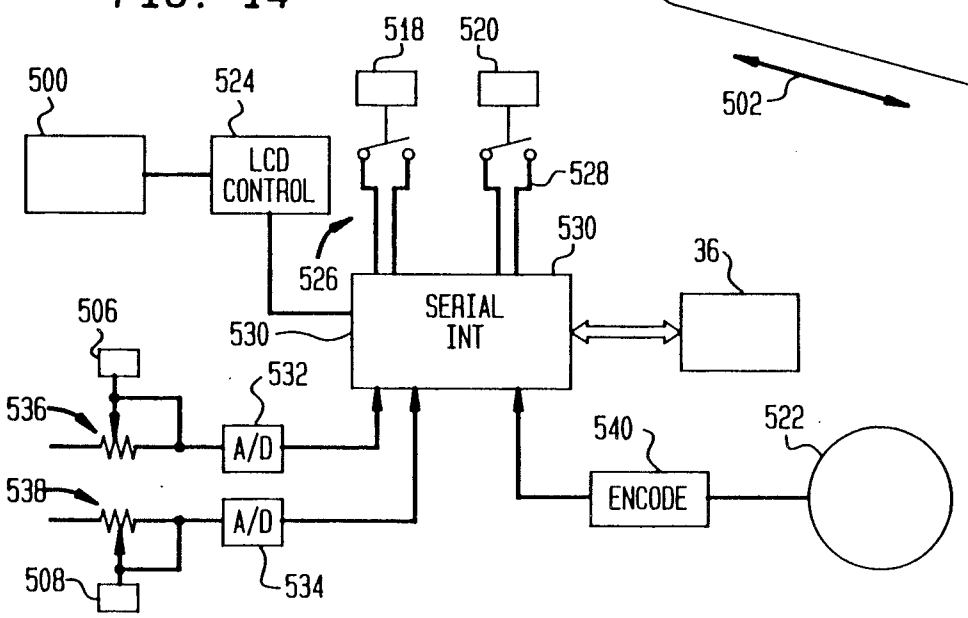
FIG. 14 is a functional block diagram of the component shown in FIG. 13.

More advanced musicians may wish to alter the sound qualities of the instrument themselves. In particular, the musician may wish to change some or all of the parameter plots. This can be accomplished by entering keystroke commands via a conventional keyboard and screen included in data I/0 equipment 52 (FIG. 1). Desirably, the data I/0 equipment includes a special control panel 54 (FIGS. 13 and 14) to facilitate these and other adjustments of the synthesizer. Control panel 54 has a display screen 500 mounted on a body or casing 501. The screen defines a first or horizontal direction 502 and a second or vertical direction 504 substantially perpendicular to the first direction. A first control knob 506 is mounted to casing 501 for movement in the horizontal direction relative to the screen 500 and the casing 501, whereas a second control knob 508 is mounted to the casing 501 for movement in the vertical direction 502 relative to the screen and casing. Casing 501 has indicia 509 marked thereon. These indicia indicate an up and down and left and right orientation of casing 501, i.e., the orientation required for the indicia to stand right side up and to read from left to right. Thus, casing 501 has a predetermined top 510, bottom 512, left side 508 and right side 514. The horizontal and vertical directions defined by screen 500 are selected so that the horizontal direction is substantially left to right and the second direction is substantially up and down in this orientation of casing 501. First control knob 506 is mounted along the lower or bottom edge of screen 500 whereas second control knob 508 is adjacent the left side of screen 500.

In addition to first and second control knobs 506 and 508, the control panel also has additional buttons disposed adjacent screen 500, together with other buttons 520 disposed adjacent portions of indicia 509 designating permanently assigned functions. Additionally, control panel 54 has a wheel 522 mounted to the casing 501 for rotation relative thereto. A data cable 524 is provided for physically connecting the control panel to the master control computer 36. Screen 500 is electrically connected to a screen control circuit 524. Desirably, screen 500 is a liquid crystal display, and control circuit 524 is a conventional device for controlling such a liquid crystal display. Each of buttons 518 and 520 has associated with it switch 526 or 528. A serial interface device 530 mounted within casing 501 is connected to switches 526 and 528 for receipt of signals therefrom. Additionally, serial interface device 530 is connected to analog to digital converters 532 and 534. Each of these is in turn connected to a respective potentiometer 536 and 538. Potentiometers 536 and 538 are connected to first knob 506 and second knob 508, respectively. Accordingly, serial input 530 receives data indicating the position of each of these knobs. Further, wheel 522 is connected to a rotary encoder 540, which is also connected to serial interface 530.

Serial interface 530 is connected to master control computer 36 for exchange of data therewith. The program within master control computer 36 incorporates an interface control section determining the interpretation given to digital data sent by interface 530 representing actuation of the various knobs, buttons and wheels. Further, the master control computer program includes a coordinated output section controlling the data sent to interface 530 and thus controlling the display on screen 500. Most preferably, these portions of the master control computer program are arranged to operate in either of two modes. In a first or graphics mode, the master control computer program displays a graph such as a graphic depiction of a parameter plot on the screen 500. The graphs displayed in this mode may be much like the depictions of parameter plots in FIGS. 8*a* through 8*f*. When operating in this graphics mode, the master control computer may interpret the data representing position of first knob 506 as a value of an ordinate or independent variable, i.e., as a value of time along the time axis of a parameter plot. In the same mode, the master control computer program interprets the position of second knob 508 as representing the abscissa of the parameter plot, i.e., the value of the dependent variable such as amplitude, equalizer center frequency, etc. The musician may employ these slidable knobs to move a pointer about the screen, thus effectively drawing a plot. The master control computer includes conventional graphics interpretation software for converting such a drawn graph of a plot into a series of values. In another operating mode, the master control computer may be arranged to interpret the position of knob 508 as setting an overall volume level and to interpret the position of knob 506 as setting a left to right pan level. As will be appreciated, the knob 506 and 508 provide a natural or instinctive control facility in either mode. It is natural to adjust the ordinate or independent value in drawing a graph along a left to right axis and to adjust the abcissa or dependent variable along the up and down axis. Likewise, it is natural to adjust a volume control up and down and a pan control left to right. Desirably, the master control computer program can also be arranged to provide varying interpretations for the position of wheel 522. Wheel 522 may be used as an additional graph drawing element, and rotation of the wheel may be interpreted as changing either the independent value such as time shown on the graph or the dependent value or abscissa dependent upon actuation of a button 520 immediately adjacent the wheel 522.

Desirably, the master control computer program actuates screen 500 to display labels 546 for each of buttons 518. The master control computer program may be arranged to change these labels from time to time and to interpret actuation of any such button in a manner consistent with the label displayed.

Analog transducers 49 associated with analog transducer inputs 247 of strike input processor 42 may be used to apply so-called "external influences" to synthesizer. Such external influences represent conditions other than strikes which can alter the sound of a percussive instrument. The master control computer program may be arranged to recognize certain such external influences as calling for issuance of additional new commands. For example, where an analog input on a particular analog input connection 247 represents the spreading or despreading motion of a pair of "high hat" cymbals, the synthesizer may be programmed to treat the high hat cymbals a either of two distinct instruments having two different sets of properties, and hence having different waveform data and different parameter plots, dependent upon whether the analog value so applied is above or below a certain threshold. Thus, when the analog value drops below the threshold while one of the voice units is emitting an output signal representing the spread cymbal instrument, the master control computer program may issue an abort signal to that voice unit and send a new command initiating a new output signal representing the despread cymbals.

ADDITIONAL EMBODIMENTS

Figure 15:
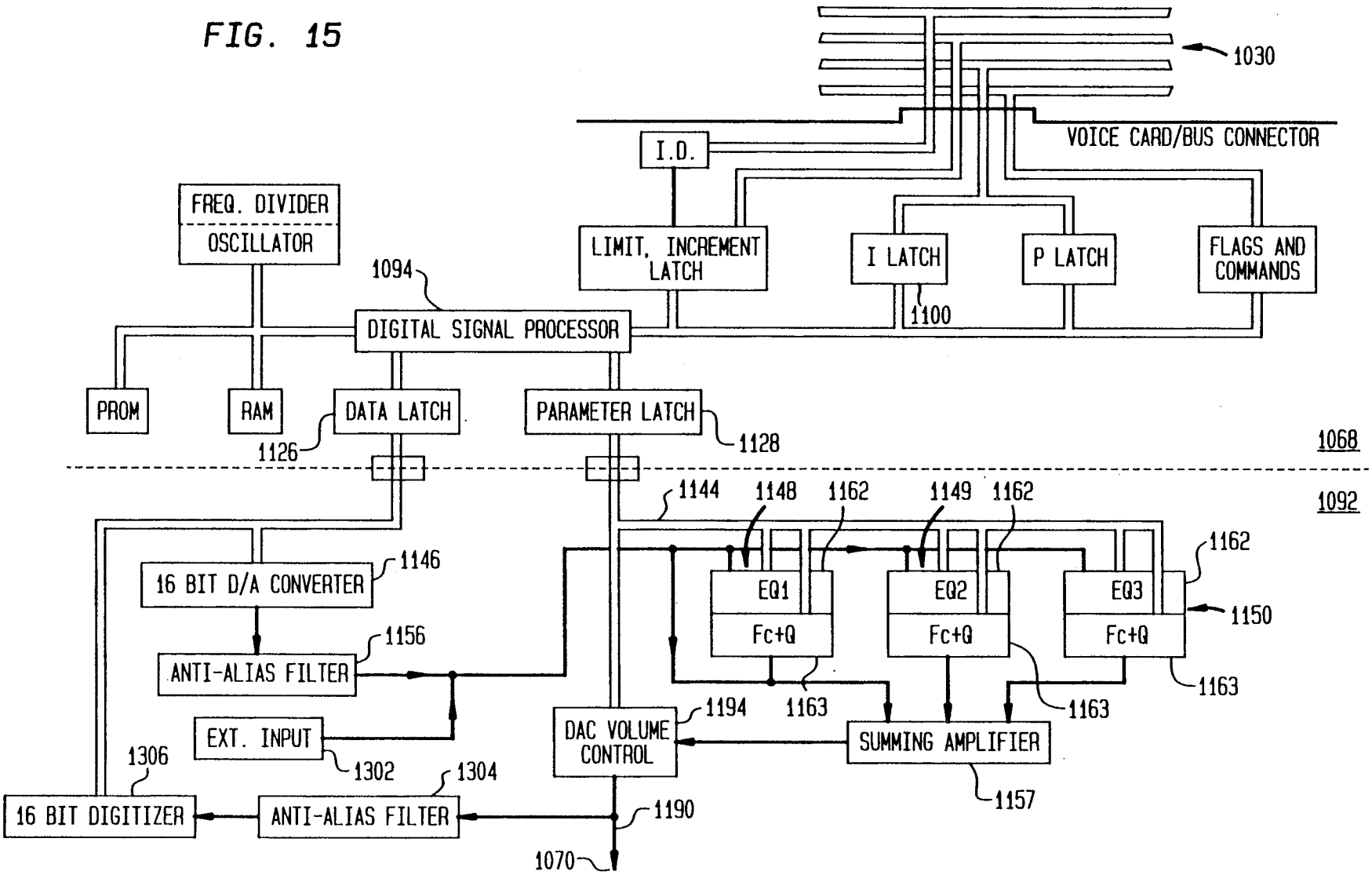
FIGS. 15 and 16 are functional block diagrams similar to FIGS. 2 and 4, respectively, but depicting portions of a synthesizer in accordance with a further embodiment of the invention.
Figure 16:
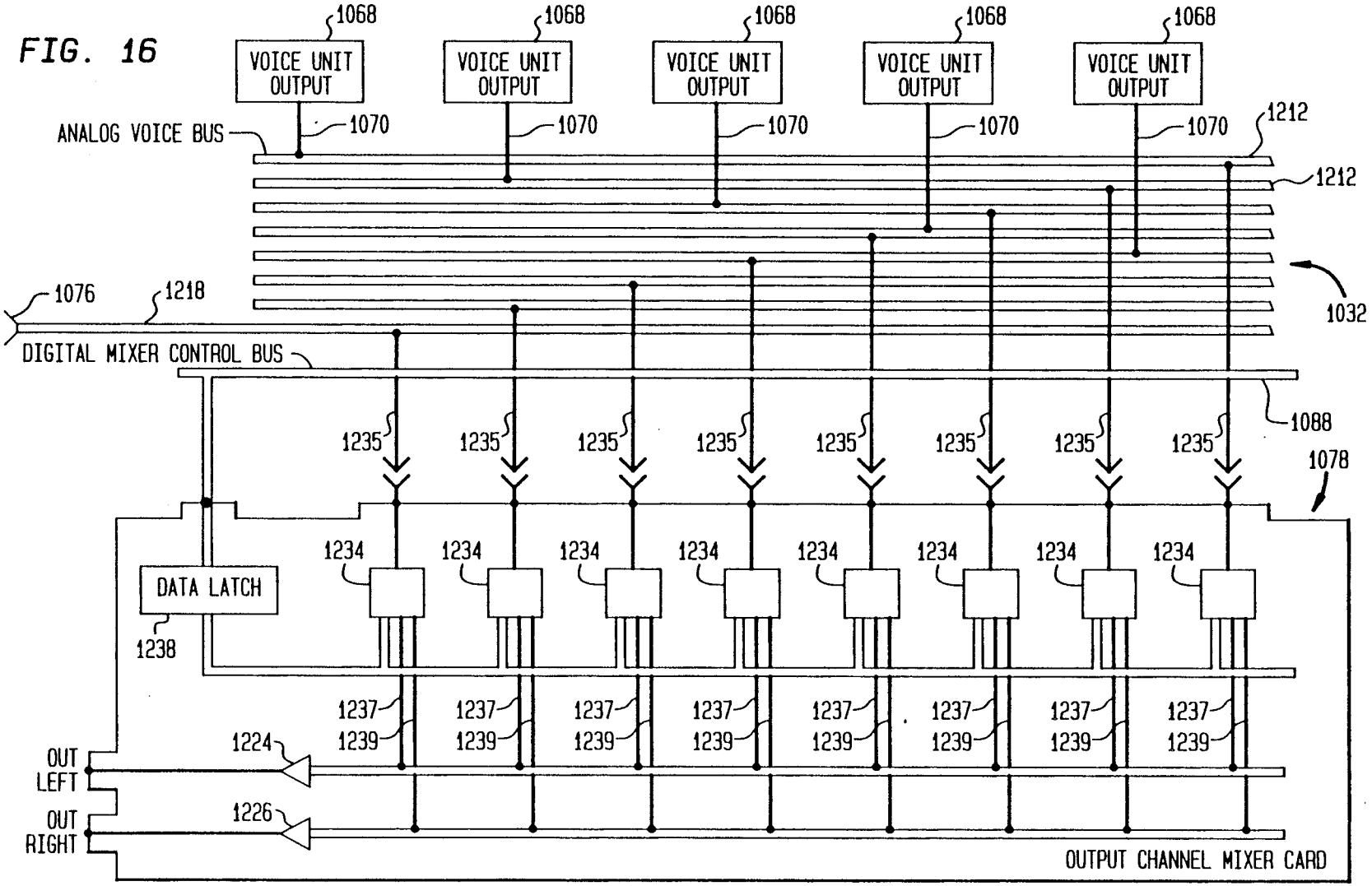

A synthesizer in accordance with a further embodiment of the present invention is partly shown in FIGS. 15 and 16. This synthesizer is generally the same as described above with reference to FIGS. 1–14. Thus, the synthesizer according to this embodiment includes a digital data bus 1030 and associated components similar to those described above. Each voice unit 1068 incorporates a digital section 1090 similar to the digital section 90 of the previously described voice units. However, the analog section 1092 of each voice unit has only one output path 1190 feeding a single output connection 1070. In the analog section 1092 of each voice unit according to this embodiment, the waveform data is passed from the waveform data latch 1126 of the digital section into a 16 bit digital to analog converter 1146 and through an anti-aliasing filter 1156 similar to that described above. The resulting analog signal passes to a summing amplifier 1157 via a direct path from filter 1156 and also via three equalizers 1148, 1149 and 1150. Each such equalizer includes a parameter controllable filter network 1162 similar to the filter network 162 discussed above with reference to FIG. 3. The output of each such filter network 1162 is connected to the input of a V-ref-able digital to analog converter configured as a so-called 4-quadrant multiplier. This device is arranged to vary the magnitude of a signal passing through it and to apply either a 180° phase shift or no phase shift all depending upon digital values supplied to the multiplier. One such V-ref-able digital to analog converter is available under the designation Analog Devices No. 7111 from Analog Devices, Inc. of Norwood, Massachusetts, USA. In effect, the analog multiplier replaces the inverting operational amplifier 182, field effect transistor 184, resistor 178 and voltage controlled amplifier 186 of FIG. 3. Just as in the embodiment discussed above, the components of equalizers 1148, 1149 and 1150 are connected to parameter latch 1128 via parameter bus 1144. Accordingly, digital values of control parameters will adjust the individual equalizers to select portions of the analog signal delivered through anti-aliasing filter 1156 in a particular frequency band and to apply phase shift and amplitude variations to the so-selected portion. When these selected portions are combined with the original signal in summing amplifier 1157, the result is boost or cut of selected portions of the frequency spectrum in the analog signal. Further, the analog section 1092 incorporates a volume control utilizing a digitally controllable variable resistor or D/A converter 1194 instead of a voltage controlled amplifier. Desirably, this D/A converter is arranged to provide fine stepwise variation in its resistance so as to minimize discontinuities in the sound delivered. As will be appreciated, the single volume control provides only a single output signal from each voice unit 1068.

As seen in FIG. 16, the analog output bus 1032 includes voice unit channel 1212 and extra channels 1218, of which only some are shown for clarity of illustration. These are similar to the corresponding voice unit and extra channels in the analog output bus 32 of FIG. 4. However, in this embodiment, each channel includes only one conductor for transmission of a monaural signal. As in the embodiment discussed above, infeed means including infeed port 1076 are connected to the extra channels 1218, so that external audio frequency signals may be applied thereto.

Each output unit 1078 incorporates a plurality of dual output digitally controllable variable resistor units 1234. Each such unit has a single signal input 1235 and left and right signal outputs 1237 and 1239 respectively. Each such unit is arranged to connect its input 1235 to each of its outputs 1237 and 1239 with an impedance specified by a digital value supplied to the unit. The impedances provided by a given unit 1234 between the input and the two outputs 1237 and 1239 may be the same or different depending upon digital control values supplied to the unit. The digital control inputs of all variable resistor units 1234 in the output unit 1078 are connected to a common data latch 1238 which in turn is connected to the output control line 1088 of the synthesizer. The output control line 1088 is connected to the master control computer (not shown). The left outputs 1237 of all variable resistor units 1234 are connected to a common left summing amplifier 1224, whereas the right outputs 1239 of all variable resistor units 1234 in the output unit 1078 are connected to a common right summing amplifier 1226. The analog signal input 1235 of each Variable resistor unit 1234 of the output 1078 is connected to one of the channels 1212 or 1218 of the analog output bus 1032.

As in the sYnthesizer discussed above, the signal from each voice unit 1068 is delivered to one channel 1212, Where as the signal from each infeed port 1076 is delivered to only one channel 1218 of bus 1032. The master control computer actuates the variable resistor units 1234 to establish connections between the channels of bus 1032 and amplifiers 1224 or 1226 of each voice unit 1078, and to control the impedances of these connections. Accordingly, the left and right amplifiers 1224 and 1226 of each voice unit 1078 will provide left and right final composite output signals including the signals from the various voice units 1068 and infeed ports 1076 mixed in proportions a specified by the impedance settings sent by the master control computer through line 1088. As in the arrangement discussed above, the connections and disconnections of the output units from the various bus channels are controlled in coordination with reassignment of the different voice units to produce signals simulating sounds by different instruments. Thus, as discussed above, the signals from each output unit 1078 will incorporate signals simulating the selected instruments in a preselected mixture. As will be appreciated, the variable resistor units 1234 can be controlled by the master control computer to vary the relative strengths of the signal from each bus channel 1212 or 1218 delivered to the left and right amplifiers 1224 and 1226. The master control computer can adjust the "pan" value or ratio between signal strength through the left and right amplifiers 1224 and 1226 in each voice unit 1078 independently for the signal from each bus channel 1212 and 1218. Thus, pan control is effected in the master control computer, rather than as a result of a pan parameter delivered to a voice unit.

The arrangement of FIGS. 15 and 16 greatly simplifies the contruction of the synthesizer, inasmuch as the voice units and output bus channels need only accommodate a single analog signal rather than a stereophonic, dual analog signal. Further, the use of digital-to-analog converters or digitally controllable variable resistors for volume control and for gain control in the individual equaliziers 1148, 1149 and 1150 in place of voltage controlled amplifiers and the like further simplifies the design and reduces its cost.

As further shown in FIG. 15, each voice unit includes an external input connection 1302. This connection may be in the form of a jack brought to the exterior of the synthesizer via appropriate leads (not shown). This external input connection 1032 is connected in parallel with the output of anti-aliasing filter 1156. Thus, an analog audio frequency signal from an external source may be applied through external input connector 1032 and sent through the equalizers 1148–1150, summing amplifier 1157 and volume control 1194 in the same manner as a signal derived from waveform data. The properties of the equalizers and volume control may be adjusted as desired to apply the same sort of signal processing normally used in operation of the synthesizer. These properties may be set via appropriate commands sent from the master control computer. Normally, these properties would be fixed rather than time varying, although time varying properties may also be specified. Thus, the signal processing equipment of the voice unit can be employed to vary the properties of externally supplied signals. The processed signals will be delivered through the output 1070 of the voice unit and hence will be sent through the analog output bus 1032. Such processed signals may be mixed with other signals at output units 1075 The number of such signals Which can be processed will be equal to the number of voice units in the synthesizer. In effect, the synthesizer according to this embodiment can serve as a multichannel, programmable equalizer. Where the external signal is a stereophonic signal, two voice units may be used in this fashion to process it and deliver separate left and right processed signals on two channels 1212 of the analog output bus 1032 for mixing by output units 1078.

Figures 17, 17A:
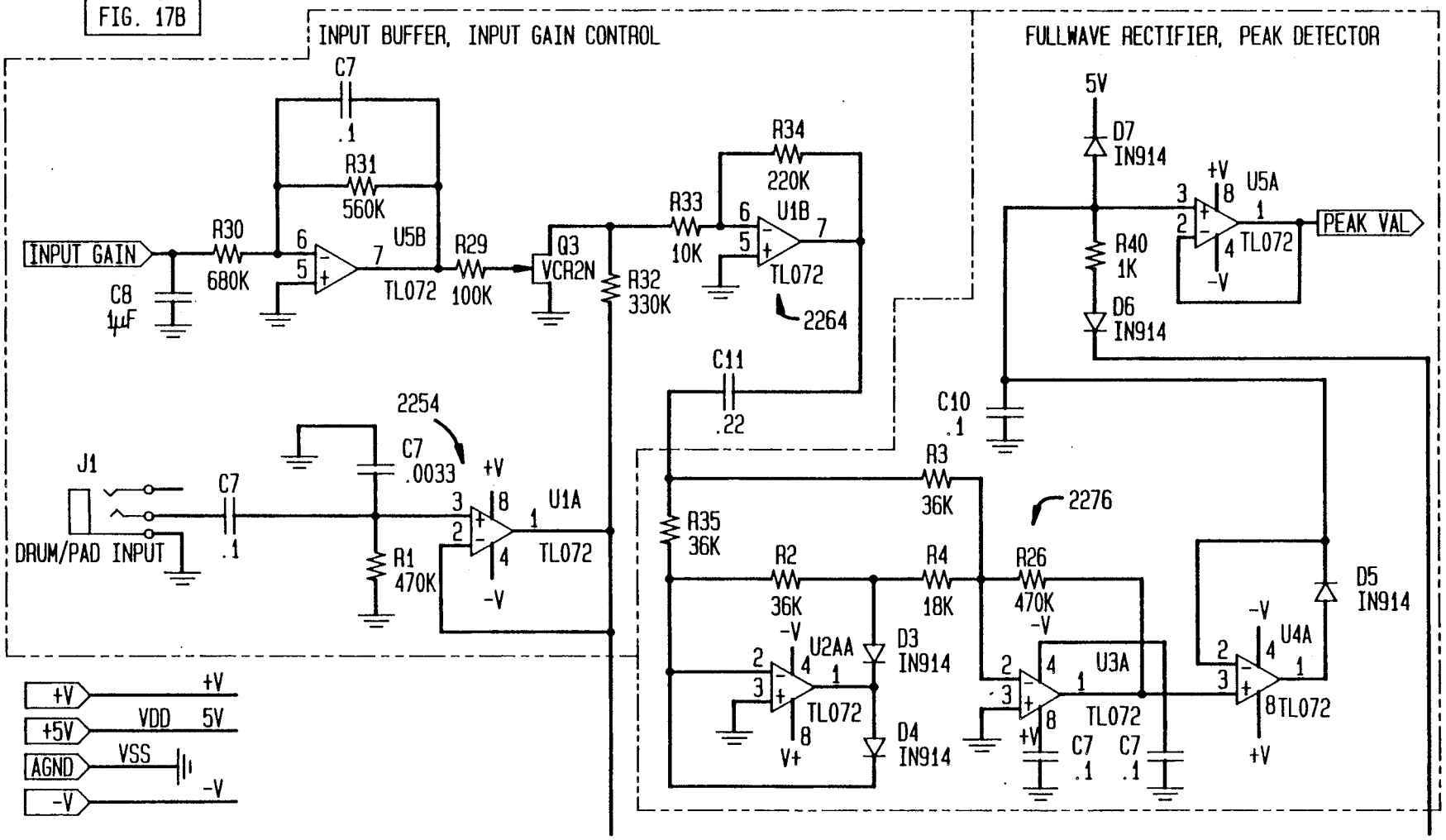
FIGS. 17A and 17B constitute a schematic diagram similar to FIG. 6 but depicting an alternate embodiment of the circuit.
Figure 17B:
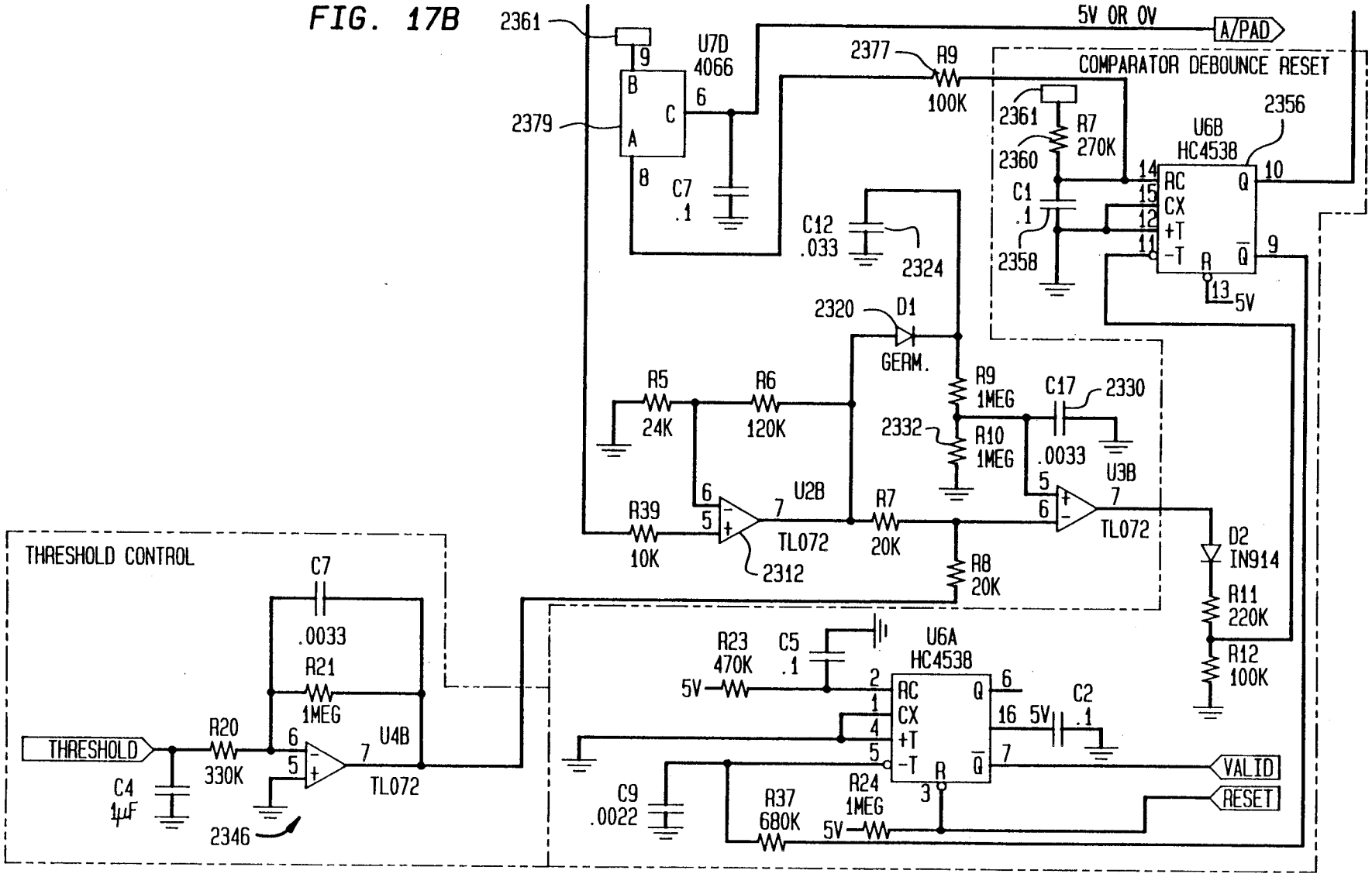

Each voice unit also includes a reverse anti-aliasing filter 1304 connected to the output channel 1190 of the unit and an analog to digital converter 1036 connected to data latch 1126. These components may be employed during processing of an external input signal applied through connection 1032. The processed signal is filtered in the reverse anti-aliasing filter 1032 to remove components having frequencies more than one-half of the sampling frequency (i.e., more than about 20 kHz) and the so-filtered signal is delivered to the digital to analog converter 1036. The digital to analog converter 1036 converts the analog signal to a series of digital values, which values are delivered by data latch 1126 to the microprocessor 1094. The microprocessor 1094 sends these values via the I-latch 1100 onto the digital data bus 1030. Thus, each voice unit may serve in place of the digitizer 56 utilized in the embodiment discussed above with reference to FIG. 1. As discussed above, the digitized signals can be used either for direct to disk digital recording or else stored as waveform data for use in later performances using the synthesizer. For example, a signal from one output unit 1078 may be connected into the external input connection 1032 of a voice unit. In this arrangement, the musician can actuate the synthesizer to produce a signal simulating a particular instrument and send that sound into the external input connection of one voice unit. The musician may set the equalizers 1148–1150 of that voice unit to modify the sound, and the modified sound can be digitized and stored in the common memory unit of the synthesizer in place of the original waveform data used to create the sound. In effect, the musician can retune and reconfigure the instrument as desired. Normally, each voice unit is used at any given time either as an analog signal generator or as a digitizer, but not both. Using plural voice cards to modify externally applied signals and using the output units to mix these modified signals, the musician can mix, equalize and digitally record sound on multiple channels. In effect, the synthesizer can perform the functions normally performed by a complete recording studio A strike detection circuit in accordance with another embodiment of the invention is illustrated in FIG. 17. This circuit is similar to the circuit discussed above with reference to FIG. 6. However, in the circuit of FIG. 17 the signal from the input buffering amplifier 2254 is sent directly to the input of trigger value operational amplifier 2312 as well as to the full wave rectification circuit 2276 via amplifier 2264. Thus, the signal representing the strike intensity delivered to the input of the trigger value amplifier 2312 in this embodiment is an unrectified signal, rather than the full wave rectified signal. The output signal from amplifier 2312 is effectively half wave rectified by diode 2320, and the rectified signal is employed to charge trigger value capacitors 2324 and 2330. The adjustable rumble gain amplifier 308 provided between the full wave rectifying circuit and the input of the trigger value amplifier in the circuit of FIG. 6 is omitted. Further, the adjustable resistance FET 334 for controlling the discharge of trigger value capacitors 324 and 330 in FIG. 5 is omitted in the circuit of FIG. 17. Capacitors 2324 and 2330 can discharge via bleed resistor 2332. The threshold voltage applied by circuit 2346 is adjustable in the same manner as discussed above, but the decay rate of the trigger value or charge on capacitors 2324 and 2330 is not adjustable.

The resetting circuit of first monostable multivibrator 2356 includes a resistor 2360 connected to a fixed voltage source 2361 and a capacitor 2358 similar to the corresponding elements 360, 361 and 358 discussed above with reference to FIG. 6. In the circuit of FIG. 17, an auxiliary resistor 2377 is connected via a digitally controllable switch 2379 to voltage source 2361. Switch 2379 can be actuated either to connect resistor 2377 in parallel with resistor 2360 or disconnect resistor 2377. With resistor 2377 connected, the reset time of the first monostable multivibrator 2356 is reduced, and hence the inhibit interval of the circuit is also reduced. Normally, the reduced interval is used where the transducer inputs applied to the strike detection circuit are taken from practice pads or the like having minimum acoustic response. Conversely, the longer inhibit interval is employed where the transducer is mounted on a real drum or the like having substantial acoustic response.

As will be appreciated, numerous variations and combinations of the features discussed above may be employed. Merely by way of example, although the discussion above has emphasized use of the synthesizer to simulate percussive sounds, it should be appreciated that the synthesizer can also simulate other sounds. Where the synthesizer is operated to simulate a generally periodic sound such as the sound from an organ pipe or the like, the same waveform data can be applied repetitively during the periodic portion of the sound. Also, the various control parameters may vary slowly or not at all during simulation of a tonal, periodic sound. In general, the demands on the synthesizer during simulation of periodic sounds are far less stringent than those imposed by simulation of percussive sounds. Also, in the discussions above, the terms "instrument" and "vibratory element" have been employed essentially interchangably. However, it should be appreciated that the synthesizer may be used to simulate one or more instruments wherein each instrument includes a plurality of vibratory elements. For example, a piano is a single instrument, but includes a plurality of vibratory elements. Where the synthesizer is employed to simulate such an instrument, the synthesizer normally is arranged to treat each vibratory element, such as each string of a piano, separately, as if it were a separate instrument.

As these and other variations and combinations of the features described above can be utilized without departing from the spirit of the present invention, the foregoing description of the preferred embodiments should be taken by way of illustration rather than by way of limitation of the present invention as defined in the claims.

What is claimed is:

1. A synthesizer comprising:

(a) reproduction means for accepting input signals and producing, responsive to said input signals, output signals simulating sounds emitted by a vibratory element of a musical instrument so that each said output signal simulates the sound emitted by said vibratory element in response to one excitation thereof; and (b) overlap means operative when said input signals call for said reproduction means to produce overlapping output signals simulating overlapping sounds emitted by said vibratory element upon closely-spaced excitations thereof for altering at least one of said output signals to change the individual sound simulated by each said altered output signal and thereby simulate a change in sound produced by said vibratory element occasioned by said closely spaced excitations.

2. A synthesizer as claimed in claim 1 wherein said reproduction means includes means for producing output signals simulating sounds emitted by a plurality of separate vibratory elements and wherein said overlap means includes means for determining if said input signals call for said reproduction means to simulate overlapping sounds emitted by one of said vibratory elements and altering at least one of said output signals simulating sounds emitted by said one of said vibratory elements.

3. A synthesizer as claimed in claim 1 wherein said reproduction means includes means for accepting input signals incorporating information defining magnitude of excitation and wherein said overlap means includes means for varying said at least one of said output signals to a degree dependent upon the magnitude of excitation defined by at least one of said input signals.

4. A synthesizer as claimed in claim 3 wherein said reproduction means includes means for accepting said input signals in temporal sequence and providing output signals in temporal sequence corresponding to the temporal sequence of said input signals.

5. A synthesizer as claimed in claim 4 wherein said means for providing output signals in temporal sequence includes means for providing an output signal responsive to each said input signal substantially immediately after receipt of such input signal.

6. A synthesizer as claimed in claim 5 wherein said overlap means includes means for altering an earlier output signal produced in response to an earlier input signal dependent upon the magnitude of excitation information in a later input signal.

7. A synthesizer as claimed in claim 5 wherein said overlap means includes means for altering a later output signal produced in response to a later input signal dependent upon the magnitude of excitation information in an earlier input signal.

8. A synthesizer as claimed in claim 4 wherein said reproduction means includes means for providing said output signals so that each output signal includes frequency information specifying frequencies in a sound to be simulated and wherein said overlap means includes means for altering said frequency information.

9. A synthesizer as claimed in claim 8 wherein said reproduction means includes waveform data storage means for storing a series of amplitude values representing a sound to be simulated, readout means for reading said stored series of amplitude values from said memory means at a preselected rate to provide a readout signal simulating a waveform, whereby said readout signal will include frequencies dependent upon said readout rate, and means for processing said readout signal to provide said output signal, said reproduction means further including means for selecting said rate dependent upon magnitude of excitation information in one of said input signals to provide an output signal responsive to said one of said input signals having frequency content dependent upon the magnitude of excitation information in said one of said input signals, said overlap means including means for adjusting said rate dependent upon the magnitude of excitation information in another one of said input signals.

10. A synthesizer as claimed in claim 9 wherein said means for adjusting said rate includes means for increasing said rate by an amount directly related to the magnitude of excitation indicated by said magnitude of excitation information in said another one of said input signals.

11. A synthesizer as claimed in claim 9 wherein said waveform data storage means includes means for storing a plurality of series of amplitude values representing a plurality of different sounds associated with a plurality of vibratory elements to be simulated, said readout means includes a plurality of voice units each operative to select one of said stored series and read out the selected stored series in response to a command specifying the particular series and specifying a readout rate and to continue such reading until further command is received or the end of the series is reached, said reproduction means further comprising command means for issuing, in response to each said input signal, a command indicating the identity of one of said plurality of stored series and a readout rate to one of said voice units, said overlap means including means for issuing, in response to a newly received input signal, a new command to one or more of said voice units which had been previously actuated in response to previous input signals.

12. A music synthesizer comprising:

(a) actuation means for providing input signals so that each such input signal includes an actuation strength value in a range between a weakest-actuation value and a strongest actuation value;

(b) generation and processing means for generating signals representing waveforms responsive to said input signals and processing said waveform-representing signals to derive output signals representing sounds and varying in accordance with a plurality of control parameters;

(c) storage means for storing, for each of said plurality of control parameters, weakest-actuation and strongest-actuation plots of the control parameter versus time each including a series of values of the control parameter; and (d) interpolation means responsive to said input signals for interpolating between said weakest-actuation and strongest-actuation plots of each said control parameter to derive an interpolated plot of each said control parameter against time so that the interpolated plot for each said control parameter approaches said weakest-actuation plot for such parameter as the actuation strength value in the input signal approaches the weakest-actuation value and approaches the strongest-actuation plot for such parameter as the actuation strength value in the input signal approaches the strongest-actuation value and providing a series of values of each said control parameter defined by the interpolated plot thereof as values of the control parameter to said generation and processing means.

13. A synthesizer as claimed in claim 12 wherein said plurality of control parameters includes at least one frequency-related control parameter and said generation and processing means includes means for varying relative predominence of different frequencies within said output signals in accordance with said at least one frequency-related parameter.

14. A synthesizer as claimed in claim 13 wherein said plurality of control parameters includes a rate parameter, said storage means includes means for storing weakest-activation and strongest-activation plots of said rate parameter, said interpolation means includes means for providing an interpolated plot of said rate parameter, and said generation and processing means includes waveform data storage means for storing a series of amplitude values and readout means for reading out said series of values at a rate in accordance with said interpolated plot of said rate parameter to thereby provide said waveform-representing signals.

15. A synthesizer as claimed in claim 13 wherein said generation and processing means includes variable filter means for applying boost or cut of a selected magnitude to signals in a selected frequency range, and wherein said at least one frequency-related parameter includes the magnitude an sign of said boost or cut and at least one parameter specifying said range.

16. A synthesizer as claimed in claim 12 wherein said generation and processing means includes means for processing said waveform representing signal to derive stereo processed signals including spatial distribution information therefrom and wherein said at least one control parameter includes a pan parameter related to said spatial distribution information.

17. A synthesizer as claimed in claim 16 wherein said generation and processing means includes a plurality of signal paths, means for providing separate signals on each said signal path including amplitude information, and amplitude control means in each said signal path for controlling said amplitude information, said plurality of control parameters includes an overall amplitude parameter, said generation and processing means including means for adjusting each said amplitude control means responsive to said pan parameter and responsive to said overall amplitude parameter.

18. A synthesizer as claimed in claim 17 wherein said means for providing separate signals includes means for providing separate analog signals on each path, said amplitude control means includes a variable gain element on each path, and said means for adjusting said amplitude control means includes means for varying the gains of said variable gain elements relative to one another responsive to said pan parameter and means for adjusting the gains of all of said variable gain elements in unison responsive to said overall amplitude parameter.

19. A synthesizer as claimed in claim 12 including a plurality of voice units each including generation and processing means and interpolation means as aforesaid, said parameter storage means including command parameter storage means for storing a plurality of sets of plots of said control parameters, each such set including a strongest-actuation plot and a weakest-actuation plot of each said control parameter, each said set being associated with simulation of a different sound, each said generation and processing means of each said voice unit being operative to provide a waveform-representing signal associated with any of said different sounds, said actuation means including command means for selecting one of said voice units and one of said different sounds, instructing the generation and processing means of the selected voice unit to generate the waveform-representing signal associated with the selected sound, routing the set of plots of said control parameters associated with the selected sound to the interpolation means of the selected voice unit and providing an actuation strength value associated with the selected sound to the interpolation means of the selected voice unit.

20. A synthesizer as claimed in claim 19 wherein said generation means of each said voice unit includes means for accepting a series of digital amplitude values and generating an analog signal therefrom, the synthesizer further comprising common waveform data storage means for storing a plurality of series of digital amplitude values associated with said different sounds, said command means including means for routing a series of digital amplitude values associated with the selected sound to the selected one of said voice units.

21. A synthesizer as claimed in claim 20 wherein said common parameter storage means includes means for storing each said set of plots as a plurality of series of digital values, said interpolation means including means for accepting the plural series of digital values representing a set of plots and providing a series of values of each said control parameter responsive thereto.

22. A synthesizer as claimed in claim 21 wherein each said voice unit includes a multifunction microprocessor, and waveform digital-to-analog conversion means, said multifunction microprocessor being operative to accept said digital amplitude values from said common waveform data storage means are provide these values to said waveform digital-to-analog conversion means at a preselected sample rate, said multifunction microprocessor also being operative to accept said series of values defining the selected set of plots from said common parameter storage means, and derive therefrom a plurality of further series of values defining said interpolated plots.

23. A synthesizer comprising:

(a) reproduction means for accepting input signals calling for sounds simulating sounds emitted by a plurality of different musical instruments and emiting output signals representing sounds responsive to said input signals, said reproduction means being capable of emitting at most a predetermined maximum number of output signals simultaneously;

(b) priority means for calculating and attributing a value to a score for each output signal depending upon a plurality of factors for each said output signal including the identity of the instrument simulated determining whether input signals will require said reproduction means to emit more than said predetermined maximum number of output signals simultaneously and, if so, causing said reproduction means to emit one or more output signals having the lowest valued scores so that the number of output signals remaining is no greater than said predetermined maximum number.

24. A synthesizer as claimed in claim 23 wherein said priority means includes means for determining, with respect to each output signal in plurality of output signals to be emitted simultaneously, the number of other output signals in said plurality simulating the same instrument, assigning a value depending upon said number and considering said value depending upon said number as one of said factors in computation of the score for such output signal.

25. A synthesizer as claimed in 23 further comprising automatic echo means for automatically providing echo signals responsive to some or all of said input signals, said reproduction means being operative to produce output signals responsive to said echo signals as well as said input signals, said priority means including means for determining whether each output signal is to be emitted in response to an input signal or in response to an echo signal and assigning an echo factor value dependent upon such determination and considering said echo factor value in computation of said scores.

26. A synthesizer as claimed in claim 23 wherein said priority means includes means for maintaining a running score for each output signal assigning an initial value to the running score for each said output signal depending upon the identity of the instrument simulated, means for ordering all of the output signals to be emitted simultaneously simulating the same instrument according to an initial amplitude value for each such output signal, means for assigning a score decrement to each said output signal depending upon its rank in such order, and means for decrementing the running score for each output signal by its score decrement when a new input signal is received.

27. A synthesizer as claimed in claim 26 further comprising automatic echo means for automatically providing echo signals each specifying a particular instrument to be simulated responsive to some or all of said input signals, said reproduction means being operative to produce output signals responsive to said echo signals as well as said input signals, said priority means including means for assigning a lower initial value for said running score to an output signal produced responsive to one of said echo signals then to an output signal simulating the same instrument produced responsive to one of said input signals.

28. A synthesizer as claimed in claim 27 further comprising tie breaker means for determining, as between two or more output signals having equal running scores constituting the lowest running score of all output signals, which, of such output signals is responsive to the oldest input signal and causing said reproduction means to emit such output signal.

29. A synthesizer as claimed in claim 23 wherein said reproduction means includes a plurality of individual voice units, each said voice unit including means for emitting one and only one output signal at any time, whereby said predetermined maximum number of output signals is equal to the number of said voice units.

30. A synthesizer as claimed in claim 29 wherein said priority means includes means, operative on receipt of a new input signal for determining whether or not one of said voice units is unoccupied, and, if so, assigning the unoccupied voice unit to produce an output signal responsive to said new input signal without regard to said scores.

31. An synthesizer as claimed in claim 30 wherein said means for determining whether or not one of said voice units is unoccupied includes means for determining whether the last output signal emitted by each said voice unit has decayed to less than a predetermined threshold and considering said voice unit as unoccupied if the last emitted output signal has so decayed.

32. A synthesizer comprising:

(a) a plurality of voice units, each having means for generating a voice signal simulating any of several instruments;

(b) a plurality of output units;

(c) switchable connector means for selectively interconnecting said output units and said voice units; and (d) command means for allocating said voice units to instruments, actuating each said voice unit to generate a voice signal simulating the instrument allocated thereto and altering said allocating from time to time while controlling said switchable connector means to route said voice signals simulating particular instruments to particular ones of said output units according to a predetermined pattern of correlation between instruments and output units.

whereby each said voice unit will produce voice signals simulating different instruments from time to time but voice signals simulating a particular instrument will be routed to a particular one or to particular ones of said output units according to said pattern of correlation.

33. A synthesizer as claimed in claim 32 wherein said switchable connector means includes an output bus having a plurality of output bus channels, means for connecting each said voice unit to predetermined ones of said output bus channels and selectively operable output unit switching means for connecting each said output unit to one or more of said bus channels responsive to commands from said command means.

34. A synthesizer as claimed in claim 33 wherein said selectively operable output unit switching means includes means for connecting each said output unit to a plurality of said output bus channels simultaneously and wherein each said output unit includes means for mixing signals received from plural output bus channels to provide a composite output signal.

35. A synthesizer as claimed in claim 34 wherein said output unit switching means includes controllable means for varying the relative proportions of signals taken from different ones of said output bus channels in the composite output signal of each output unit.

36. A synthesizer as claimed in claim 35 wherein said command means include mean for controlling said controllable means for selecting the proportion of signals from said plural output bus channels so as to change such proportions concomitantly with changes in the allocation of said voice units to different instruments.

37. A synthesizer as claimed in claim 35 further comprising infeed means for accepting signals from external sources and applying said signals from said external sources to predetermined ones of said output bus channels, and wherein said command means includes means for actuating said output unit switching means to connect one or more of said output units to one or more of said predetermined ones of said bus channels, whereby each so connected output unit will provide a composite output signal including signals representative of said signals from said external source.

38. A synthesizer as claimed in claim 37 wherein said infeed means includes a plurality of ports and means for delivering external signals applied it each port to one or more pre-selected ones of said bus channels.

39. A synthesizer as claimed in claim 38 wherein said output bus includes voice unit channels and excess channels, said means for connecting said voice units to said bus including means for connecting said voice units only to said voice unit channels, whereby no voice units are connected to said excess channels, and wherein said infeed means includes means for conducting signals applied to said ports only to said excess channels.

40. A synthesizer as claimed in claim 34 wherein said means for connecting said voice units to said output bus channels includes means for connecting each said voice unit to only one of said output bus channels.

41. A synthesizer as claimed in claim 34 further comprising common memory means for storing information defining signals to be generated for notes sounded by each instrument to be simulated, each of said voice units including means for taking information from said common memory means and generating the voice signal of that voice output unit depending upon said information.

42. A synthesizer as claimed in claim 41 wherein said common memory means includes digital waveform memory means for storing waveforms corresponding to the waveforms of instruments to be simulated as separate series of digital values synthesizer further comprising a digital data bus, said means in each said voice unit for taking information from said common memory including means for accessing said digital waveform memory via said digital data bus.

43. A synthesizer as claimed in claim 42 wherein said digital data bus includes a plurality of digital/voice unit connectors at least equal in number to the number of said voice units, said output bus includes a plurality of voice/output connectors at least equal in number to the number of said voice units, and wherein each of said voice units is releasably connected to the digital data bus and to the output bus via said digital/voice unit connectors and said voice/output connectors, respectively.

44. A synthesizer as claimed in claim 43 wherein the number of said digital/voice unit connectors and the number of said voice unit/output connectors are each greater than the number of said voice units, whereby additional voice units may be installed by releasably connecting the same to said digital bus and said output bus via unused ones of said connectors.

45. A synthesizer as claimed in claim 43 wherein said output bus includes a plurality of output bus/output unit connectors at least equal in number to the number of said output units, each said output unit being releasably connected to said output bus via one of said output bus/output unit connectors.

46. A synthesizer as claimed in claim 42 wherein each said voice unit includes digital processing means for drawing digital amplitude values from said common memory via said digital data bus and providing said values in series, digital to analog conversion means for converting said series of digital amplitude values to an analog signal and analog processing means for adjusting said analog signal and providing said adjusted analog signal as the voice signal, said digital processing means and analog processing means being releasably connected to one another, said digital processing means being connected to said digital data bus, said analog signal processing means being connected to said output bus.

47. A synthesizer as claimed in claim 32 wherein said means for generating a voice signal in each of said voice units includes means for generating the voice signal in the form of an analog audio frequency signal.

48. A synthesizer as claimed in claim 47 wherein each of said output units includes means for amplifying voice signals directed thereto.

49. A synthesizer as claimed in claim 47 wherein said means for generating a voice signal in each of said output units includes means for generating an audio frequency waveform signal and means for processing said waveform signal, and wherein at least one of said voice units incorporates external signal input means for accepting an external audio frequency analog signal and means for passing the external signal through the signal-processing means of the voice unit so that the processed external signal is supplied by the voice unit instead of the normal voice signal.

50. A synthesizer as claimed in claim 32 wherein said command means includes means for accepting control inputs representing notes played on various instruments to be simulated and allocating a voice unit to a particular instrument upon receipt of each control input calling for a note to be sounded simulating that particular instrument.

51. A synthesizer as claimed in claim 50 wherein said means for allocating voice units includes means for allocating any voice units which are available upon receipt of a control input substantially at random and without regard to the identify of the particular voice units, whereby there is no long-term correlation between the identities of various ones of said voice units and the instruments simulated thereby.

* * * * *

UNITED STATES PATENT AND TRADEMARK OFFICE

CERTIFICATE OF CORRECTION

PATENT NO. : 4,998,960

DATED : March 12, 1991

INVENTOR(S) : Rose, et al.

It is certified that error appears in the above-identified patent and that said Letters Patent is hereby corrected as shown below:

Column 5, line 38, "vibrator" should read --vibratory--.

Column 11, line 14, "amoung" should read --among--.

Column 13, line 32, "40" second occurrence should read --42--.

Column 13, line 34, ".." should read --. --.

Column 14, line 48, "inputs" should read --input--.

Column 15, line 63, "ram" should read --RAM--.

Column 16, line 3, after "132 first occurrence insert --. --.

Column 16, line 33, "150" should read --158--.

Column 16, line 53, "buss" should read --bus--.

Column 16, line 65, ".." should read --. --.

Column 17, line 24, after "184" insert --. --.

Column 17, line 65, after "channels" first occurrence insert --. --.

Column 18, line 3, "righthand" should read --right-hand--.

Column 18, line 4, "214" should read --212--.

Column 18, line 7, "voice output" should read --voice/output--.

Column 18, line 53, "resistors" should read --resistor--.

UNITED STATES PATENT AND TRADEMARK OFFICE

CERTIFICATE OF CORRECTION

PATENT NO. : 4,998,960

DATED : March 12, 1991

INVENTOR(S) : Rose, et al.

It is certified that error appears in the above-identified patent and that said Letters Patent is hereby corrected as shown below:

Column 19, line 61, "24" should read --246--.

Column 19, line 65, after "of" insert --a--.

Column 21, line 36, "vibrator" should read --multivibrator--.

Column 22, line 8, "300" should read --288--.

Column 22, line 54, after "signal" insert --. --.

Column 23, line 44, "multivibrato" should read --multivibrator--.

Column 25, line 53, "aWay" should read --away--.

Column 27, line 60, ""windows" should read --"windows"--.

Column 28, line 19, "next"" should read --"next"--.

Column 28, line 34, delete "is".

Column 28, line 52, after "devices" insert --. --.

Column 30, line 52, after "$t_s$" insert --=--.

Column 31, line 38, "an" should read --and--.

Column 31, line 40, delete "of" <u>second occurrence</u>.

Column 31, line 55, after "with" insert --a---.

Column 32, line 57, "ram" should read --RAM--.

UNITED STATES PATENT AND TRADEMARK OFFICE

CERTIFICATE OF CORRECTION

PATENT NO. : 4,998,960

DATED : March 12, 1991

INVENTOR(S) : Rose, et al.

It is certified that error appears in the above-identified patent and that said Letters Patent is hereby corrected as shown below:

Column 33, line 66, "9" should read --94--.

Column 35, line 41, "tINT typically" should read --$t_{INT}$ typically--.

Column 36, line 20, "non-invented" should read --noninverted--.

Column 36, line 22, "o" should read --or--.

Column 38, line 8, "signals" should read --signal--.

Column 38, line 27, "millisecond" shoud read --milliseconds--.

Column 39, line 25, "an" should read --a--.

Column 39, line 50, after "signal" insert --. --.

Column 39, line 52, "an" should read --a--.

Column 41, line 11, "send" should read --sends--.

Column 45, line 13, "a" should read --as--.

Column 46, line 45, "Variable" should read --variable--.

Column 46, line 48, "sYnthesizer" should read --synthesizer--.

Column 46, line 50, "Where as" should read --Whereas--.

Column 46, line 60, "a" should read --as--.

Column 47, line 14, "contruction" should read --construction--.

UNITED STATES PATENT AND TRADEMARK OFFICE

CERTIFICATE OF CORRECTION

PATENT NO. : 4,998,960

DATED : March 12, 1991

INVENTOR(S) : Rose, et al.

It is certified that error appears in the above-identified patent and that said Letters Patent is hereby corrected as shown below:

Column 47, line 20, "equaliziers" should read --equalizers--.

Column 47, line 47, "1075" should read --1078.--.

Column 47, line 48, "Which" should read --which--.

Column 51, line 43, "predominence" should read --predominance--.

Column 51, line 63, "an" should read --and--.

Column 53, line 2, "are" should read --and--.

Column 53, line 31, after "in" insert --a--.

Column 53, line 38, after "in" insert --claim--.

Column 54, line 26, "An" should read --A--.

Column 54, line 49, after "units" delete "." and continue sentence with "whereby".

UNITED STATES PATENT AND TRADEMARK OFFICE

CERTIFICATE OF CORRECTION

PATENT NO. : 4,998,960

DATED : March 12, 1991

INVENTOR(S) : Rose, et al.

It is certified that error appears in the above-identified patent and that said Letters Patent is hereby corrected as shown below:

Column 55, line 27, "it" should read --at--.

Column 55, line 52, after "values" insert --, the--.

Column 56, line 60, "identify" should read --identity--.

Signed and Sealed this

Twenty-fourth Day of November, 1992

*Attest:*

DOUGLAS B. COMER

*Attesting Officer*

*Acting Commissioner of Patents and Trademarks*